US008758562B2

(12) United States Patent
Krapsch et al.

(10) Patent No.: US 8,758,562 B2
(45) Date of Patent: Jun. 24, 2014

(54) METHOD FOR INCREASING THE ADVANTAGES OF STARCH IN PULPED CELLULOSIC MATERIAL IN THE PRODUCTION OF PAPER AND PAPERBOARD

(75) Inventors: Ludwig Krapsch, Winterthur (CH); Christopher John McGregor, Chester (GB); Jean Mallard de La Varende, Boulogne Billancourt (FR)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 13/818,763

(22) PCT Filed: Aug. 25, 2011

(86) PCT No.: PCT/EP2011/004253

§ 371 (c)(1),
(2), (4) Date: Mar. 19, 2013

(87) PCT Pub. No.: WO2012/025228

PCT Pub. Date: Mar. 1, 2012

(65) Prior Publication Data

US 2013/0186584 A1 Jul. 25, 2013

(30) Foreign Application Priority Data

Aug. 25, 2010 (EP) ..... 10008834
Jan. 6, 2011 (EP) ..... 11000063

(51) Int. Cl.
*D21F 11/00* (2006.01)

(52) U.S. Cl.
USPC ..... 162/141; 162/161

(58) Field of Classification Search
USPC ..... 162/141, 161
See application file for complete search history.

(56) References Cited

U.S. PATENT DOCUMENTS

| | | | | |
|---|---|---|---|---|
| 4,894,119 | A * | 1/1990 | Baron et al. | 162/168.2 |
| 2004/0171719 | A1 | 9/2004 | Neivandt et al. | |
| 2005/0155731 | A1 | 7/2005 | Martin et al. | |
| 2006/0289139 | A1 | 12/2006 | Zhang et al. | |

FOREIGN PATENT DOCUMENTS

| | | |
|---|---|---|
| DE | 2433325 | 1/1976 |
| EP | 0361763 | 4/1990 |
| EP | 517102 | 1/2001 |
| EP | 785908 | 1/2001 |
| EP | 1293482 | 3/2003 |
| EP | 1734009 | 12/2006 |
| WO | 0136740 | 5/2001 |
| WO | 2005042843 | 5/2005 |
| WO | 2006014426 | 2/2006 |
| WO | 2006060784 | 6/2006 |
| WO | 2009059888 | 5/2009 |
| WO | 2012025228 | 1/2012 |

OTHER PUBLICATIONS

Biocide Busan™ 1130, Buckman Laboratories International, Property Data Sheet, Nov. 1984.*

I.M. El-Sherbiny et al. Preparation, characterization, swelling and in vitro drug release behavior of poly(N-acryloylglycine-chitosan) interpolymeric pH and thermally-responsive hydrogels. European Polymer Journal 2005, 41, 2584-2591.

D.H. Everett, Manual of Symbols and Terminology for Physicochemical Wuantities and Units. Appendix II, Part I: Definitions, Terminology and Symbols in Colloid and Surface Chemistry. Pure & Applied Chemistry 1972, 31, 579-638.

G.P. Moss et al. Glossary of Class Names of Organic Compounds and Reactive Intermediates Based on Structure. Pure & Applied Chemistry 1995, 67, 1307-1375.

A.D. Jenkins et al. Glossary of Basic Terms in Polymer Science. Pure & Applied Chemistry 1996, 68, 2287-2311.

International Search Report PCT/EP2011/004253, dated Nov. 24, 2011, pp. 1-2.

* cited by examiner

*Primary Examiner* — Mark Halpern
(74) *Attorney, Agent, or Firm* — Joanne Rossi; Michael Herman

(57) ABSTRACT

The invention relates to a method for increasing the benefit from starch in pulped, preferably repulped cellulosic material at paper or paperboard manufacturing comprising the steps of (a) pulping a cellulosic material containing a starch; (b) treating the cellulosic material containing the starch with one or more biocides, preferably in the thick stock area; and (h) adding an ionic polymer and preferably, an auxiliary ionic polymer to the cellulosic material; wherein the ionic polymer and the optionally added auxiliary ionic polymer preferably have a different average molecular weight and preferably a different ionicity, wherein the ionicity is the molar content of ionic monomer units relative to the total amount of monomer units.

31 Claims, 11 Drawing Sheets

Dewatering impact

Drainage curve vs progam

Bone dry evolution and floc size vs Program

Turbidity of the filtrate DFR study

Total retention impact vs treatment

Drainage curves vs program
DFR study
grams
350
300
250
200
150
100
50
0
0
5
10
15
20
25
30
35
40
45
seconds
Reference
Reference + Poly A:0.5kg/t
Reference + Poly A: 1kg/t
Reference + Poly A: 1.5 kg/t
Reference+ Poly A:2 kg/t
Reference+ Poly A:2 kg/t
Reference + Poly A:0.5kg/t
Reference % of water recovered vs reference DFR study

METHOD FOR INCREASING THE ADVANTAGES OF STARCH IN PULPED CELLULOSIC MATERIAL IN THE PRODUCTION OF PAPER AND PAPERBOARD

This application claims the benefit of PCT/EP2011/004253, Filed 25 Aug. 2011, the entire contents of which are hereby incorporated by reference.

FIELD OF THE INVENTION

The invention relates to a method for manufacturing paper or paperboard from pulped, preferably repulped cellulosic material. The method increases the benefit of starch in pulped, preferably repulped cellulosic material at paper or paperboard manufacturing by (a) pulping a cellulosic material containing a starch, (b) treating the cellulosic material containing the starch with one or more biocides, preferably in the thick stock area, and (h) adding an ionic polymer and preferably, an auxiliary ionic polymer to the cellulosic material; wherein the ionic polymer and the optionally added auxiliary ionic polymer preferably have a different average molecular weight and preferably a different ionicity, wherein the ionicity is the molar content of ionic monomer units relative to the total amount of monomer units.

BACKGROUND PRIOR ART

Paper manufacture is among the most water intensive industries. In the course of the paper making process, at various stages substantial amounts of water and aqueous solutions are added to the cellulosic fibers (inflow stream) and separated there from, respectively (effluent stream). Typically, in the course of the process, a relatively concentrated aqueous slurry of cellulosic material, the so-called "thick stock", is diluted by addition of water, thereby yielding a relatively diluted aqueous slurry of cellulosic material, the so-called "thin stock".

As a result of growing concern for the purity of water resources and in response to growing governmental pressures to maintain the quality of these water resources, paper industry has been required to investigate and implement methods for reducing chemical pollutants contained in their effluent water streams. The danger of chemical pollution in water is due to the ability of organic constituents of the effluent streams of paper mills to bind dissolved oxygen contained in the water. This binding, whether by chemical reaction or simple chemical interaction, prevents the utilization of dissolved oxygen by aquatic life. The effect of this binding is commonly referred to as chemical oxygen demand (COD).

It is well known that the higher the COD of the waste water to be treated, the more ineffective, more unreliable and more expensive are these processes.

Because of the importance of maintaining adequate levels of dissolved oxygen in water streams, various governmental agencies have set forth guidelines and test procedures for measuring the COD of effluent streams of paper mills entering rivers and lakes. Various processes have been implemented to improve the quality of the water discharged. Among the methods proposed are (1) evaporation followed by incineration, (2) chemical treatment to render the organic constituents in the effluent harmless, (3) biological treatment and aeration of effluent collected in holding tanks, and (4) oxidation of the chemical constituents under restrictive conditions.

WO 01/36740 discloses papermaking processes using enzyme and polymer compositions. The polymer compositions typically contain starch, i.e. fresh starch is added to the system. The reference is fully silent on recycling of starch originating from waste paper. A biocide may be added to the pulp or treated pulp. For example, a biocide may be added to the treated pulp in a blend chest after the pulp has been treated with the enzyme and cationic polymer. The teaching of the reference is focused on utilization of enzymes. It is well known that some biocides interfere with enzymes. The reference does not require the presence of biocide, but merely discloses this as an option to be used in conventional ways for papermaking. There is no hint in the reference that starch degradation can be prevented by addition of biocide, let alone that the thus non-degraded starch can be refixated to the cellulose fibers by means of ionic polymers.

From EP 0 361 736 compositions containing a starch and a flocculating agent intended for use in a paper- or boardmaking furnish are known. US 2006/289139 discloses a method of improving retention and drainage in a papermaking process. The method provides for the addition of an associative polymer, starch or a starch derivative and optionally a siliceous material to the papermaking slurry.

These processes, however, are not satisfactory in every respect and thus, there is a demand for a method for manufacturing paper, paperboard or cardboard which reduces the COD of the waste water that is produced at the individual stages of the paper manufacturing process including the early stages.

Starch, particularly non-ionic, anionic, cationic and/or native starch, that is released in the wet end of a papermaking machine by the pulping of waste paper or broke is not fixed to fiber except through natural retention and it does not usually contribute to strength parameters. Further, degradation of the starch usually through microbiological activity causes an increase in biological oxygen demand (BOD) and electrical conductivity and a drop in pH due to the creation of organic acids in the papermaking machine system. This leads to deposition, increased need for microbiological control programs, higher uses of new internal or surface starch to reach strength targets and even up to reduced machine productivity. BOD contributes to COD and gives problems in reaching consent targets from the effluent plant.

For production of woodfree uncoated and coated fine papers up to 40 kg starch per ton of paper are applied. Packaging paper made from 100% recovered paper can only be produced economically and in the required quality by adding cost effective biosynthetic starch products. Therefore, these papers are produced with an average starch consumption of 40 kg $t^{-1}$, mainly by surface application. A further 25 kg $t^{-1}$ is applied as an adhesive in the converting plant. This means that a high amount of starch is typically returned to the production process via recovered papers, where conventionally it is nearly not retained in the paper sheet. Therefore, this uncontrolled starch quantity leads to a considerable load in the white water circuit (usual COD levels from 5,000 to 30,000 mg $O_2$ $l^{-1}$) and finally also in the waste water (cf. H Holik, Handbook of paper and board, Wiley-VCH Verlag GmbH & Co. KGaA, 1st ed, 2006, Chapter 3.4.3).

Thus, there is a demand for a method for manufacturing paper, paperboard or cardboard which overcomes these drawbacks of the prior art.

SUMMARY OF THE INVENTION

The invention relates to a method for manufacturing paper, paperboard or cardboard comprising the steps of (a) pulping a cellulosic material containing a starch;

(b) treating the cellulosic material containing the starch with one or more biocides, preferably in the thick stock area, preferably thereby preventing microbial degradation of at least a portion of the starch; and (h) adding an ionic polymer and preferably, an auxiliary ionic polymer to the cellulosic material, preferably in the thick stock area, where the cellulosic material preferably has a stock consistency of at least 2.0%; or preferably in the thin stock area, where the cellulosic material preferably has a stock consistency of less than 2.0%;

wherein the ionic polymer and the auxiliary ionic polymer preferably have a different average molecular weight and preferably a different ionicity, wherein the ionicity is the molar content of ionic monomer units relative to the total amount of monomer units.

Preferably, the ionic polymer and the optionally present auxiliary ionic polymer are both cationic.

Preferably, step (h) comprises the substeps ($h_1$) adding an ionic, preferably a cationic or anionic polymer to the cellulosic material, preferably in the thick stock area, where the cellulosic material preferably has a stock consistency of at least 2.0%; or preferably in the thin stock area, where the cellulosic material preferably has a stock consistency of less than 2.0%; and, ($h_2$) preferably, adding an auxiliary ionic, preferably cationic polymer to the cellulosic material, preferably in the thick stock area where the cellulosic material preferably has a stock consistency of at least 2.0%; or preferably in the thin stock area, where the cellulosic material preferably has a stock consistency of less than 2.0 wt.-%;

wherein the ionic polymer and the auxiliary ionic polymer preferably have a different average molecular weight and preferably a different ionicity, wherein the ionicity is the molar content of ionic monomer units relative to the total amount of monomer units.

Further, the invention relates to a method to increase the strength of paper, paperboard or cardboard comprising steps (a), (b) and (h), wherein step (h) can be divided in substep ($h_1$) and substep ($h_2$), as described above. Unless expressly stated otherwise, for the purpose of the specification, any reference to step (h) also independently of one another refers to substeps ($h_1$) and ($h_2$). Still further, the invention relates to a method to increase papermaking machine drainage and/or production rate comprising steps (a), (b) and (h) as described above. Yet further, the invention relates to a method to reduce the effluent COD in the papermaking process comprising steps (a), (b) and (h) as described above.

Preferably, step (b) is performed at least partially simultaneously with step (a) or after step (a). Preferably, step (h) is performed at least partially simultaneously with step (a) or after step (a). Preferably, step (h) is performed at least partially simultaneously with step (b) or after step (b).

It has been found that treating of waste paper or broke with a sufficient amount of a suitable biocide, e.g. an oxidizing and/or non-oxidizing biocide program, during or after pulping, can prevent microbiological degradation of starch contained in waste paper or broke. Fixation, preferably re-fixation, of this non-degraded starch, particularly if it is a nonionic, anionic, cationic and/or native starch, preferably a nonionic, anionic, and/or native starch, to the cellulosic fibers can be achieved by the addition of a cationic polymer, preferably added in the thick stock area, thereby providing reduced whitewater solids, reduced whitewater turbidity, increased retention, increased sheet strength and/or reduction of COD. In a preferred embodiment, this effect can be "switched on and off", i.e. when the ionic polymer, preferably cationic polymer is employed, the effect is observed after a moment, and when its addition is interrupted, the effect disappears after a moment. Further, it has been surprisingly found that the reduction of starch in the system due to its (re-)fixation to the cellulose fibers by means of ionic polymer also leads to a reduction of nutrients for the microorganisms and thus a relative reduction of biocide demand.

BRIEF DESCRIPTION OF THE DRAWINGS

FIG. 1 also shows the absorbance of said filtrates at 550 nm after being subjected to the iodine test.

The results shown in FIGS. 2-9 were performed with a thick stock of cellulosic material containing sufficient biocide to avoid degradation of starch.

Figure 10:
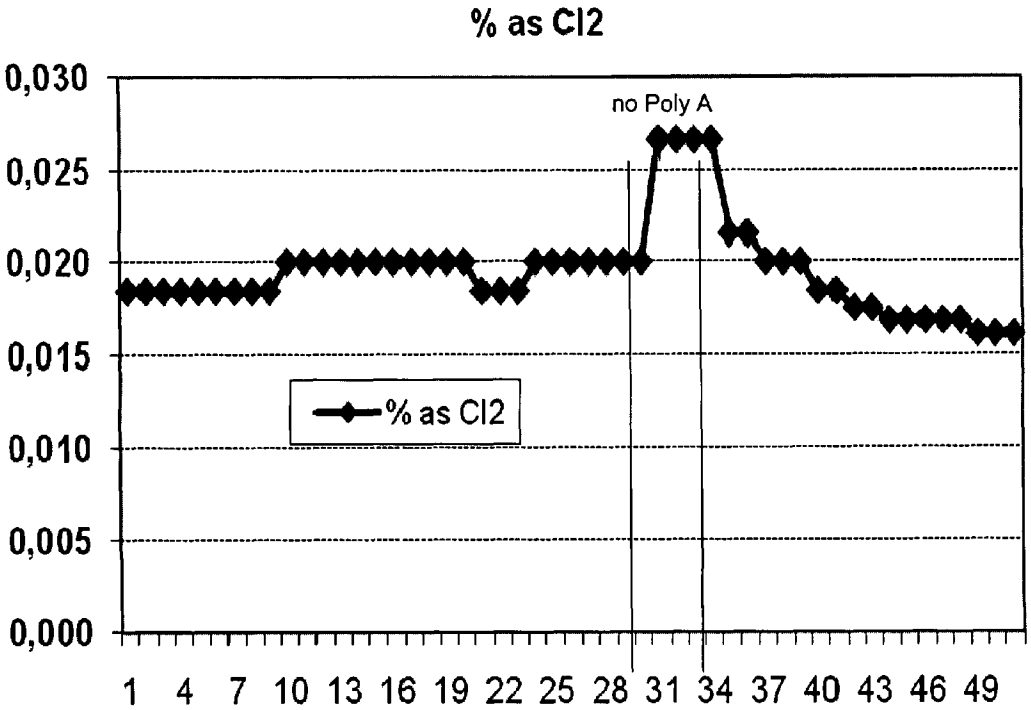

FIG. 10 shows the dose of biocide needed in order to keep the process parameters of the papermaking process constant with addition of ionic polymer (inventive) and without addition of ionic polymer (polymer).

Figure 11:
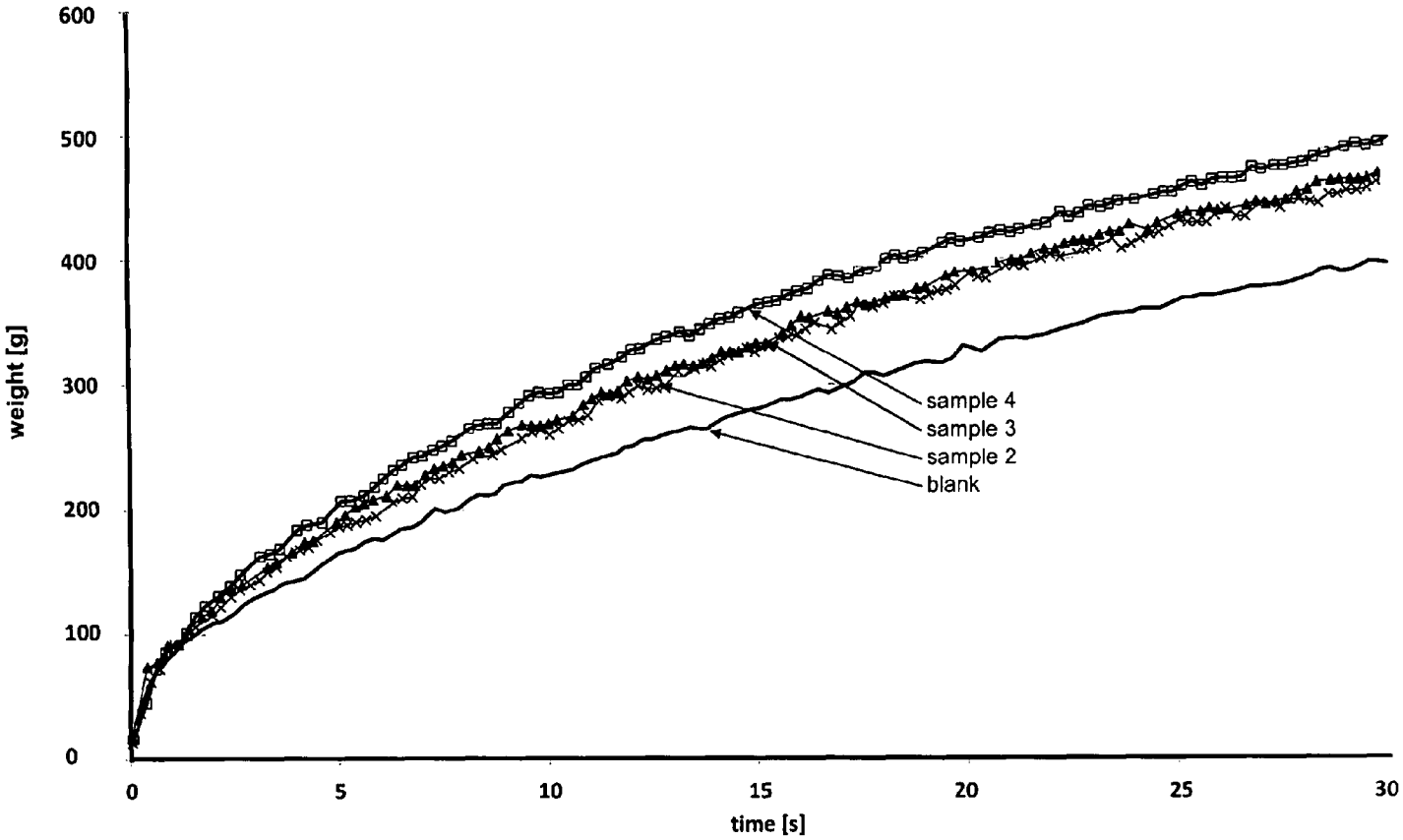

FIG. 11 shows the drainage rates (time to obtain 100, 200, 300 and 400 ml of filtrate) of inventive examples and comparative examples after being subjected to a VDT study.

DETAILED DESCRIPTION OF THE INVENTION

The control of microbiological activity in papermaking machines with both oxidizing and non-oxidizing biocides is well documented. There is also wide spread literature on the use of starch as a dry strength aid and the use of synthetic dry strength aids which can be used either in addition to starch applied at both the wet end and on the surface of the paper sheet or as full or part replacement of the starch.

The invention is concerned with the combined use of an effective biocide, e.g. an oxidizing and non-oxidizing microbiological control program, to prevent the degradation of starch (nonionic/cationic/anionic) present from the pulping of waste paper or broke and the use of an ionic polymer, preferably in combination with an auxiliary ionic polymer in order to fix the now non-degraded starch to the fiber so it is retained, thus making it available to impart strength to the final sheet and removing it from the circulation water. It has been surprisingly found that starch which is released e.g. by pulping recycled waste furnish can be reused to provide strength as long as its degradation (conventionally through microbiological activity) is prevented (amylase control) and the thus non-degraded starch is fixed to the newly formed sheet. This is especially true for non-ionic, anionic, cationic and/or native starch, for example applied to the surface of the sheet through a size press and partly released from the waste paper during pulping. In conventional processes, this released starch is generally considered as non-active starch, without the ability to be re-retained in an substantial amount in order to provide strength.

The invention relates to the use of a biocide, e.g. an oxidizing and/or non-oxidizing biocide, as the first step in preventing starch degradation by microbiological activity (amylase control), and the use of an ionic, preferably a cationic or anionic polymer, preferably a high molecular weight, high cationic charged polymer, preferably in combination with an auxiliary ionic, preferably cationic or anionic polymer, to fix the starch to fiber.

Thus, the method according to the invention features a two step approach: 1.) avoidance of microbiological starch degradation in board or papermaking machine approach flows with 2.) removal of the maintained starch from the papermaking machine white water system through fixation, preferably re-fixation to fiber in order to impart strength.

By controlling the microbiological degradation of the starch as it is released by the pulping process and the subsequent fixation by the high molecular weight, high charged cationic polymer, COD and electrical conductivity levels can be reduced and importantly less fresh starch is needed to reach strength specifications. Machine runnability can be improved through improved cleanliness. Importantly, COD levels can be reduced improving the load on the mill effluent plant. Cost savings from increased efficiency of machine additives, less downtime for cleaning and improved runnability are all possible.

A first aspect of the invention relates to a method for treating a cellulosic material used to manufacture paper; and/or for making a paper product; and/or for manufacturing paper, paperboard or cardboard; and/or to increase the strength of paper, paperboard or cardboard; and/or to increase papermaking machine drainage and/or production rate; and/or to reduce the effluent COD in the papermaking process; and/or to reduce the amount of nutrients for microorganisms in the cellulosic material and/or to reduce the consumption of fresh starch by recycling starch that is already contained in the starting material and/or the water circuit of the papermaking plant; the method in each case comprising the steps of (a) pulping a cellulosic material containing a starch;

(b) treating the cellulosic material containing the starch with one or more biocides, preferably thereby preventing microbial degradation of at least a portion of the starch;

(c) optionally, de-inking the cellulosic material;

(d) optionally, blending the cellulosic material;

(e) optionally, bleaching the cellulosic material;

(f) optionally, refining the cellulosic material;

(g) optionally, screening and/or cleaning the cellulosic material in the thick stock area;

(h) adding ($h_1$) an ionic, preferably a cationic polymer and preferably, ($h_2$) an auxiliary ionic, preferably cationic polymer to the cellulosic material, preferably in the thick stock area, i.e. to the thick stock, where the cellulosic material preferably has a stock consistency of at least 2.0%; or preferably in the thin stock area, i.e. to the thin stock, where the cellulosic material preferably has a stock consistency of less than 2.0%; wherein the ionic polymer and the optionally added auxiliary ionic polymer preferably have a different average molecular weight and preferably a different ionicity, wherein the ionicity is the molar content of ionic monomer units relative to the total amount of monomer units;

(i) optionally, screening and/or cleaning the cellulosic material in the thin stock area, i.e. after diluting the thick stock into a thin stock;

(j) optionally, forming a wet sheet from the cellulosic material;

(k) optionally, draining the wet sheet; and (l) optionally, drying the drained sheet.

It now has been surprisingly found that starch, such as non-ionic, cationic and anionic starch, preferably non-ionic, anionic, cationic and/or native starch, if non-degraded, may be bound, preferably rebound to the cellulose fibers, simply by pulping the cellulosic material containing said starch and treating the cellulosic material containing the starch with a sufficient amount of a suitable biocide either during pulping or shortly thereafter, thereby avoiding microbiological degradation of the starch and adding suitable amounts of suitable ionic, preferably cationic polymers in order to fixate the thus non-degraded starch, preferably non-degraded non-ionic, anionic, cationic and/or native starch, to the cellulosic fibers.

For the purpose of the specification, the term "non-degraded starch" refers to any type of starch that preferably originates from waste paper or broke and in the course of the pulping preferably has essentially maintained its molecular structure so that it remains capable of being fixated to the fibers. This does include slight degrees of degradation, but compared to conventional processes, the structure of the non-degraded starch does preferably substantially not change (in terms of microbiological degradation) during the pulping and papermaking processes.

In a preferred embodiment, the method according to the invention comprises the additional step of adding starch to the cellulosic material. Thus, in this embodiment, the starch that is processed in accordance with the invention preferably originates from two sources: the first source is the starting material, e.g. waste paper, already containing starch, and the second source is starch that is additionally added to the cellulosic material. The additionally added starch may be any type starch, i.e. native, anionic, cationic, non-ionic and the like. It may be added to the cellulosic material in the thick stock area or in the thin stock area. When it is added in the thick stock area, it is preferably added at the machine chest, more preferably to the outlet of the machine chest. Alternatively or additionally, the starch can be added at the size press. In a preferred embodiment, the starch is sprayed, e.g. in form of an aqueous solution, between the plies of a multi-ply paper, paperboard or cardboard.

The basic steps of paper manufacture are known to the skilled artisan. In this regard it can be referred to, e.g., C. J. Biermann, Handbook of Pulping and Papermaking, Academic Press; 2 edition (1996); J. P. Casey, Pulp and Paper, Wiley-Interscience; 3 edition (1983); and E. Sjöström et al., Analytical Methods in Wood Chemistry, Pulping and Papermaking (Springer Series in Wood Science), Springer; 1 edition (1999).

The raw material for paper is fiber. For the purpose of the specification, "pulping" is to be regarded as the process of separating the fibers, suitable for papermaking, from cellulosic material such as recovered (waste) paper.

Modern papermaking typically involves seven basic operations: 1) fiber pretreatment; 2) fiber blending; 3) furnish cleaning and screening; 4) slurry distribution and metering; 5) web formation and water removal by mechanical means; 6) web compaction and water removal by means of heat; and 7) sheet finishing, by means of calendering, sizing, coating, glazing, or converting of paper.

In practice, there are numerous variants of methods for manufacturing paper, paperboard or cardboard. All these variants have in common, however, that the overall method can be divided into the following sections which will be referred to the following to define preferred embodiments of the method according to the invention:

- measures taking place before pulping;
- measures associated with pulping;
- measures taking place after pulping but still outside the papermaking machine;
- measures taking place inside the papermaking machine; and
- measures taking place after the papermaking machine.

Typically, sections (I) to (II) are concerned with the processing of a thick stock of cellulosic material, whereas during section (III) the cellulosic material is converted from a thick stock to a thin stock by dilution with water, and section (IV) is thus concerned with the processing of a thin stock of cellulosic material. All areas in which measures take place before dilution, preferably during step (III) are preferably referred to as the "thick stock area", whereas the remainder is preferably referred to as the "thin stock area".

In a preferred embodiment of the invention, the water used for pulping the cellulosic material containing the starch is brought in contact with at least a part of the biocide, optionally provided as aqueous composition, in section (I) of the method for the manufacture of paper, i.e. before pulping.

In another preferred embodiment of the invention, the cellulosic material containing the starch is brought in contact with at least a part of the biocide, optionally provided as aqueous composition, in section (II) of the method for the manufacture of paper, i.e. in the course of pulping. Section (II) encompasses step (a) of the method according to the invention, whereas the supply of the cellulosic material containing the starch into the pulping device (pulper) and its removal therefrom are usually not considered as belonging to the pulping step per se, but are at least partially encompassed by section (II) as well.

In still another preferred embodiment of the invention, the cellulosic material containing the starch is brought in contact with at least a part of the biocide, optionally provided as aqueous composition, in section (III) of the method for the manufacture of paper, i.e. after pulping but still outside the papermaking machine. Preferably, the biocide is added to the cellulosic material containing the starch in the thick stock area.

Preferably, pulping is the first step in paper manufacturing where the cellulosic material is brought into contact with substantial amounts of water thereby generating aqueous slurry, i.e. an aqueous suspension of cellulosic fibers, also referred to as pulp. Said pulp forms an intermediate, fibrous material for the manufacture of paper or paperboard.

The site of pulping is referred to as the pulper, i.e. a reaction vessel used for the manufacturing of an aqueous dispersion or suspension of the cellulosic material. Sometimes, a pulper is also referred to as a hydrapulper or hydropulper.

In case that recovered (waste) paper is used as the starting material for the paper manufacturing process, suitable recovered (waste) paper is typically directly introduced to the pulper. Waste paper may be also mixed with a quantity of virgin material to improve the quality of the cellulosic material.

For the purpose of the specification, the term "cellulosic material" refers to any material comprising cellulose including recovered (waste) paper. Further, the term "cellulosic material" refers to all intermediate and final products during the paper making process, which originate from recovered (waste) paper, such as dispersions or suspensions of cellulosic material, pulped cellulosic material, de-inked cellulosic material, blended cellulosic material, bleached cellulosic material, refined cellulosic material, screened cellulosic material and the final paper, paperboard or cardboard. Therefore, the term "cellulosic material" encompasses pulp, slurry, sludge, stock, and the like.

The starch contained in the cellulosic material does not necessarily originate from the cellulose starting material (recycled material and the like). It is also possible that the entire amount of cellulose starting material is virgin material not containing any starch and that the starch contained in the cellulosic material originates from another source, preferably from a recirculation unit supplying the pulper with recycle water from the wet end of the papermaking machine.

In a preferred embodiment, the cellulosic material containing the starch originates from waste paper or broke, but may be blended with e.g. virgin material (=>recycle pulp and blended pulp, respectively).

In a preferred embodiment, the starch content of the cellulosic material containing the starch, i.e. the waste paper or broke that is employed as starting material, is at least 0.1 wt.-%, more preferably at least 0.25 wt.-%, or at least 0.5 wt.-%, or at least 0.75 wt.-%, or at least 1.0 wt.-%, or at least 1.5 wt.-%, or at least 2.0 wt.-%, or at least 3.0 wt.-%, or at least 5.0 wt.-%, or at least 7.5 wt.-%, or at least 10 wt.-%, or at least 15 wt.-%, based on the weight of dry cellulosic material.

In another preferred embodiment, the starch is added to the cellulosic material, e.g. to virgin material, in the course of paper manufacture, preferably in the thick stock area. Preferably, a portion of the freshly added starch is fixated to the cellulosic fibers before the web is formed and the water is drained off. Due to recirculation of at least a portion of the water drained from the pulp, another portion of the starch is returned to the beginning of the overall process. Thus, the starch does not necessarily originate from waste paper, but may alternatively or additionally also originate from the method itself. This embodiment is particularly preferred when the starch is non-ionic, particularly native starch. Under these circumstances, the freshly added starch is not re-fixated to the cellulose fibers but fixated.

According to the invention, the cellulosic material contains a starch. For the purpose of the specification, the term "starch" refers to any modified or non-modified starch typically employed in paper manufacture. Starch is a polysaccharide carbohydrate consisting of a large number of glucose units joined together by glycosidic bonds. Starch is produced by all green plants as an energy store. Starch is composed of two types of molecules: the linear and helical amylose and the branched amylopectin. Depending on the origin, native starch usually contains 20 to 25% amylose and 75 to 80% amylopectin. By physical, enzymatical or chemical treating native starch, a variety of modified starches can be prepared, including non-ionic, anionic and cationic starches.

Preferably, the starch contained in the cellulosic material has an amylose content within the range of from 0.1 wt.-% to 95 wt.-%.

In a preferred embodiment of the invention, the starch contained in the cellulosic material is substantially pure amylose, i.e. has an amylose content of about 100 wt.-%. In another preferred embodiment of the invention, the starch contained in the cellulosic material is substantially pure amylopectin, i.e. has an amylopectin content of about 100 wt.-%. In still another preferred embodiment, the amylose content is within the range of 22.5±20 wt.-%, whereas the amylopectin content is preferably within the range of 77.5±20 wt.-%.

In a preferred embodiment, the starch is non-ionic, preferably native starch. In another preferred embodiment, the starch is anionic. In still another preferred embodiment, the starch is cationic. In yet another preferred embodiment, the starch contains both charges, anionic as well as cationic, whereas the relative content may be balanced, dominated by anionic charges or dominated by cationic charges.

In a preferred embodiment, the starch that is contained in the cellulosic material, preferably before pulping, has a weight average molecular weight of at least 25,000 g/mol.

In a preferred embodiment, the relative weight ratio of the starch and the cellulosic material (solid contents) is within the range of 1:(20±17.5) or 1:(50±40) or 1:(100±90) or 1:(200±90) or 1:(400±200) or 1:(600±200) or 1:(800±200).

A person skilled in the art knows that the cellulosic material may contain further components besides cellulose, such as chemicals used for the chemical and semi-chemical pulping step, dyes, bleaching agents, fillers, etc.

If not expressly stated otherwise, percentages based on the cellulosic material are to be regarded as being based on the overall composition containing the cellulosic material and the starch (solids content).

If not explicitly stated otherwise, for the purpose of the specification, the term "paper-making process" or "method for the manufacture of paper" refers to the manufacturing of paper as well as to the manufacturing of paperboard and cardboard.

For the purpose of the specification, the cellulosic starting material for the manufacturing of paper, paperboard and/or cardboard, which originates from recovered (waste) paper, is referred to as "recycle material", whereas fresh starting material is referred to as "virgin material". It is also possible that a blend of virgin material and recycle material is used as the starting material for the paper making process, which is herein referred to as "blend material". Furthermore, it is also possible that the cellulosic starting material is "broke" or "coated broke" (recess material) which, for the purpose of the specification, shall be encompassed by the term "recycle material".

For the purpose of the specification, the pulp which originates from virgin material, recycle material or blend material is referred to as "virgin pulp", "recycle pulp" and "blend pulp", respectively.

Typically, water is added during the mechanical pulping step to the cellulosic material, i.e. to the virgin, recycle or blend material, to produce the respective cellulosic pulp, i.e. virgin, recycle or blend pulp. The respective pulp is usually a fibrous aqueous dispersion or fibrous aqueous suspension of the cellulosic material.

The mechanical pulping process is typically performed by exposing the cellulosic material to mechanical force, more specifically shearing force.

According to the invention, biocide is present during the pulping step and/or is added thereafter, preferably shortly thereafter. Microorganisms coming from waste paper also play a role in the degradation of starch contained in the waste paper, particularly when the waste paper is stored for days or months and subjected to microorganism activity during this storage time. Treating waste paper with biocide during pulping cannot reverse the effects caused by microorganism activity upon the starch during waste paper storage. However, growth conditions of microorganism improve significantly during pulping—when the paper gets in contact with process water—and the inventors have found that it is advantageous to add the biocide at this stage of the process. Since the degradation caused by the microorganisms usually takes more time than a few minutes, the inventors have found that it may also be sufficient to add the biocide shortly after pulping.

For that purpose, the cellulosic material that contains the starch, i.e. the virgin, recycle or blend material, is brought into contact with biocide. If the biocide is added shortly after the pulping step, it is preferably added to the cellulosic material 1 to 60 minutes after the pulping step has been finished.

In order to treat the cellulosic material containing the starch with biocide according to the invention, it is apparent to a person skilled in the art that at least a part of the total amount (total inflow) of biocide is added to the cellulosic material containing the starch at any time during the pulping step (a), i.e. after the pulping has been commenced, or shortly after the pulping has been completed. The biocide can be added continuously or discontinuously.

For the purpose of the specification, the term "continuously" means that the amount (inflow) of the biocide for the specific dose is added to the cellulosic material containing the starch without interruption.

For the purpose of the specification, the term "discontinuously" means herein that the addition of the biocide to the cellulosic material containing the starch is performed by means of pulses of a predetermined length which are interrupted by periods during which no biocide is added at this feeding point.

A skilled person is aware that papermaking processes as such are typically continuous processes. Thus, any "amount" or "dosage" of biocide, ionic polymer and further additive, respectively, that is to be added to the cellulosic material refers to a respective "inflow" of said biocide, ionic polymer and further additive, respectively, in order to achieve a desired predetermined local concentration thereof in the stream of the cellulosic material. Said inflow may be continuous or discontinuous. Accordingly, when the "amount" or "dosage" of biocide, ionic polymer and further additive, respectively, is divided into portions that are added to the cellulosic material at different locations and/or during different process steps, each portion refers to a partial inflow of said biocide, ionic polymer and further additive, respectively, in order to achieve a desired predetermined local concentration thereof, i.e. downstream with respect to its feeding point.

Typically, water is added to the cellulosic material, i.e. to the virgin, recycle or blend material, prior to and/or during the pulping step. At least a part of the total amount (total inflow) of the biocide may be dissolved, dispersed or suspended in said water used to repulp the cellulosic material containing the starch, i.e. to the virgin, recycle or blend material.

In this embodiment, the biocide and the water used for the pulping may already be brought into contact with one another before pulping is initiated.

In a preferred embodiment according to the invention, the biocide is in contact with the water used for the pulping at least 10 min before pulping commences, or at least 30 min, or at least 60 min, or at least 120 min, or at least 150 min, or at least 180 min, or at least 210 min, or at least 240 min, or at least 300 min, or at least 360 min, or at least 420 min, or at least 480 min.

Typically, the pulping step (a) may take several minutes to several hours. In another preferred embodiment, at least one part of the total amount (total inflow) of the biocide is added to the cellulosic material during the pulping period.

For the purpose of the specification, the term "pulping period" is defined as the total time the pulping step is performed.

For example, in case that the pulping step takes a total time of 1 hour (pulping period), the biocide may be added discontinuously or continuously to the pulper at any point of time or during any time interval, e.g., up to 120 minutes after the pulping step has been commenced.

In step (b) of the method according to the invention the cellulosic material containing the starch is treated with one or more biocides, preferably thereby preventing microbial degradation of at least a portion of the starch. In a preferred embodiment, step (b) is at least partially simultaneously performed with step (a) of the method according to the invention, i.e. the biocide treatment is performed during pulping. In another preferred embodiment, step (b) is performed after step (a) has been completed. A skilled person recognizes that any full or partial time overlap of steps (a) and (b) is possible and in accordance with the invention.

According to the method of the invention, step (b) preferably serves the purpose of avoiding degradation of the starch, which is contained in the cellulosic material, by eradicating the microorganisms that are otherwise capable of degrading the starch (amylase control).

A great variety of microorganisms can be found in the pulping process. Each type of pulp has its own microbial characteristics. In general, the microorganisms observed in paper manufacture are species of bacteria, yeast and fungi; algae and protozoa exist but rarely cause problems. Problems caused by microorganisms can be very different. Very well known problems are slime formation and corrosion.

Species of the following bacteria genera belong to the usual contaminates of pulp: *Achromobacter, Actinomycetes, Aerobacter, Alcaligenes, Bacillus, Beggiatoa, Crenothrix, Desulphovibrio, Flavobacterium, Gallionella, Leptothrix, Pseudomonas, Sphearotilus*, and *Thiobacillus*. Species of *Alcaligenes, Bacillus* and *Flavobacterium* as well as species of the yeast, *Manilla*, cause pink slime. Red or brown slime is caused by the bacteria that form ferric hydroxide, namely species of *Crenothrix, Gallionella* and *Leptothrix*. Species of *Thiobacillus* and *Beggiatoa* are corrosion bacteria in that they oxidize sulphides to sulphuric acid. Species of *Desulphovibrio* are also corrosion bacteria for the opposite reason. Species of the latter genus reduce sulphate to hydrogen sulphide which interacts with metal to cause corrosion. Metallic sulphides are also black, which is another unwanted effect of sulphate-reducing bacteria.

Among the fungi, species of the following genera are found most frequently in pulp systems: *Aspergillus, Basidiomyces, Cephalosporium, Cladosporium, Endomyces, Endomyopsis, Mucor, Penicillium*, and *Trichoderma*. Blue stain on wood is caused by *Cephalosporium* and *Cladosporium*.

Finally, species of the following genera of yeast may be isolated from pulp: *Monilia, Pullularia, Rhodotorula* and *Saccharomyces*. For further details it is referred to H. W. Rossmoore, Handbook of Biocide and Preservative Use, Chapter Paper and Pulp, Chapman & Hall, 1995.

Most predominant species expriming amylase and thus causing starch degradation include *Actinomycetes, Aerobacter, Bacillus, Beggiatoa, Desulphovibrio, Flavobacterium, Gallionella, Leptothrix, Pseudomonas, Thiobacillus; Aspergillus, Basidiomycetes, Cephalosporium, Endomyces, Endomycopsis, Mucor, Penicillium; Pullularia*, and *Saccharomyces*.

Thus, the purpose of adding biocide according to the invention essentially serves the purpose of eradication one or more of the aforementioned microorganisms and the dosages of biocide are preferably adapted accordingly.

In a preferred embodiment, the total amount (total inflow) of biocide is added to the cellulosic material during the pulping step (a) discontinuously or continuously; i.e. 100 wt.-% of the total amount (total inflow) of the biocide is added to the cellulosic material, i.e. to the virgin, recycle or blend material, during the pulping step (a).

In another preferred method, further parts of biocide may be added at any time preferably up to 480 min after the pulping step (a) has been commenced at any suitable place in order to avoid degradation of the starch. This embodiment includes the addition of further parts of the biocide either during the pulping step (a) or preferably up to 60 minutes after pulping has been completed. In a preferred embodiment, at least a part of the total amount (total inflow) of the biocide is added to the cellulosic material containing the starch at any preferably time up to 60 minutes after the pulping step (a) has been completed.

In a preferred embodiment, one or more biocides are added to the cellulosic material at at least 2 different feeding points, more preferably at least 3 different feeding points, and still more preferably at least 4 different feeding points on the papermaking plant, where identical or different biocides or biocide combinations can be added at the various feeding points.

The biocide may be gaseous, solid or liquid; organic or inorganic; oxidizing or non-oxidizing.

The biocide may be employed in substance or in dilution with a suitable solvent, preferably water, in solution or dispersion, suspension or emulsion.

The biocide may be a one-component biocide, a two-component biocide or a multi-component biocide.

The biocide preferably has a comparatively short half-life, i.e. is decomposed comparatively quickly thereby losing its biocidial action. When a combination of two or more biocides is employed, the half-life of at least one biocide within said combination is preferably comparatively short. Preferably, under the conditions of the method according to the invention (temperature, pH and the like), the half-life of the biocide is not more than 24 h, or not more than 18 h, or not more than 12 h, more preferably not more than 10 h, still more preferably not more than 8 h, yet more preferably not more than 6 h, most preferably not more than 4 h and in particular not more than 2 h. The half-life of a given biocide can be easily determined by routine experimentation, preferably under the general conditions of the method according to the invention.

It has been surprisingly found that biocides having a comparatively short half-life are effective in preventing starch degradation by eradicating the microorganisms, which would otherwise decompose the starch, but do not cause problems in the waste water system, which typically also relies on microorganisms that should not be eradicated by the biocide. Further, it has been surprisingly found that biocides having a comparatively short half-life can be employed at comparatively high concentrations without causing substantial problems regarding the waste water treatment.

In the U.S. biocides to be employed in the production of paper and paper board for use in contact with food must be on the approved list of the US Food and Drug Administration (FDA).

In a preferred embodiment, the biocide is selected from oxidizing and non-oxidizing biocides.

Examples of oxidizing biocides include one component systems such as $ClO_2$, $H_2O_2$ or NaOCl; and two component systems comprising e.g. a nitrogenous compound, preferably an inorganic ammonium salts in combination with an oxidant, preferably a halogen source, more preferably a chlorine source, most preferably hypochlorous acid or a salt thereof, such as $NH_4Br$/NaOCl or $(NH_4)_2SO_4$/NaOCl; and two component systems comprising e.g. organic biocides in combination with an oxidant, preferably a halogen source, more preferably a chlorine source, most preferably hypochlorous acid or a salt thereof, such as bromochloro-5,5-dimethylimidazolidine-2,4-dione (BCDMH)/NaOCl, or dimethylhydantoin (DMH)/NaOCl, In a particularly preferred embodiment, the biocide is an oxidizing two-component biocide where the first component is a nitrogenous compound, preferably selected from ammonia, amines, inorganic or organic salts of ammonia, and inorganic or organic salts of amines; and the second component is a halogen source, preferably a chlorine source.

Preferred nitrogenous compounds include ammonium salts, methylamine, dimethylamine, ethanolamine, ethylenediamine, diethanolamine, triethanolamine, dodecylethanolamine, hexdecylethanolamine, oleic acid ethanolamine, triethylenetetramine, dibutylamine, tributylamine, glutamine, dilaurylamine, distearylamine, tallow-methylamine, coco-methylamine, n-acetylglucosamine, diphenylamine, ethanol/methylamine, diisopropanolamine, n-methylaniline, n-hexyl-n-methylamine, n-heptyl-n-methylamine, n-octyl-n-methylamine, n-nonyl-n-methylamine, n-decyl-n-methylamine, n-dodecyl-n-methylamine, n-tridecyl-n-methylamine, n-tetra-decyl-n-methylamine, n-benzyl-n-methylamine, n-phenylethyl-n-methylamine, n-phenylpropyl-n-methylamine, n-alkyl-n-ethylamines, n-alkyl-n-hydroxyethylamines, n-alkyl-n-propylamines, n-propylheptyl-n-methylamine, n-ethylhexyl-n-methylamine, n-ethylhexyl-n-butylamine, n-phenylethyl-n-methylamine, n-alkyl-n-hydroxypropylamines, n-alkyl-n-isopropylamines, n-alkyl-n-butylamines and n-alkyl-n-isobutylamines, n-alkyl-n-hydroxyalkylamines, hydrazine, urea, guanidines, biguanidines, polyamines, primary amines, secondary amines, cyclic amines, bicyclic amines, oligocyclic amines, aliphatic amines, aromatic amines, primary and secondary nitrogen containing polymers. Examples of ammonium salts include ammonium bromide, ammonium carbonate, ammonium chloride, ammonium fluoride, ammonium hydroxide, ammonium iodide, ammonium nitrate, ammonium phosphate, and ammonium sulfamate. Preferred nitrogenous compounds are ammonium bromide and ammonium chloride.

Preferred oxidants include chlorine, alkali and alkaline earth hypochlorite salts, hypochlorous acid, chlorinated isocyanurates, bromine, alkali and alkaline earth hypobromite salts, hypobromous acid, bromine chloride, halogenated hydantoins, ozone and peroxy compounds such as alkali and alkaline earth perborate salts, alkali and alkaline earth percarbonate salts, alkali and alkaline earth persulfate salts, hydrogen peroxide, percarboxylic acid, and peracetic acid. Particularly preferred halogen sources include reaction products of a base and a halogen, such as hypochlorous acid and the salts thereof. Preferred salts of hypochlorous acid include LiOCl, NaOCl, KOCl, $Ca(OCl)_2$ and $Mg(OCl)_2$, which are preferably provided in aqueous solution. Preferred inorganic salts of ammonia include but are not limited to $NH_4F$, $NH_4Cl$, $NH_4Br$, $NH_{41}$, $NH_4HCO_3$, $(NH_4)_2CO_3$, $NH_4NO_3$, $NH_4H_2PO_2$, $NH_4H_2PO_4$, $(NH_4)_2HPO_4$, $NH_4SO_3NH_2$, $NH_4IO_3$, $NH_4SH$, $(NH_4)_2S$, $NH_4HSO_3$, $(NH_4)_2SO_3$, $NH_4HSO_4$, $(NH_4)_2SO_4$, and $(NH_4)_2S_2O_3$. Preferred organic salts of ammonia include but are not limited to $NH_4OCONH_2$, $CH_3CO_2NH_4$ and $HCO_2NH_4$. The amine can be a primary or secondary amine or the amine portion of an amide; for example urea, or alkyl derivatives thereof such as N—N'-dimethyl urea, or N'—N'-dimethylurea. The combination of $NH_4Br$ and NaOCl is particularly preferred and known e.g. from U.S. Pat. No. 7,008,545, EP-A 517 102, EP 785 908, EP 1 293 482 and EP 1 734 009. Preferably, the relative molar ratio of said first component and said second component is within the range of from 100:1 to 1:100, more preferably 50:1 to 1:50, still more preferably 1:20 to 20:1, yet more preferably 1:10 to 10:1, most preferably 1:5 to 5:1 and in particular 1:2 to 2:1.

Compared to strong oxidizers, biocides of this type, i.e. combinations of ammonium salts with hypochlorous acid or salts thereof, have particular advantages.

For a number of years, strong oxidizers have been used to control microbial populations in the papermaking industry. Maintaining an effective level of oxidizer is not always easy or economically viable because paper process streams exhibit a high and variable "demand" on the oxidizer. This demand is caused by the presence of organic materials such as fiber, starch, and other colloidal or particulate organic materials in the process. These organic materials react with and consume the oxidizer, making it much less effective at controlling microbial populations. In order to achieve an effective oxidizer residual in high-demand systems, such as papermaking machines, the oxidizer must be overfed to surpass the demand in the system. Overfeeding strong oxidizers not only leads to higher treatment costs but can also cause many adverse side effects in the papermaking system. These side effects include increased consumption of dyes and other costly wet end additives (for example, optical brighteners and sizing agents), increased corrosion rates, and reduced felt life. Some oxidizers also greatly contribute to the amount of halogenated organic compounds (AOX) produced in the papermaking process. Furthermore, excessive residuals of certain oxidizers may be adequate for controlling microbial populations in the bulk fluid but are ineffective at controlling biofilm due to limited penetration into the biofilm matrix.

In contrast to strong oxidizers, biocides produced by blending ammonium salts, such as an ammonium bromide solution, with e.g. sodium hypochlorite and mill freshwater under specific reaction conditions can be described as a weak oxidizer. The biocide is produced onsite and immediately dosed to the paper system. The dosage required depends on several factors, including freshwater usage, water recycle, and presence of reducing agents. Biocides of this type thus have a comparatively short half-life and therefore do not accumulate which could cause problems concerning the waste water treatment. Further, they are not too aggressive, i.e. do not oxidize the other constituents of the cellulosic material but are comparatively selective for microorganisms.

Oxidizing one or two component biocides of this type can be employed alone, or preferably, particularly when the starting material comprises recycle pulp, in combination with non-oxidizing biocides.

Examples of non-oxidizing biocides include but are not limited to quaternary ammonium compounds, benzyl-$C_{12-16}$-alkyldimethyl chlorides (ADBAC), polyhexamethylenebiguanide (biguanide), 1,2-benzisothiazol-3(2H)-one (BIT), bronopol (BNPD), bis(trichloromethyl)sulfone, diiodomethyl-p-tolylsulfone, sulfone, bronopol/quaternary ammonium compounds, benzyl-$C_{12-16}$-alkyldimethyl chlorides (BNPD/ADBAC), bronopol/didecyldimethylammonium chloride (BNPD/DDAC), bronopol/5-chloro-2-methyl-2H-isothiazol-3-one/2-methyl-2H-isothiazol-3-one (BNPD/Iso), NABAM/sodium dimethyldithiocarbamate, sodiumdimethyldithiocarbamate-N,N-dithiocarbamate (NABAM), sodiummethyldithiocarbamate, sodium dimethyldithiocarbamate, 5-chloro-2-methyl-4-isothiazolin-3-one (CMIT), 2,2-dibromo-2-cyanoacetamide (DBNPA), DBNPA/bronopol/iso (DBNPA/BNPD/Iso), 4,5-dichloro-2-n-octyl-3-isothiazolin-3-one (DCOIT), didecyldimethylammonium chloride (DDAC), didecyldimethylammoniumchloride, alkyldimethylbenzylammoniumchloride (DDAC/ADBAC), dodecylguanidine monohydrochloride/quaternary ammonium compounds, benzyl-$C_{12-16}$-alkyldimethyl chlorides (DGH/ADBAC), dodecylguanidine monohydrochloride/methylene dithiocyanate (DGH/MBT), glutaraldehyde (Glut), gluteraldehyde/quaternary ammonium compounds/benzyl-coco alkyldimethyl chlorides (Glut/coco), gluteraldehyde/didecyldimethylammonium chloride (Glut/DDAC), gluteraldehyde/5-chloro-2-methyl-2H-isothiazol-3-one/2-methyl-2H-isothiazol-3-one (Glut/Iso), gluteraldehyde/methylene dithiocyanate (Glut/MBT), 5-chloro-2-methyl-2H-isothiazol-3-one/2-methyl-2H-isothiazol-3-one (Iso), methylene dithiocyanate (MBT), 2-methyl-4-isothiazolin-3-one (MIT), methamine oxirane (methamine oxirane), sodium bromide (NaBr), nitromethylidynetrimethanol, 2-n-octyl-3-isothiazolin-3-one (OIT), bis(trichloromethyl) sulphone/quaternary ammonium compounds, benzyl-$C_{12-16}$-alkyldimethyl chlorides (sulphone/ADBAC), symclosene, terbuthylazine, dazomet (thione), tetrakis(hydroxymethyl)phosphonium sulphate(2:1) (THPS) and p-[(diiodomethyl)-sulphonyl]toluene (tolyl sulphone), and mixtures thereof.

A skilled person knows that a single biocide or a single multi-component biocide can be employed or a combination of different biocides.

In a particularly preferred embodiment of the invention, preferably when the starting material comprises recycle pulp, the biocide is a biocide system, preferably comprising a first biocide composed of an inorganic ammonium salt in combination with a halogen source, preferably a chlorine source, more preferably hypochlorous acid or a salt thereof, and a further biocide, preferably selected from the non-oxidizing and/or organic biocides, preferably non-oxidizing organic biocides. For the purpose of the specification, unless expressly stated otherwise, the one or more biocides referred to in step (b) may encompass said further biocide, if present.

In a preferred embodiment, the non-oxidizing biocide comprises bronopol (BNPD) and at least one isothiazolone compound selected from the group consisting of 1,2-benzisothiazol-3(2H)-one (BIT), 5-chloro-2-methyl-4-isothiazolin-3-one (CMIT), 4,5-dichloro-2-n-octyl-3-isothiazolin-3-one (DCOIT), methyl-4-isothiazolin-3-one (MIT), 2-n-octyl-3-isothiazolin-3-one (OIT); and/or a sulfone selected from bis(trichloromethyl)-sulfone and diiodomethyl-p-tolylsulfone. In another preferred embodiment, the non-oxidizing biocide comprises compounds bearing quaternary ammonium ions and bronopol (BNPD) or a sulfone selected from bis(trichloromethyl)sulfone and diiodomethyl-p-tolylsulfone. The biocide system, preferably comprising an oxidizing biocide and a non-oxidizing biocide, is particularly preferred when the residence time of the biocide in the thick stock is comparatively long, i.e. the time from the point in time when the biocide is added to the cellulosic material until the point in time when the cellulosic material enters the papermaking machine. In a preferred embodiment, the above biocide system comprising a first and a further biocide is employed when said residence time is at least 1 h, or at least 2 h, or at least 4 h, or at least 6 h, or at least 8 h, or at least 10 h.

Said biocide system is particularly preferred when the starting material comprises recycle pulp. When the starting material essentially consists of virgin pulp, however, the addition of a further biocide is preferably omitted.

When such combination of biocides is employed, at least a portion of the first biocide is preferably added to pulper dilution water, while the further biocide is preferably added to the outlet of the pulper and/or to the inlet of the fiber clarification.

The dosage of the one or more biocides depends upon their antimicrobial efficacy. Typically, biocide is dosed in an amount sufficient to prevent substantial degradation of the starch contained in the cellulosic material. Suitable dosages for a given biocide can be determined by routine experimentation or by comparing the number of microorganisms before and after addition of the biocide (taking into account that biocides typically need some time in order to eradicate microorganisms).

The addition of biocides during the papermaking process has been known for many years. The presence of microorganisms in the pulp and papermaking process is unavoidable and thus, steps are taken to control their growth and numbers. It would be unrealistic to attempt to kill all the microorganisms. Instead the objective is typically to control, or suppress, the multiplication of microorganisms and thus to curtail their metabolic activities.

In conventional methods for manufacturing paper, paperboard or cardboard the build up of slime is one of the most important indicators that microbial growth and microbial activities must be curtailed. In conventional methods for manufacturing paper, paperboard or cardboard, the biocide is typically added for the conventional purpose of avoiding slime formation, corrosion and/or wet end breaks, controlling wet end deposition or for odor control, but not for the purpose of avoiding microbial degradation of the starch, which is contained in the cellulosic material, by eradicating the microorganisms that are otherwise capable of degrading the starch with the intention to (re-)fixate this starch later on with polymers as described hereinafter.

The above conventional purposes require comparatively low amounts of biocides keeping only relatively small sections of the overall papermaking plant antimicrobially controlled. In contrast, the avoidance of starch degradation according to the invention, i.e. the partial or full eradication of the microorganisms that are capable of degrading the starch (amylase control), typically requires substantially higher amounts/concentrations of biocide. As further shown in the experimental section, the amount of biocide that is preferably employed in accordance with the invention in order to avoid starch degradation is at least 2 times, preferably at least 3 times higher than the amount of biocide conventionally employed in papermaking processes for conventional purposes. Furthermore, the distribution of the biocide that is preferably achieved by dosing the biocide at various feeding points located in various sections of the papermaking plant in the method according to the invention in order to avoid starch degradation at any places is not conventional. For example, according to the product specification of aqueous ammonium bromide compositions currently marketed as microbiological control agent precursor for paper manufacture, the recommended dosage varies merely from 150-600 g/t of dry fiber at an active content of 35%, which corresponds to a maximum dosage of only 210 g ammonium bromide per ton of dry fiber. However, by such a conventional biocide treatment, i.e. by 210 g/t of dry fiber and without addition of further biocide at further locations, the starch that is contained in the remainder of the papermaking plant is still substantially degraded.

In a preferred embodiment of the method according to the invention, step (b) involves the reduction of the content of microorganisms that are contained in the cellulosic material and that a capable of degrading starch by treating the cellulosic material containing the starch with a sufficient amount of a suitable biocide.

In another preferred embodiment of the method according to the invention, step (b) involves the partial or full avoidance, prevention, suppression or reduction of starch degradation by microorganisms that are contained in the cellulosic material and that a capable of degrading starch by treating the cellulosic material containing the starch with a sufficient amount of a suitable biocide.

In another preferred embodiment of the method according to the invention, step (b) involves the partial or full preservation of starch against degradation by microorganisms that are contained in the cellulosic material and that a capable of degrading starch by treating the cellulosic material containing the starch with a sufficient amount of a suitable biocide.

Degradation of the starch contained in the cellulosic material can be monitored by measuring various parameters, e.g. pH value, electrical conductivity, ATP (adenosine triphosphate) content, redox potential, and extinction. Microbiological activity need to be reduced significantly in the entire system, compared to conventional biocide treatments. Thus, the efficacy of a given biocide in a given amount with respect to its effect on the prevention of starch degradation can be investigated by routine experimentation, i.e. by monitoring pH value, electrical conductivity, ATP content, redox-potential, and/or extinction (iodine test) and comparing the situation without biocide treatment to the situation with biocide treatment after a sufficient equilibration period (typically at least 3 days, preferably 1 week or 1 month).

A skilled person is fully aware that papermaking plants comprise a water circuit to which more or less fresh water is added (open system and closed system, respectively). The cellulosic material is brought into contact with the process water at or before pulping step (a), is further diluted by addition of process water when the thick stock is converted into thin stock, and is separated from the process water on the papermaking machine where sheet formation takes place. The process water is returned (recycled) through the water circuit in order to reduce the consumption of fresh water. The parameters of the process water in the water circuit are typically equilibrated, the equilibrium being influenced by system size, added quantity of fresh water, properties of the starting material, nature and amount of additives, and the like.

When changing the process conditions in accordance with the invention, e.g. by addition of higher quantities of biocide at various locations, some parameters spontaneously change locally and reach an equilibrium in the entire system within hours or days, e.g. redox potential, ATP level and oxygen reduction potential (ORP), whereas other parameters typically need more time to equilibrate, e.g. pH value and electrical conductivity.

Typically, the undesired starch degradation leads to a decrease of the pH value of the aqueous cellulosic material. Thus, efficient prevention of starch degradation by eradication of microorganisms due to biocide treatment can be monitored by measuring the pH value of the aqueous phase of the cellulosic material. Preferably, in step (b) of the method according to the invention the one or more biocides are continuously or discontinuously added to the cellulosic material in quantities so that after 1 month of treatment, preferably after two months of treatment on a continuously operating papermaking plant, the pH value of the aqueous phase of the cellulosic material has been increased by at least 0.2 pH units, or by at least 0.4 pH units, or by at least 0.6 pH units, or by at least 0.8 pH units, or by at least 1.0 pH units, or by at least 1.2 pH units, or by at least 1.4 pH units, or by at least 1.6 pH units, or by at least 1.8 pH units, or by at least 2.0 pH units, or by at least 2.2 pH units, or by at least 2.4 pH units, compared to the pH value that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch thereby causing a decrease of the pH value. Preferably, in step (b) of the method according to the invention the one or more biocides are continuously or discontinuously added to the cellulosic material in quantities so that after 1 month of treatment, preferably after two months of treatment on a continuously operating papermaking plant, the pH value of the aqueous phase of the cellulosic material measured at the wet end entry of the papermaking machine has been decreased by not more than 2.4 pH units, or by not more than 2.2 pH units, or by not more than 2.0 pH units, or by not more than 1.8 pH units, or by not more than 1.6 pH units, or by not more than 1.4 pH units, or by not more than 1.2 pH units, or by not more than 1.0 pH units, or by not more than 0.8 pH units, or by not more than 0.6 pH units, or by not more than 0.4 pH units, or by not more than 0.2 pH units, compared to the pH value of a composition containing the starting material (virgin pulp and recycle pulp, respectively) as well as all additives that have been added to the cellulosic material in the corresponding concentrations until it reaches the wet end entry of the papermaking machine.

Typically, the undesired starch degradation also leads to an increase of electrical conductivity of the aqueous cellulosic material. Thus, efficient prevention of starch degradation by eradication of microorganisms due to biocide treatment can be monitored by measuring the electrical conductivity of the aqueous phase of the cellulosic material. Preferably, in step (b) of the method according to the invention the one or more biocides are continuously or discontinuously added to the cellulosic material in quantities so that after 1 month of treatment, preferably after two months of treatment on a continuously operating papermaking plant, the electrical conductivity of the aqueous phase of the cellulosic material has been decreased by at least 5%, or by at least 10%, or by at least 15%, or by at least 20%, or by at least 25%, or by at least 30%, or by at least 35%, or by at least 40%, or by at least 45%, or by at least 50%, or by at least 55%, or by at least 60%, or by at least 65%, or by at least 70%, or by at least 75%, or by at least 80%, compared to the electrical conductivity that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch thereby causing an increase of electrical conductivity. Preferably, in step (b) of the method according to the invention the one or more biocides are continuously or discontinuously added to the cellulosic material in quantities so that after 1 month of treatment, preferably after two months of treatment on a continuously operating papermaking plant, the electrical conductivity of the aqueous phase of the cellulosic material measured at the wet end entry of the papermaking machine has been increased by at most 80%, or by at most 75%, or by at most 70%, or by at most 65%, or by at most 60%, or by at most 55%, or by at most 50%, or by at most 45%, or by at most 40%, or by at most 35%, or by at most 30%, or by at most 25%, or by at most 20%, or by at most 15%, or by at most 10%, or by at most 5%, compared to the electrical conductivity of a composition containing the starting material (virgin pulp and recycle pulp, respectively) as well as all additives that have been added to the cellulosic material in the corresponding concentrations until it reaches the wet end entry of the papermaking machine.

Preferably, in step (b) of the method according to the invention the one or more biocides are continuously or discontinuously added to the cellulosic material in quantities so that, preferably after 1 month of treatment, more preferably after two months of treatment on a continuously operating papermaking plant, the electrical conductivity of the aqueous phase of the cellulosic material is at most 7000 μS/cm, or at most 6500 μS/cm, or at most 6000 μS/cm, or at most 5500 μS/cm, or at most 5000 μS/cm, or at most 4500 μS/cm, or at most 4000 μS/cm, or at most 3500 μS/cm, or at most 3000 μS/cm, or at most 2500 μS/cm, or at most 2000 μS/cm, or at most 1500 μS/cm, or at most 1000 μS/cm.

Typically, the undesired starch degradation also leads to a decrease of extinction when subjecting the aqueous cellulosic material to an iodine test. Thus, efficient prevention of starch degradation by eradication of microorganisms due to biocide treatment can be monitored by measuring the extinction of the starch that is contained in the aqueous phase of the cellulosic material by means of the iodine test. Preferably, in step (b) of the method according to the invention the one or more biocides are continuously or discontinuously added to the cellulosic material in quantities so that after 8 hours, preferably after 2 days, more preferably after 3 days of treatment, more preferably after 1 week of treatment on a continuously operating papermaking plant, the extinction of the starch contained in the aqueous phase of the cellulosic material has been increased by at least 5%, or by at least 10%, or by at least 15%, or by at least 20%, or by at least 25%, or by at least 30%, or by at least 35%, or by at least 40%, or by at least 45%, or by at least 50%, or by at least 55%, or by at least 60%, or by at least 65%, or by at least 70%, or by at least 75%, or by at least 80%, compared to the extinction that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch thereby causing a decrease of extinction. In a preferred embodiment, the extinction of native starch is monitored. This can be done at a particular wave length (for details it is referred to the experimental section). According to the invention, the increase of starch content can be higher. For example, depending on the composition of the starting material, the starch content in the very beginning, i.e. when biocide treatment commences, can be about zero.

In a preferred embodiment, the starch that is contained in the cellulosic material, preferably after the pulping step has been completed, has a weight average molecular weight of at least 25,000 g/mol.

In a preferred embodiment, the one or more biocides are dosed in an amount so that after 60 minutes the content of microorganisms (MO) in [cfu/ml] in the cellulosic material containing the starch is at most $1.0\times10^7$, or at most $5.0\times10^6$, or at most $1.0\times10^6$; or at most $7.5\times10^5$, or at most $5.0\times10^5$; or at most $2.5\times10^5$, or at most $1.0\times10^5$, or at most $7.5\times10^4$; or at most $5.0\times10^4$, or at most $2.5\times10^4$, or at most $1.0\times10^4$; or at most $7.5\times10^3$, or at most $5.0\times10^3$, or at most $4.0\times10^3$; or at most $3.0\times10^3$, or at most $2.0\times10^3$, or at most $1.0\times10^3$. In another preferred embodiment, the biocide is dosed in an amount so that after 60 minutes the content of microorganisms (MO) in [cfu/ml] in the cellulosic material containing the starch is at most $9.0\times10^2$, or at most $8.0\times10^2$, or at most $7.0\times10^2$; or at most $6.0\times10^2$, or at most $5.0\times10^2$, or at most $4.0\times10^2$; or at most $3.0\times10^2$, or at most $2.0\times10^2$, or at most $1.0\times10^2$; or at most $9.0\times10^1$, or at most $8.0\times10^1$, or at most $7.0\times10^1$; or at most $6.0\times10^1$, or at most $5.0\times10^1$, or at most $4.0\times10^1$; or at most $3.0\times10^1$, or at most $2.0\times10^1$, or at most $1.0\times10^1$.

In a preferred embodiment, the one or more biocides are dosed to the cellulosic material at a feed rate related to the finally produced paper of at least 5 g/metric ton (=5 ppm), preferably within the range of from 10 g/metric ton to 5000 g/metric ton, more preferably from 20 g/metric ton to 4000 g/metric ton, still more preferably from 50 g/metric ton to 3000 g/metric ton, yet more preferably from 100 g/metric ton to 2500 g/metric ton, most preferably from 200 g/metric ton to 2250 g/metric ton, and in particular from 250 g/metric ton to 2000 g/metric ton, based on the finally produced paper.

In a preferred embodiment, the one or more biocides comprise a two component system comprising an inorganic ammonium salt and a halogen source, preferably a chlorine source, more preferably hypochlorous acid or a salt thereof, wherein the molar ratio of the inorganic ammonium salt to the hypochlorous acid or salt thereof is within the range of from 2:1 to 1:2. Under these circumstances, preferably when the starting material of the process according to the invention comprises recycle pulp, said two component system is preferably dosed to the cellulosic material at a feed rate related to the finally produced paper of at least 175 g/metric ton, or at least 200 g/metric ton, or at least 250 g/metric ton, or at least 300 g/metric ton; or at least 350 g/metric ton, or at least 400 g/metric ton, or at least 450 g/metric ton, at least 500 g/metric ton, or at least 550 g/metric ton; more preferably at least 600 g/metric ton, or at least 650 g/metric ton, or at least 700 g/metric ton, or at least 750 g/metric ton, or at least 800 g/metric ton, or at least 850 g/metric ton, or at least 900 g/metric ton, or at least 950 g/metric ton, or at least 1000 g/metric ton; or at least 1100 g/metric ton, or at least 1200 g/metric ton, or at least 1300 g/metric ton, or at least 1400 g/metric ton, or at least 1500 g/metric ton; or at least 1750 g/metric ton, or at least 2000 g/metric ton; in each case based on the weight of the inorganic ammonium salt and relative to the finally produced paper. Under these circumstances, preferably when the starting material of the process according to the invention does not comprise recycle pulp, i.e. essentially consists of virgin pulp, said two component system is preferably dosed to the cellulosic material at a feed rate related to the finally produced paper of or at least 50 g/metric ton, or at least 100 g/metric ton, or at least 150 g/metric ton, or at least 200 g/metric ton, or at least 250 g/metric ton, or at least 300 g/metric ton, or at least 350 g/metric ton, or at least 400 g/metric ton, or at least 450 g/metric ton, or at least 500 g/metric ton, or at least 550 g/metric ton, or at least 600 g/metric ton, or at least 650 g/metric ton; or at least 700 g/metric ton, or at least 750 g/metric ton, or at least 800 g/metric ton, or at least 850 g/metric ton, or at least 900 g/metric ton; or at least 950 g/metric ton, or at least 1000 g/metric ton; in each case based on the weight of the inorganic ammonium salt and relative to the finally produced paper.

In a preferred embodiment, the one or more biocides are discontinuously added to the cellulosic material on a continuously operating papermaking plant. The one or more biocides are preferably added by means of pulsed feed rates, i.e. peaks in the local concentration of the biocide in the cellulosic material reaching the critical local concentration that is necessary in order to eradicate the microorganisms thereby effectively preventing starch from being degraded. In other words, the cellulosic material passing the feeding point(s) of biocide is transiently locally enriched by biocide in predetermined intervals (biocide intervals) that are interrupted by intervals during which no biocide is locally added (passive intervals).

Preferably, a biocide interval lasts typically at least about 2 minutes, but may also last e.g. up to about 120 minutes. Preferably, the biocide is added to the cellulosic material on a continuously operating papermaking plant during 24 h by means of at least 4, 8, 12, 16, 20, 30, 40, 50, 60, 70 or more biocide intervals that are separated from one another by a respective number of passive intervals, wherein during each biocide interval the desired and predetermined local concentration of the biocide in the cellulosic material is reached.

In another preferred embodiment, the one or more biocides are continuously added to the cellulosic material on a continuously operating papermaking plant.

Preferably, biocide is added to the cellulosic material at at least two feeding points, which are located downstream of one another. For example, biocide is added at a first feeding point and at a second feeding point being located downstream with respect to the first feeding point. Depending upon the half-life and distribution of the biocide in the cellulosic material, the cellulosic material passing the second feeding point may already locally contain biocide that has been added thereto upstream at the first feeding point. Thus, the amount of biocide locally added at the second feeding point can be lower than the amount locally added at the first feeding point in order to reach the same desired and predetermined local concentration of the biocide in the cellulosic material that is necessary in order to eradicate the microorganisms thereby effectively preventing starch from being degraded.

Preferably, biocide, more preferably an oxidizing two-component biocide, is added in section (I) and/or (II); and optionally also in section (III) and/or (IV) of the papermaking plant; more preferably in section (I) and/or (II); as well as in section (IV) of a papermaking plant comprising a papermaking machine, wherein section (I) includes measures taking place before pulping; section (II) includes measures associated with pulping; section (III) includes measures taking place after pulping but still outside the papermaking machine; and section (IV) includes measures taking place inside the papermaking machine.

In a preferred embodiment, particularly when the biocide is oxidizing, e.g. a two component system comprising an ammonium salt and a halogen source, preferably a chlorine source, more preferably hypochlorous acid or a salt thereof, biocide is dosed to the cellulosic material to a concentration of active substance that is equivalent to elemental chlorine at a concentration within the range of from 0.005 to 0.500% active substance as $Cl_2$ per ton produced paper, more preferably from 0.010 to 0.500% active substance as $Cl_2$ per ton produced paper, still more preferably from 0.020 to 0.500% active substance as $Cl_2$ per ton produced paper, yet more preferably from 0.030 to 0.500% active substance as $Cl_2$ per ton produced paper, most preferably from 0.040 to 0.500%, and in particular from 0.050 to 0.500% active substance as $Cl_2$ per ton produced paper.

In another preferred embodiment, particularly when the biocide is oxidizing, e.g. a two component system comprising an ammonium salt and a halogen source, preferably a chlorine source, more preferably hypochlorous acid or a salt thereof, biocide is dosed to the cellulosic material to a concentration of active substance that is equivalent to elemental chlorine at a concentration within the range of from 0.005 to 0.100% active substance as $Cl_2$ per ton produced paper, more preferably from 0.010 to 0.100% active substance as $Cl_2$ per ton produced paper, still more preferably from 0.020 to 0.100% active substance as $Cl_2$ per ton produced paper, yet more preferably from 0.030 to 0.100% active substance as $Cl_2$ per ton produced paper, most preferably from 0.040 to 0.100% active substance as $Cl_2$ per ton produced paper, and in particular from 0.050 to 0.100% active substance as $Cl_2$ per ton produced paper.

In still another preferred embodiment, particularly when the biocide is oxidizing, e.g. a two component system comprising an ammonium salt and a halogen source, preferably a chlorine source, more preferably hypochlorous acid or a salt thereof, biocide is dosed to the cellulosic material to a concentration of active substance that is equivalent to elemental chlorine at a concentration within the range of from 0.010 to 0.080% active substance as $Cl_2$ per ton produced paper, more preferably from 0.015 to 0.080% active substance as $Cl_2$ per ton produced paper, still more preferably from 0.020 to 0.080% active substance as $Cl_2$ per ton produced paper, yet more preferably from 0.030 to 0.080%, most preferably from 0.040 to 0.080% active substance as $Cl_2$ per ton produced paper, and in particular from 0.050 to 0.080% active substance as $Cl_2$ per ton produced paper.

The above concentrations of the biocide are expressed as equivalent concentrations of elemental chlorine. The determination of the concentration of a biocide (based on active substance) that is equivalent to a particular concentration of elemental chlorine is known to the person of ordinary skill.

Particularly preferred embodiments $A^1$ to $A^6$ concerning the biocide added in step (b) of the method according to the invention (first biocide) and the additional organic biocide (further biocide) are summarized in Table 1 here below:

TABLE 1

| | $A^1$ | $A^2$ | $A^3$ | $A^4$ | $A^5$ | $A^6$ |
|---|---|---|---|---|---|---|
| | | | First biocide | | | |
| nature | oxidizing, two component | oxidizing, two component | oxidizing, two component | oxidizing, two component | oxidizing, two component | oxidizing, two component |
| feeding point | in section (I) and/or (II); and optionally also in section (III) and/or (IV) | in section (I) and/or (II); and optionally also in section (III) and/or (IV) | in section (I) and/or (II); as well as in section (III) and/or (IV) | in section (I) and/or (II); as well as in section (III) and/or (IV) | in section (I) and/or (II); as well as in section (III) and/or (IV) | in section (I) and/or (II); as well as in section (IV); but preferably not in section (III) |
| | | | Further biocide | | | |
| nature | organic, non-oxidizing | organic, non-oxidizing | organic, non-oxidizing | organic, non-oxidizing | organic, non-oxidizing | organic, non-oxidizing |

TABLE 1-continued

| | $A^1$ | $A^2$ | $A^3$ | $A^4$ | $A^5$ | $A^6$ |
|---|---|---|---|---|---|---|
| feeding point | in section (I) and/or (II); and optionally also in section (III) and/or (IV) | in section (I) and/or (II); as well as in section (III); but preferably not in section (IV) | in section (I) and/or (II); as well as in section (IV); but preferably not in section (III) | in section (I) and/or (II); but preferably neither in section (III) nor (IV) | in section (II); but preferably neither in section (I) nor (III) nor (IV) | in section (II); but preferably neither in section (I) nor (III) nor (IV) |

wherein sections (I) to (IV) refer to the sections of a papermaking plant comprising a papermaking machine,
wherein section (I) includes measures taking place before pulping;
section (II) includes measures associated with pulping;
section (III) includes measures taking place after pulping but still outside the papermaking machine; and
section (IV) includes measures taking place inside the papermaking machine.

In a preferred embodiment, the stock consistency of the cellulosic material in pulping step (a) is within the range of from 3.0 to 6.0%, or from 3.3 to 5.5%, or of from 3.6 to 5.1%, or from 3.9 to 4.8%, or from 4.2 to 4.6%. In another preferred embodiment, the stock consistency of the cellulosic material in pulping step (a) is within the range of from 10 to 25%, or from 12 to 23%, or from 13 to 22%, or from 14 to 21%, or from 15 to 20%. Suitable methods for measuring the stock consistency of cellulosic materials are known to the skilled person. In this regard it can be referred to e.g. M. H. Waller, Measurement and Control of Paper Stock Consistency, Instrumentation Systems &, 1983; H. Holik, Handbook of Paper and Board, Wiley-VCH, 2006.

Preferably, the redox potential of the cellulosic material increases by addition of the biocide to a value within the range of from −500 mV to +500 mV, or from −150 mV to +500 mV, or from −450 mV to +450 mV, or from −100 mV to +450 mV, or from −50 mV to +400 mV, or from −25 mV to +350 mV, or from 0 mV to +300 mV. For example, before the biocide is added, the redox potential of the cellulosic material may be −400 mV and after the addition of the biocide it is increased to a value of, e.g., −100 mV to +200 mV.

A positive value of the redox potential indicates an oxidative system, whereas a negative redox potential indicates a reductive system. Suitable methods for measuring the redox potential are known to the skilled person. In this regard it can be referred to e.g. H. Holik, Handbook of Paper and Board, Wiley-VCH, 2006.

Preferably, the ATP (adenosine triphosphate) level of the cellulosic material, expressed in RLU (relative light units), decreases by addition of biocide to a value within the range of from 500 to 400,000 RLU, or from 600 to 350,000 RLU, or from 750 to 300,000 RLU, or from 1,000 to 200,000 RLU, or from 5,000 to 100,000 RLU. For example, before biocide is added, the ATP level may exceed 400.000 RLU and after the addition of biocide it is decreased to a value of, e.g., 5,000 to 100,000 RLU. In a preferred embodiment, the ATP (adenosine triphosphate) level of the cellulosic material, expressed in RLU (relative light units), decreases by addition of biocide to a value within the range of from 5000 to 500,000 RLU, more preferably 5000 to 25,000 RLU.

ATP detection using bioluminescence provides another method to determine the level of microbial contamination. Suitable methods for ATP detection using bioluminescence are known to the skilled person.

Pulping step (a) may be performed at ambient conditions.

In a preferred embodiment, pulping step (a) is performed at elevated temperature. Preferably, pulping step (a) is performed at a temperature within the range of from 20° C. to 90° C., more preferably of from 20° C. to 50° C.

In a preferred embodiment, pulping step (a) is performed at a pH value of from 5 to 13, or from 5 to 12, or from 6 to 11, or from 6 to 10, or from 7 to 9. The desired pH value may be adjusted by the addition of acids and bases, respectively.

In a preferred embodiment according to the invention, pulping step (a) is performed in the presence of one or more biocides and further auxiliaries. Said further auxiliaries may comprise, but are not limited to inorganic materials, such as talcum, or other additives.

Typically, the pulped cellulosic material containing the (non-degraded) starch, i.e. virgin, recycle or blend pulp, may be subjected to further process steps all being encompassed by section (III) of the method for the manufacture of paper, paperboard or cardboard, which follow the pulping step (a) of section (II). These steps may comprise, but are not limited to (c) de-inking the cellulosic material; and/or
(d) blending the cellulosic material; and/or
(e) bleaching the cellulosic material; and/or
(f) refining the cellulosic material; and/or
(g) screening and/or cleaning the cellulosic material in the thick stock area; and/or
(h) adding ($h_1$) an ionic, preferably a cationic or anionic polymer and preferably, ($h_2$) an auxiliary ionic, preferably cationic polymer to the cellulosic material, preferably in the thick stock area, i.e. to the thick stock, where the cellulosic material preferably has a stock consistency of at least 2.0%; or preferably in the thin stock area, i.e. to the thin stock, where the cellulosic material preferably has a stock consistency of less than 2.0%; wherein the ionic polymer and the optionally added auxiliary ionic polymer preferably have a different average molecular weight and preferably a different ionicity, wherein the ionicity is the molar content of ionic monomer units relative to the total amount of monomer units; and/or
(i) screening and/or cleaning the cellulosic material in the thin stock area, i.e. after diluting the thick stock into a thin stock.

In this respect, it should be emphasized that the aforementioned steps (c) to (g) and (i) are optional only, meaning that any one, any two, any three or any four of steps (c) to (g) and (i) may be omitted. It is also possible that the six steps (c) to (g) and (i) are omitted during the paper making process. According to the invention step (b), the treatment of the cellulosic material containing the starch with one or more biocides, is mandatory and may be performed either during the pulping step (a) and/or after the pulping step (a). Provided that step (b), the treatment of the cellulosic material containing the starch with one or more biocides, is at least partially performed after the pulping step (a), it can either be performed before step (c) or at any time during the aforementioned steps (c) to (g). Preferably, however, step (b) is performed before the cellulosic material containing the starch is diluted from a thick stock (being processed at the thick stock area) to a thin stock (being further processed at the thin stock area), i.e. before step (i).

Devices that are suitable for the subsequent steps after pulping step (a) are known to the skilled person. For example, the cellulosic material containing the (non-degraded) starch may be pumped from the pulper into a stock vat, a mixing vat and/or a machine vat before it is supplied to the papermaking machine (i.e. to the so-called "constant part" of the papermaking machine).

The temporal sequence of steps (c) to (g) can be freely chosen, meaning that the temporal sequence of steps (c) to (g) does not necessarily follow the alphabetical order as indicated. Preferably, however, the order is alphabetical.

Further process steps such as storing the cellulosic material in storage tanks or additional washing and/or screening steps may be incorporated after any of the process steps (a) to (g).

In a preferred embodiment, the temporal sequence of the process steps is selected from the group consisting of (a)→(g); (a)→(c)→(g); (a)→(d)→(g); (a)→(e)→(g); (a)→(f)→(g); (a)→(c)→(d)→(g); (a)→(c)→(e)→(g); (a)→(c)→(f)→(g); (a)→(d)→(e)→(g); (a)→(d)→(f)→(g); (a)→(e)→(f)→(g); (a)→(c)→(d)→(e)→(g); (a)→(c)→(d)→(f)→(g); (a)→(c)→(e)→(f)→(g); (a)→(d)→(e)→(f)→(g); and (a)→(c)→(d)→(e)→(f)→(g);

wherein, for the purpose of the specification, the symbol "→" means "followed by"; and further process steps such as storing the cellulosic material in storage tanks or additional washing and/or screening steps may be incorporated after any one of the process steps (a) to (g). Step (b), the treatment of the cellulosic material containing the starch with the biocide, can also be incorporated after any one of the process steps (a) to (g).

At least one part of the biocide is preferably added during the pulping step (a) or shortly thereafter. Provided that the biocide which was initially added during pulping step (a) is not completely removed or consumed in the subsequent steps, the biocide is also present in the process steps (c), (d), (e), (f) and (g), if any, which follow the pulping step (a).

In a preferred embodiment, at least one part of the remainder of the total amount (total inflow) of the biocide is added to the cellulosic material during any of steps (c), (d), (e), (f) and/or (g). For example, 50 wt.-% of the total amount (total inflow) of the biocide may be added continuously or discontinuously, prior to and/or during the pulping step (a) and the remaining 50 wt.-% of the total amount (total inflow) of the biocide may be added continuously or discontinuously, prior to, during and/or after the process steps (c), (d), (e), (f) and/or (g).

A person skilled in the art is aware that after each of the process steps (a) to (g), the mixture comprising the cellulosic material and the biocide may be supplied to storage tanks, before it is re-introduced to further process steps of the paper making process.

It is also apparent to a person skilled in the art that at least one part of the remainder of the total amount (total inflow) of the biocide may be added to the cellulosic material, when it is stored in storage tanks after any of process steps (a), (c), (d), (e), (f) and (g).

In general, the pulping step (a) is performed before the cellulosic material containing the (non-degraded) starch enters the papermaking machine. In a preferred embodiment, at least one part of the biocide is added to the water used for pulping prior to or during the pulping step to the cellulosic material, i.e. to the virgin, recycle or blend material. Said addition takes place preferably at least 5 minutes, or at least 10 minutes, or at least 20 minutes, or at least 30 minutes, or at least 40 minutes before the cellulosic material is supplied to the wet end of the papermaking machine, e.g. through the flow box.

In a preferred embodiment, said addition takes place preferably at most 360 minutes, or at most 300 minutes, or at most 240 minutes, or at most 180 minutes, or at most 120 minutes, or at most 60 minutes before the cellulosic material is supplied to the wet end of the papermaking machine, e.g. through the flow box.

Preferably, the time period during which the cellulosic material is in contact with biocide is within the range of from 10 minutes to 3 days.

In a preferred embodiment of the method according to the invention, the time period during which the cellulosic material is in contact with biocide is at least 10 minutes, or at least 30 minutes, or at least 60 minutes, or at least 80 minutes, or at least 120 minutes.

In a preferred embodiment of the method according to the invention, the time period during which the cellulosic material is in contact with biocide is preferably within the range of 12±10 hours, or 24±10 hours, or 48±12 hours, or 72±12.

The duration of pulping step (a) is not critical to the invention. After the pulping step, the pulp according to the invention may be subjected to a de-inking step (c), wherein the virgin pulp, recycle pulp or blend pulp is de-inked, preferably in the presence of the biocide.

After the pulping step, the pulp according to the invention may be subjected to a blending step (d). The blending (d), also referred to as stock preparation, is typically performed in a so-called blend chest, i.e. a reaction vessel wherein additives such as dyes, fillers (e.g., talc or clay) and sizing agents (e.g., rosin, wax, further starch, glue) are added to the pulped cellulosic material, preferably to virgin pulp, recycle pulp or blend pulp, preferably in the presence of the biocide. Fillers are preferably added to improve printing properties, smoothness, brightness, and opacity. Sizing agents typically improve the water resistance and printability of the final paper, paperboard and/or cardboard. The sizing may also be performed on the papermaking machine, by surface application on the sheet.

After the pulping step, the pulp according to the invention may be subjected to a bleaching step (e). Typically, the bleaching (e) is performed to whiten the pulped cellulosic material, preferably in the presence of the biocide. In said bleaching process, chemical bleaches such as hydrogen peroxide, sodium bisulfite or sodium hydrosulfite are typically added to the pulped cellulosic material to remove the color.

After the pulping step, the pulp according to the invention may be subjected to a refining step (f). The refining (f) is preferably performed in a so-called pulp beater or refiner by fibrillating the fibers of the cellulosic material, preferably in the presence of the biocide. The purpose is preferably to brush and raise fibrils from fiber surfaces for better bonding to each other during sheet formation resulting in stronger paper. Pulp beaters (e.g., Hollander beater, Jones-Bertram beater, etc.) process batches of pulp while refiners (e.g., Chaflin refiner, Jordan refiner, single or double disk refiners, etc.) process pulp continuously.

After the pulping step, the pulp according to the invention may be subjected to a screening step (g). The screening (g) is preferably applied to remove undesirable fibrous and non-fibrous material from the cellulosic material, preferably in the presence of the biocide, preferably by the use of rotating screens and centrifugal cleaners.

Before the cellulosic material enters the papermaking machine the cellulosic material which is present as a "thick stock" is diluted with water to "thin the stock". After dilution, the pulp according to the invention may be subjected to a further screening and/or cleaning step (i).

Thereafter, typically close to the end of the paper-making process, the cellulosic material is supplied to a papermaking machine, where it typically enters the wet end of the papermaking machine.

This is where section (IV) of the overall method for the manufacture of paper, paperboard or cardboard begins.

For the purpose of the specification the term "papermaking machine" preferably refers to any device or component thereof that basically serves the formation of sheets from an aqueous suspension of the cellulosic material. For example, the pulper is not to be regarded as a component of the papermaking machine.

Typically, a papermaking machine has a wet end which comprises a wire section and a press section, and a dry end which comprises a first drying section, a size press, a second drying section, a calender, and "jumbo" reels.

The first section of the wet end of the papermaking machine is typically the wire section, where the cellulosic material is supplied through a flow box to the wire section and distributed evenly over the whole width of the papermaking machine and a significant amount of water of the aqueous dispersion or aqueous suspension of the cellulosic material is drained away. The wire section, also called forming section, can comprise one layer or multi layers, wherein multi preferably means 2, 3, 4, 5, 6, 7, 8 or 9 layers (plies). Subsequently, the cellulosic material enters preferably the press section of the papermaking machine where remaining water is squeezed out of the cellulosic material, which forms a web of cellulosic material, which then in turn is preferably supplied to the dry end of the papermaking machine.

The so-called dry end of the papermaking machine comprises preferably a first drying section, optionally a size press, a second drying section, a calender, and "jumbo" reels. The first and the second drying section comprise preferably a number of steam-heated drying cylinders, where synthetic dryer fabrics may carry the web of cellulosic material round the cylinders until the web of cellulosic material has a water content of approximately 4 to 12%. An aqueous solution of starch may be added to the surface of the web of the cellulosic material in order to improve the surface for printing purposes or for strength properties. Preferably, the web of cellulosic material is then supplied to the calender, where it is smoothed and polished. Subsequently, the cellulosic material is typically reeled up in the so-called "jumbo" reel section.

In a preferred embodiment, the method according to the invention is performed on a papermaking plant that can be regarded as having an open water supply and thus an open water circuit. Papermaking plants of this type are typically characterized by a effluent plant, i.e. by an effluent stream by means of which an aqueous composition is continuously drawn from the system.

In another preferred embodiment, the method according to the invention is performed on a papermaking plant that can be regarded as having a closed water recycle circuit. Papermaking plants of this type are typically characterized by not having any effluent plant, i.e. there is no effluent stream by means of which an aqueous composition is continuously drawn from the system, while the paper, of course, contains some residual moisture. All papermaking plants (closed and open systems) typically allow for evaporation of (gaseous) water, whereas closed systems do not allow for liquid effluent streams. It has been surprisingly found that the method according to the invention is of particular advantage in such closed water recycle circuit. Without the method according to the invention, the starch in the liquid phase would concentrate from recycle step to recycle step and finally end up in a highly viscous pasty composition not useful for any paper manufacture. By means of the method according to the invention, however, starch is fixated, preferably re-fixated to the fibers thereby avoiding any concentration effect from recycle step to recycle step.

In a preferred embodiment, at least 50 wt.-%, of the biocide, which is present during step (b), is still present when the cellulosic material containing the (non-degraded) starch enters the wet end of the papermaking machine. In case that the loss of biocide during the paper making process is too high, further parts of the biocide may be added during any of the process steps (c), (d), (e), (f) and/or (g).

In another preferred embodiment, at most 50 wt.-% of the biocide, which is present during step (b), is still present when the cellulosic material containing the (non-degraded) starch enters the papermaking machine.

A further one or two component biocide (further biocide) that differs in nature from the biocide of step (b) (first biocide) may be also added to the cellulosic material containing the (non-degraded) starch prior to, during or after the process steps (c) to (g) and/or after the cellulosic material has been supplied to the papermaking machine.

Provided that the biocide which was added during step (b) and optionally in the process steps (c), (d), (e), (f), and (g), if any, which follow the pulping step (a), is not completely removed in the subsequent steps, said biocide is also present in the papermaking machine.

In a preferred embodiment, at least one part of the remainder of the total amount (total inflow) of the biocide (first biocide) and/or another biocide (further biocide) is added to the cellulosic material subsequent to any of steps (c), (d), (e), (f) and/or (g), i.e. at the papermaking machine. For example, 50 wt.-% of the total amount (total inflow) of the first biocide may be added discontinuously or continuously prior to and/or during the pulping step (a) and/or after the process steps (c), (d), (e), (f) and/or (g), and the remaining 50 wt.-% of the total amount (total inflow) of the first biocide may be added discontinuously or continuously, at the papermaking machine.

In a preferred embodiment, further biocide (i.e. another portion of the first biocide and/or a further biocide differing in nature from the first biocide) is added to the cellulosic material containing the (non-degraded) starch at the wet end of the papermaking machine, preferably at the wire section. In a preferred embodiment, said further biocide is added at the machine chest or mixing chest, or at the regulating box, or at the constant part of the papermaking machine. In a preferred embodiment, at least a portion of said further biocide is added to one or more water streams of the papermaking plant selected from the group consisting of pulper dilution water, white water (such as white water 1 and/or white water 2), clarified shower water, clear filtrate, and inlet of clarification. Adding at least a portion of said further biocide to the pulper dilution water is particularly preferred.

According to the invention, step (h) comprises adding an ionic polymer, preferably a cationic polymer and preferably an auxiliary ionic, preferably a cationic auxiliary polymer, preferably to a thick stock of the cellulosic material, preferably having a stock consistency of at least 2.0%; or to a thin stock of the cellulosic material, preferably having a stock consistency of less than 2.0%; wherein the ionic polymer and the optionally present auxiliary ionic polymer preferably have a different average molecular weight and preferably a different ionicity, wherein the ionicity is the molar content of ionic monomer units relative to the total amount of monomer units.

The ionic polymer and the auxiliary ionic polymer according to the invention differ from one another. If the ionic polymer and the auxiliary ionic polymer are derived from the same monomer units, both polymers are still characterized by features according to which a skilled person can clearly recognize that the two polymers differ from one another, taking into account the statistical nature of most polymerization reactions, e.g. because of the significantly different weight average molecular weights and/or the significantly different cationicity.

As the ionic polymer and the optionally present auxiliary ionic polymer preferably have a different ionicity, wherein the ionicity is the molar content of ionic monomer units relative to the total amount of monomer units, at least one of the polymers is a copolymer comprising ionic as well as non-ionic monomer units. In a preferred embodiment, the ionic polymer is a homopolymer of ionic monomer units and the auxiliary ionic polymer is a copolymer comprising ionic monomer units and non-ionic monomer units. In another preferred embodiment, the ionic polymer is a copolymer comprising ionic monomer units and non-ionic monomer units and the auxiliary ionic polymer is a homopolymer of ionic monomer units. In still another embodiment, the ionic polymer as well as the auxiliary ionic polymer is a copolymer each comprising ionic monomer units and non-ionic monomer units.

Preferably, step (h) comprises the substeps ($h_1$) adding an ionic, preferably a cationic polymer to the cellulosic material, preferably in the thick stock area, where the cellulosic material preferably has a stock consistency of at least 2.0%, or preferably in the thin stock area, where the cellulosic material preferably has a stock consistency of less than 2.0%; and, ($h_2$) preferably, adding an auxiliary ionic, preferably cationic polymer to the cellulosic material, preferably in the thick stock area where the cellulosic material preferably has a stock consistency of at least 2.0%, or preferably in the thin stock area, where the cellulosic material preferably has a stock consistency of less than 2.0 wt.-%;

wherein the ionic polymer and the auxiliary ionic polymer preferably have a different average molecular weight and preferably a different ionicity, wherein the ionicity is the molar content of ionic monomer units relative to the total amount of monomer units.

Substep ($h_1$) may be performed before substep ($h_2$), simultaneously with substep ($h_2$) or after substep ($h_2$). Any partial overlap is also possible. In a preferred embodiment, step (b) is performed at least partially before substeps ($h_1$) and ($h_2$), and substep ($h_2$) in turn is preferably performed at least partially before substep ($h_1$). In other words, preferably a feeding point for at least a part of the total amount of biocide that is added in step (b) is located on the papermaking plant upstream with respect to the feeding points for the ionic polymer and the auxiliary ionic polymer, and a feeding point for at least a part of the total amount of auxiliary ionic polymer that is added in step ($h_2$) is located on the papermaking plant upstream with respect to the feeding point for the ionic polymer added in substep ($h_1$).

A skilled person recognizes that the ionic polymer and the auxiliary ionic polymer may independently of one another be directly added to a location of the plant, i.e. the overall plant for processing the cellulosic material, where thick stock is processed as such and where thin stock is processed as such, respectively. In this regard, direct addition can mean addition of a solid or liquid material containing the polymer to the stock. A skilled person also recognizes that alternatively, the polymer may be added to a location of said plant where no stock is processed as such, but where other liquid, solid or gaseous material is processed which in turn is subsequently added to the stock, i.e. mixed with the thick stock or the thin stock (indirect addition). In this regard, indirect addition can also mean addition of a solid or liquid material containing the polymer to the other liquid, solid or gaseous material that in turn is subsequently added to the thick stock and to the thin stock, respectively.

One purpose of adding the ionic, preferably cationic polymer and the optionally added auxiliary ionic, preferably cationic polymer is fixating, preferably re-fixating the (non-degraded) starch, preferably the (non-degraded) non-ionic, anionic, cationic and/or native starch, particularly the non-ionic, anionic, and/or native starch, to the cellulosic fibers thereby preferably reducing the starch content in the white water.

Cationic polymers are particularly useful for fixating non-ionic, native, zwitter-ionic or anionic starches, while anionic polymers are particularly useful for fixating non-ionic, native, zwitter-ionic or cationic starches.

The ionic, preferably cationic polymer and the auxiliary ionic, preferably cationic polymer may independently of one another be added to the cellulosic material containing the starch at any stage of paper manufacture in the thick stock area, at pulping or after pulping; or at any stage of paper manufacture in the thin stock area. It is apparent to a person skilled in the art that at least a part of the total amount (total inflow) of the polymer may be added to the cellulosic material, i.e. to the virgin, recycle or blend material, during or after the pulping step (a).

For the purpose of specification, the term "thick stock area" refers to any stage of paper manufacture where the cellulosic material is present as "thick stock". Analogously, the term "thin stock area" refers to any stage of paper manufacture where the cellulosic material is present as thin stock. Typically, thick stock is processed at any steps of conventional processes for the manufacture of paper or paperboard taking place before step (i). The terms "thick stock" and "thin stock" are known to the person skilled in the art. Typically, on the papermaking machine thick stock is diluted before step (i) thereby yielding thin stock. For the purpose of the specification, "thick stock" preferably has a solids content (=stock consistency) of at least 2.0 wt.-%, preferably at least 2.1 wt.-%, more preferably at least 22 wt.-%, still more preferably at least 2.3 wt.-%, yet more preferably at least 2.4 wt.-% and most preferably at least 2.5 wt.-%. Thus, for the purpose of the specification, cellulosic material having the above solids content is preferably to be regarded as thick stock, whereas cellulosic material having a lower solids content is to be regarded as thin stock.

In a preferred embodiment, the ionic polymer and/or the auxiliary ionic polymer is independently of one another added to the cellulosic material containing the (non-degraded) starch during any of steps, (a), (c), (d), (e), (f) or (g), i.e. before the cellulosic material containing the (non-degraded) starch is diluted to a "thin stock" and before the cellulosic material containing the (non-degraded) starch enters the papermaking machine. If the method according to the invention comprises one or more of steps (c) to (g), this does not mean that step (h) and its substeps ($h_1$) and ($h_2$), respectively, are performed in alphabetical order, i.e. after all the other steps. Rather, for example, it is possible that after step (a) the ionic polymer is added in step ($h_1$) and that thereafter any of steps (c) to (g) is performed, followed by addition of the auxiliary ionic polymer in step ($h_2$). Preferably, however, the steps of the method according to the invention are performed in alphabetical order.

In a preferred embodiment, the ionic polymer and/or the auxiliary ionic polymer is added to the cellulosic material containing the starch before the biocide is added to the cellulosic material containing the starch.

In this respect, at least one part of the total amount (total inflow) of the ionic polymer and/or the auxiliary ionic polymer may be added directly at the beginning of the pulping step, i.e. directly after the virgin, recycle or blend material is supplied to the pulper. Further, at least a part of the ionic polymer and/or the auxiliary ionic polymer may be added to the cellulosic material at any time during the pulping step, i.e. after the pulping has commenced but prior to recovering the pulped cellulosic material from the pulper. When pulping is performed continuously, the ionic polymer and/or the auxiliary ionic polymer can be added continuously as well.

In another preferred embodiment, the ionic polymer and/or the auxiliary ionic polymer is added to the cellulosic material containing the starch after the biocide has been added. It is also possible, that the biocide and the ionic polymer and/or the auxiliary ionic polymer are added simultaneously to the cellulosic material containing the starch. Further, it is possible that a first part of the ionic polymer and/or the auxiliary ionic polymer is added to the cellulosic material containing the starch before a first part of biocide is added and subsequently a second part of ionic polymer and/or the auxiliary ionic polymer is added, or vice versa.

In another preferred embodiment, the ionic polymer and/or the auxiliary ionic polymer is added before or subsequently with the biocide during the pulping step (a).

In a preferred embodiment, the ionic polymer and/or the auxiliary ionic polymer is added to the cellulosic material containing the starch after the pulping step has been completed.

It is apparent to a person skilled in the art that the amount (inflow) of ionic polymer and/or auxiliary ionic polymer may be added continuously (uniterruptedly) or discontinuously (interruptedly) with respect to one feeding point. Furthermore, the total amount (total inflow) of polymer can be divided in at least two parts, from which at least one part is continuously or discontinuously added to the cellulosic material containing the starch during or after the pulping step (a) and the other part is continuously or discontinuously added elsewhere, i.e. at one or more other feeding points.

In a preferred embodiment, the total amount (total inflow) of ionic polymer and/or the auxiliary ionic polymer is added to the cellulosic material during the pulping step (a) continuously or discontinuously, i.e. 100 wt.-% of the total amount (total inflow) of the ionic polymer and/or the auxiliary ionic polymer is added to the cellulosic material, i.e. to the virgin, recycle or blend material during or after the pulping step (a).

Provided that the ionic polymer and/or the auxiliary ionic polymer which was added during step (a) and optionally in the process steps (c), (d), (e), (f) and (g), if any, which follow the pulping step (a), is not completely removed in the subsequent steps, the ionic polymer and/or the auxiliary ionic polymer is also present in the papermaking machine.

In a preferred embodiment, at least one part of the remainder of the total amount (total inflow) of the ionic polymer and/or the auxiliary ionic polymer is added to the cellulosic material subsequent to any of steps (c), (d), (e), (f) and/or (g). For example, 50 wt.-% of the total amount (total inflow) of the ionic polymer and/or the auxiliary ionic polymer may be added continuously or discontinuously, during the pulping step (a) and the remaining 50 wt.-% of the total amount (total inflow) of the ionic polymer and/or the auxiliary ionic polymer may be added continuously or discontinuously, at any other processing step, e.g. within the thick stock area.

In a preferred embodiment, the ionic polymer and/or the auxiliary ionic polymer is added at the machine chest or mixing chest, or at the regulating box. In a preferred embodiment, the ionic polymer and/or the auxiliary ionic polymer is added to the outlet of the machine chest.

According to the method of the invention, the addition of the ionic polymer and of the optionally added auxiliary ionic polymer to the cellulosic material serves the purpose of (re-) fixating the starch to the cellulose fibers of the cellulose material thereby substantially reducing the content of free (i.e. unbound dissolved or dispersed starch) in the cellulosic material. In this regard, for the purpose of the specification, "(re-)fixating" starch can mean both, refixating non-degraded starch and/or fixating newly added starch to the cellulose fibers.

(Re-)fixation of starch to the cellulose fibers leads to a decrease of extinction when subjecting the aqueous phase of the cellulosic material to a iodine test. Thus, efficient (re-) fixation of starch by means of the ionic polymer and/or the auxiliary ionic polymer can be monitored by measuring the extinction of the starch that is contained in the aqueous phase of the cellulosic material by means of the iodine test.

Preferably, in step (h) of the method according to the invention the ionic polymer and/or the auxiliary ionic polymer independently of one another is continuously or discontinuously added to the cellulosic material in quantities so that after 3 days of treatment, preferably after 1 week of treatment on a continuously operating papermaking plant, the extinction of the starch contained in the aqueous phase of the cellulosic material has been decreased by at least 5%, or by at least 10%, or by at least 15%, or by at least 20%, or by at least 25%, or by at least 30%, or by at least 35%, or by at least 40%, or by at least 45%, or by at least 50%, or by at least 55%, or by at least 60%, or by at least 65%, or by at least 70%, or by at least 75%, or by at least 80%, compared to the extinction that was measured, preferably at the same location, preferably at the wet end entry of the papermaking machine immediately before the polymer was added for the first time or before the addition of higher amounts of biocide than conventionally employed was started, i.e. compared to a situation where microorganisms had been prevented from degrading the starch by means of the biocide added in step (b), but in the absence of ionic polymer and/or auxiliary ionic polymer. In a preferred embodiment, the extinction of native starch is monitored. This can be done at a particular wave length, typically at 550 nm (for details it is referred to the experimental section).

Thus, as far as the content of free starch in the aqueous phase of the cellulosic material is concerned, steps (b) and (h) of the method according to the invention have opposite effects: While step (b) prevents starch from being degraded by microorganisms and thus increases the content of free starch, step (h) causes (re-)fixation, i.e. deposition of the starch and thus decreases the content of free starch. These opposing effects of the method according to the invention can easily be demonstrated by experiments where a conventional, equilibrated method for manufacture of paper, paperboard or cardboard is firstly modified by step (b) only, thus leading to a substantial increase of the free starch content in the aqueous phase of the cellulosic material (which can be monitored e.g. by the iodine test), and then, once the thus modified method has equilibrated, secondly, additionally modifying the method also by step (h), thus leading to a substantial decrease of the free starch content in the aqueous phase of the cellulosic material (which also can be monitored e.g. by the iodine test).

As the starch is (re-)fixated to the cellulose fibers, the strength of the paper, paperboard or cardboard is increased. Thus, another aspect of the invention relates to a method to increase the strength of paper, paperboard or cardboard comprising to method for the manufacture of paper, paperboard or cardboard according to the invention.

Further, as the starch is (re-)fixated to the cellulose fibers, the papermaking machine drainage and/or production rate can be increased. Thus, another aspect of the invention relates to a method to increase papermaking machine drainage and/or production rate comprising to method for the manufacture of paper, paperboard or cardboard according to the invention.

Still further, as the starch is (re-)fixated to the cellulose fibers, the effluent COD in the papermaking process can be reduced. Thus, another aspect of the invention relates to a method to reduce the effluent COD in the papermaking process comprising to method for the manufacture of paper, paperboard or cardboard according to the invention.

In a preferred embodiment, the ionic polymer and/or the auxiliary ionic polymer independently of one another is dosed to the cellulosic material containing the starch during or after the pulping step (a) to a final concentration of at least 50 g/metric ton, or at least 100 g/metric ton, or at least 250 g/metric ton, or at least 500 g/metric ton, or at least 750 g/metric ton, or at least 1,000 g/metric ton, or at least 1,250 g/metric ton, or at least 1,500 g/metric ton, wherein the metric tons are preferably based on the overall composition containing the cellulosic material, and the grams are preferably based on the ionic polymer as such (active content). More preferably, the ionic, preferably cationic polymer is dosed to the cellulosic material during or after the pulping step (a) to a final concentration of from 100 to 2,500 g/metric ton, or from 200 to 2,250 g/metric ton, or from 250 to 2,000 g/metric ton, or from 300 to 1,000 g/metric ton wherein the metric tons are preferably based on the overall composition containing the cellulosic material, and the grams are preferably based on the ionic polymer and the auxiliary ionic polymer, respectively, as such (active content).

In a preferred embodiment, preferably when the ionic polymer and/or the auxiliary ionic polymer is employed in solid state, e.g. as a granular material, the ionic polymer and/or the auxiliary ionic polymer independently of one another is dosed to the cellulosic material to a concentration of 1,500±750 g/metric ton, or 1,500±500 g/metric ton, or 1,500±400 g/metric ton, or 1,500±300 g/metric ton, or 1,500±200 g/metric ton, or 1,500±100 g/metric ton, based on the overall composition containing the cellulosic material. In another preferred embodiment, preferably when the ionic polymer and/or the auxiliary ionic polymer independently of one another is employed in emulsified state, e.g. as a water-in-oil emulsion, the ionic polymer and/or the auxiliary ionic polymer independently of one another is dosed to the cellulosic material to a concentration of 2,500±750 g/metric ton, or 2,500±500 g/metric ton, or 2,500±400 g/metric ton, or 2,500±300 g/metric ton, or 2,500±200 g/metric ton, or 2,500±100 g/metric ton, based on the overall composition containing the cellulosic material and related to the polymer content, i.e. not to the water and oil content of the water-in-oil emulsion.

It has been found that the biocide and the ionic polymer and the optionally added auxiliary ionic polymer reduce not only the COD of the resulting effluents such as waste water, but can also improve the strength properties of the final paper products. This indicates that the ionic polymer and the optionally added auxiliary ionic polymer are stable throughout the paper making process.

In a preferred embodiment, the combined treatment of the cellulosic material containing the starch with the biocide and the ionic polymer and the optionally added auxiliary ionic polymer in the thick stock or thin stock area according to the invention results in a decrease in the COD value of the waste water of at least 3.0%, or at least 5.0%, or at least 10%, or at least 15%, or at least 20%, or at least 25%, or at least 30%, or at least 40%, or at least 50%, or at least 60%, or at least 70%, when compared to the COD of waste water, which is obtained when the cellulosic material is processed in the absence of the biocide and when no polymer is added. The COD value is preferably measured in accordance with ASTM D1252 or ASTM D6697.

In a further preferred embodiment, the combined treatment of the cellulosic material containing the starch with the biocide and the ionic polymer and the optionally added auxiliary ionic polymer result in a reduction of turbidity of at least 5.0%, or at least 10%, or at least 15%, or at least 20%, or at least 25%, or at least 30%, or at least 35%, or at least 40%, or at least 50%, or at least 60%, or at least 70%, or at least 80%, or at least 90%, when compared to the turbidity measured for the final paper product made from cellulosic material which was not treated with the biocide and the polymer during pulping or shortly after. The turbidity is preferably measured in accordance with ASTM D7315-07a.

In another preferred embodiment, the combined treatment of the cellulosic material containing the starch with the biocide and the ionic polymer and the optionally added auxiliary ionic polymer result in an increase in the Scott Bond value of the final paper product of at least 2.0%, or at least 5.0%, or at least 10%, or at least 15%, or at least 20%, or at least 25%, or at least 30%, or at least 40%, or at least 50%, or at least 60%, or at least 70%, when compared to the Scott Bond value measured for the final paper product made from cellulosic material which was not treated with the biocide and the polymer during pulping or shortly after. The Scott Bond value is preferably measured in accordance with TAPPI T 833 pm-94.

In still another preferred embodiment, the combined treatment of the cellulosic material containing the starch with the biocide and the ionic polymer and the optionally added auxiliary ionic polymer result in an increase in the CMT value of the final paper product of at least 2.0%, or at least 5.0%, or at least 10%, or at least 15%, or at least 20%, or at least 25%, or at least 30%, or at least 40%, or at least 50%, or at least 60%, or at least 70%, when compared to the CMT value measured for the final paper product made from cellulosic material which was not treated with the biocide and the polymer during pulping or shortly after. The CMT value is preferably measured in accordance with DIN EN ISO 7236 or TAPPI method T 809.

In yet another preferred embodiment, the combined treatment of the cellulosic material containing the starch with the biocide and the ionic polymer and the optionally added auxiliary ionic polymer result in an increase in the SCT value of the final paper product of at least 2.0%, or of at least 5.0%, or at least 10%, or at least 15%, or at least 20%, or at least 25%, or at least 30%, or at least 40%, or at least 50%, or at least 60% or at least 70%, when compared to the SCT value measured for the final paper product made from cellulosic material which was not treated with the biocide and the polymer during pulping or shortly after. The SCT value is preferably measured in accordance with DIN 54 518 or TAPPI method T 826.

In a further preferred embodiment, the combined treatment of the cellulosic material containing the starch with the biocide and the ionic polymer and the optionally added auxiliary ionic polymer result in an increase in the bursting strength (Mullen bursting strength) of the final paper product of at least 2.0%, or at least 5.0%, or at least 10%, or at least 15%, or at least 20%, or at least 25%, or at least 30%, or at least 40%, or at least 50%, or at least 60%, or at least 70%, when compared to the bursting strength measured for the final paper product made from cellulosic material which was not treated with the biocide and the polymer during pulping or shortly after. The bursting strength is preferably measured in accordance with TAPPI 403os-76 or ASTM D774.

In a further preferred embodiment, the combined treatment of the cellulosic material containing the starch with the biocide and the ionic polymer and the optionally added auxiliary ionic polymer result in an increase in the breaking length of the final paper product of at least 2.0%, or at least 5.0%, or at least 10%, or at least 15%, or at least 20%, or at least 25%, or at least 30%, or at least 40%, or at least 50%, or at least 60%, or at least 70%, when compared to the breaking length measured for the final paper product made from cellulosic material which was not treated with the biocide and the polymer during pulping or shortly after. The breaking length is preferably measured in accordance with TAPPI Method T 404 cm-92.

For the purpose of the specification, the term "cationic polymer" preferably refers to water-soluble and/or water-swellable polymers, which have a positive net charge. The cationic polymers may be branched or unbranched, cross-linked or not cross-linked, grafted or not grafted. The cationic polymers according to the invention are preferably neither branched, nor cross-linked, nor grafted.

For the purpose of the specification, the term "anionic polymer" preferably refers to water-soluble and/or water-swellable polymers, which have a negative net charge. The anionic polymers may be branched or unbranched, cross-linked or not cross-linked, grafted or not grafted. The anionic polymers according to the invention are preferably neither branched, nor cross-linked, nor grafted.

A person skilled in the art knows the meaning of the terms "branched polymer", "unbranched polymer", "cross-linked polymer" and "graft polymer". Definitions for these terms may be found preferably in A. D. Jenkins et al. Glossary of Basic Terms in Polymer Science. *Pure & Applied Chemistry* 1996, 68, 2287-2311.

For the purpose of the specification the term "water-swellable" preferably refers to the increase in volume of polymer particles associated with the uptake of water (cf. D. H. Everett. Manual of Symbols and Terminology for Physicochemical Quantities and Units. Appendix II, Part I: Definitions, Terminology and Symbols in Colloid and Surface Chemistry. *Pure & Applied Chemistry* 1972, 31, 579-638). The swelling behavior of polymers may be measured at different temperatures and pH values in water. The swollen weights of the polymers are determined at intervals, after removal of the surface water, until equilibrium swelling is attained. The percent swelling is preferably calculated by the following equation: % swelling=$100\times[(W_t-W_0)/W_0]$, where $W_o$ is the initial weight and $W_t$ the final weight of the gel at time t (cf. I. M. El-Sherbiny et al. Preparation, characterization, swelling and in vitro drug release behaviour of poly[N-acryloylglycine-chitosan] interpolymeric pH and thermally-responsive hydrogels. *European Polymer Journal* 2005, 41, 2584-2591).

The water-swellable ionic polymers and/or the auxiliary ionic polymers according to the invention may preferably display a % swelling of at least 2.5%, or at least 5.0%, or at least 7.5%, or at least 10%, or at least 15%, or at least 20% measured in demineralized water at 20° C. and pH 7.4 in phosphate buffer after equilibrium swelling is attained.

For the purpose of the specification, the term "polymer" preferably refers to a material composed of macromolecules containing >10 monomer units (cf. G. P. Moss et al. Glossary of Class Names of Organic Compounds and Reactive Intermediates Based on Structure. *Pure & Applied Chemistry* 1995, 67, 1307-1375).

The ionic polymer and/or the auxiliary ionic polymer independently of one another may each consist of a single type of ionic, preferably cationic polymer or may be contained in a composition comprising different ionic, preferably cationic polymers.

The ionic polymers and/or the auxiliary ionic polymers independently of one another may be homopolymers, which preferably comprise ionic, preferably cationic monomer units as the only monomer component. Further, the ionic polymers and/or the auxiliary ionic polymers independently of one another may also be copolymers, i.e. bipolymers, terpolymers, quaterpolymers, etc., which comprise, e.g., different ionic, preferably cationic monomer units; or ionic, preferably cationic as well as non-ionic monomer units.

For the purpose of the specification, the term "homopolymer" preferably refers to a polymer derived from one species of monomer and the term "copolymer" preferably refers to a polymer derived from more than one species of monomer. Copolymers that are obtained by copolymerization of two monomer species are termed bipolymers, those obtained from three monomers terpolymers, those obtained from four monomers quaterpolymers, etc. (cf. A. D. Jenkins at al. Glossary of Basic Terms in Polymer Science. *Pure & Applied Chemistry* 1996, 68, 2287-2311).

In case that the ionic polymer and/or the auxiliary ionic polymer is a copolymer, it is preferably independently of one another a random copolymer, a statistical copolymer, a block copolymer, a periodic copolymer or an alternating copolymer, more preferably a random copolymer. In a particularly preferred embodiment, the ionic polymer and/or the auxiliary ionic polymer independently of one another is a copolymer with one of the co-monomers being acrylamide.

A person skilled in the art knows the meaning of the terms "random copolymer", "statistical copolymer", "periodic copolymer", "block copolymer" and "alternating copolymer". Definitions for these terms may be found preferably in A. D. Jenkins et al. Glossary of Basic Terms in Polymer Science. *Pure & Applied Chemistry* 1996, 68, 2287-2311.

For the purpose of the specification, the expression "at least two different ionic polymers" refers to a mixture (blend) of ionic polymers comprising more than one, preferably two, three or four ionic polymers that differ from each other in their monomer units, molecular weight, polydispersity and/or tacticity, etc. The different polymers may also differ in their ionicity, i.e. one ionic polymer may by cationic, another anionic.

For the purpose of the specification, the term "ionicity" shall refer to the net charge of a polymer as well as to its quantitative, preferably molar content of ionic monomer units based on the total content of monomer units, preferably expressed in mole.-%.

Preferably, the ionic polymer and/or the auxiliary ionic polymer independently of one another comprises monomer units that are derived from radically polymerizable, ethylenically unsaturated monomers. Therefore, in a preferred embodiment the polymer backbone of the ionic polymer and/or the auxiliary ionic polymer independently of one another is a carbon chain that is not interrupted by heteroatoms, such as nitrogen or oxygen.

Preferably, the ionic polymer and/or the auxiliary ionic polymer independently of one another is derived from ethylenically unsaturated monomers that are preferably radically polymerizable.

In a preferred embodiment, the ionic polymer and/or the auxiliary ionic polymer independently of one another is derived from (meth)acrylic acid derivatives, such as (meth) acrylic acid esters, (meth)acrylic acid amides, acrylonitrile, and the like. Preferably, the ionic polymer and/or the auxiliary ionic polymer independently of one another is a derivative of a poly(meth)acrylate. For the purpose of the specification, the term "(meth)acryl" shall refer to methacryl as well as to acryl.

Preferably, the degree of polymerization of the ionic polymer and/or the auxiliary ionic polymer independently of one another is at least 90%, more preferably at least 95%, still more preferably at least 99%, yet more preferably at least 99.9%, most preferably at least 99.95% and in particular at least 99.99%.

Preferably, the ionic, preferably cationic or anionic polymer has a comparably high average molecular weight that is preferably higher than that of the optionally present auxiliary ionic polymer. Preferably, the weight average molecular weight $M_w$ of the ionic, preferably cationic or anionic polymer, that can be measured e.g. by GPC, is at least 100,000 g/mol or at least 250,000 g/mol, more preferably at least 500,000 g/mol or at least 750,000 g/mol, still more preferably at least 1,000,000 g/mol or at least 1,250,000 g/mol, yet more preferably at least 1,500,000 g/mol or at least 2,000,000 g/mol, most preferably at least 2,500,000 g/mol or at least 3,000,000 g/mol and in particular within the range of from 1,000,000 g/mol to 10,000,000 g/mol or within the range of from 5,000,000 g/mol to 25,000,000 g/mol.

Preferably, the molecular weight dispersity (weight average molecular weight: $M_w$)/(number average molecular weight: $M_n$) of the ionic, preferably cationic or anionic polymer is within the range of from 1.0 to 4.0, more preferably 1.5 to 3.5 and in particular 1.8 to 3.2.

The average molecular weight and the molecular weight distribution of the ionic, preferably cationic or anionic polymer can be measured by a well-known method using gel permeation chromatography. A number average molecular weight and weight-average molecular weight can be calculated using these values, and the ratio ($M_w/M_n$) can also be calculated.

The number average molecular weight ($M_n$) of the ionic, preferably cationic or anionic polymer is preferably 1,000,000-50,000,000 g/mol and more preferably 5,000,000-25,000,000 g/mol.

In a preferred embodiment, the ionic polymer and/or the auxiliary ionic polymer independently of one another is a cationic polymer.

In a preferred embodiment, the cationic polymer and/or the auxiliary cationic polymer independently of one another is derived from vinyl amine or vinyl amine derivatives such as vinylamides, e.g. vinyl formamide or vinyl acetamide.

In another preferred embodiment, the cationic polymer and/or the auxiliary cationic polymer independently of one another is derived from quaternized ammonia compounds comprising radically polymerizable groups such as allyl or acryl groups.

The cationic polymer and/or the auxiliary cationic polymer independently of one another may also be derived from several of the above monomers, e.g. from acrylic acid derivatives as well as from vinyl amine or vinyl amine derivatives.

In a preferred embodiment the cationic polymer and/or the auxiliary cationic polymer independently of one another is a positively charged material composed of macromolecules containing >10 monomer units, wherein at least one monomer is a cationic monomer of general formula (I) as defined below.

Compounds of the following general formula (I) can be used as cationic monomers for manufacturing the water-soluble or water-swellable cationic polymer and/or the auxiliary cationic polymer independently of one another according to the invention:

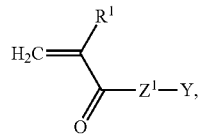

(I)

wherein $R^1$ stands for hydrogen or methyl, $Z^1$ stands for O, NH or $NR^4$, wherein $R^4$ stands for alkyl with 1 to 4 carbon atoms; preferably $Z^1$ stands for NH; and Y stands for one of the groups

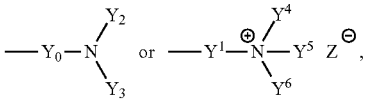

wherein $Y^0$ and $Y^1$ stand for alkylene with 2 to 6 carbon atoms, optionally substituted with hydroxy groups, $Y^2$, $Y^3$, $Y^4$, $Y^5$, and $Y^6$, independently of each other, stand for alkyl with 1 to 6 carbon atoms, and $Z^-$ stands for halide, pseudohalide, acetate or methyl sulfate.

For the purpose of the specification the term "pseudohalide" preferably refers to certain ions such as azide, thiocyanate, and cyanide, which resemble halide ions in their chemistry (cf. G. P. Moss et al. Glossary of Class Names of Organic Compounds and Reactive Intermediates Based on Structure. *Pure & Applied Chemistry* 1995, 67, 1307-1375).

Protonated or quaternized dialkylaminoalkyl(meth)acrylates (e.g. trialkylammoniumalkyl(meth)acrylates) or protonated or quaternized dialkylaminoalkyl-(meth)acrylamides (e.g. trialkylammoniumalkyl(meth)acrylamides) with $C_1$ to $C_3$-alkyl or $C_1$ to $C_3$-alkylene groups are preferred. The methyl halide-quaternized, ethyl halide-quaternized, propyl halide-quaternized, or isopropyl halide-quaternized ammonium salts of N,N-dimethylaminomethyl(meth)acrylate, N,N-dimethylaminoethyl(meth)acrylate, N,N-dimethylaminopropyl(meth)acrylate, N,N-diethylaminomethyl(meth) acrylate, N,N-diethylaminoethyl(meth)acrylate, N,N-diethylaminopropyl(meth)acrylate, N,N-dimethylaminomethyl (meth)acrylamide, N,N-dimethylaminoethyl(meth) acrylamide and/or N,N-dimethylaminopropyl(meth) acrylamide are more preferred. As preferred alkyl halides the alkyl chlorides are used for quaternization. Instead of the alkyl chlorides (i.e., methyl chloride, ethyl chloride, propyl chloride, and isopropyl chloride), the corresponding bromides, iodides, sulfates, etc. may also be used for the quaternization of said N,N-dialkylaminoalkyl(meth)acrylate and N,N-dialkylaminoalkyl(meth)acrylamide derivatives.

Further, the cationic monomer DADMAC (diallyldimethyl ammonium chloride) may be used for the preparation of the cationic polymer and/or the auxiliary cationic polymer according to the invention.

In a preferred embodiment of the invention, the cationic polymer and/or the auxiliary ionic polymer independently of one another contains cationic monomer units selected from the group consisting of ADAME-Quat (quaternized N,N-dimethylaminoethyl acrylate; e.g. N,N,N-trimethylammoniumethyl acrylate), DIMAPA-Quat (quaternized N,N-dimethylaminopropyl acrylamide; e.g. N,N,N-trimethylammoniumpropyl acrylamide) and DADMAC (diallyldimethyl ammonium chloride) as well as non-ionic monomer units selected from the group consisting of acrylamide, methacrylamide and vinylamide and vinylamine, respectively.

Quaternized dialkylaminoalkyl(meth)acrylates with $C_1$ to $C_6$-alkyl, preferably $C_1$ to $C_3$-alkyl or $C_1$ to $C_6$-alkylene groups, preferably $C_1$ to $C_3$-alkylene groups (N,N,N-trialkylammoniumalkyl(meth)acrylates); preferably N,N,N-trialkylammoniumalkyl(meth)acrylate, more preferably N,N,N-trimethylammoniumalkyl(meth)acrylate, still more preferably N,N,N-trimethylammoniumethyl(meth)acrylate, in each case with suitable counter anions, such as halogenide are particularly preferred as cationic monomers for manufacturing the water-soluble or water-swellable polymers according to the invention, especially the ionic polymer.

In a preferred embodiment of the invention, the cationic polymer and/or the auxiliary cationic polymer independently of one another is the reaction product (preferably Michael adduct) of a fully or partially hydrolyzed polyvinylamine and protonated or quaternized N,N-dialkylaminoalkyl acrylamide, preferably DIMAPA-Quat. (quaternized N,N-dimethylaminopropyl acrylamide; e.g. N,N,N-trimethylammoniumpropyl acrylamide) or other cationic, anionic and/or nonionic monomers. Polymers of this type comprise the following structural element:

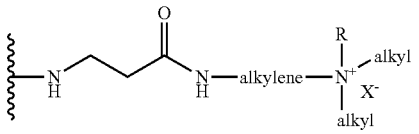

wherein R is H (in case of the protonated form) or alkyl (in case of the quaternized form) and $X^-$ is a counter anion, such as halogen, $HSO_4^-$ and the like.

Quaternized dialkylaminoalkyl(meth)acrylamides with $C_1$ to $C_6$-alkyl, preferably $C_1$ to $C_3$-alkyl or $C_1$ to $C_6$-alkylene groups, preferably $C_1$ to $C_3$-alkylene groups (N,N,N-trialkylammoniumalkyl(meth)acrylamide, wherein "(meth)acrylamide" stands for "methacrylamide or acrylamide"); preferably N,N,N-trialkylammoniumalkyl(meth)acrylamide, more preferably N,N,N-trimethylammoniumalkyl(meth)acrylamide, still more preferably N,N,N-trimethylammoniumpropyl(meth)acrylamide, in each case with suitable counter anions, such as halogenide are particularly preferred as cationic monomers for manufacturing the water-soluble or water-swellable polymers according to the invention, especially the ionic polymer and/or the auxiliary ionic polymer.

For the preparation of cationic polymers and/or the auxiliary cationic polymers independently of one another, a monomer composition is preferably used which comprises one or more cationic monomers. Very preferably, the preparation of cationic polymer and/or auxiliary cationic polymer is carried out using a mixture of one or more nonionic monomers, preferably acrylamide and one or more cationic monomers, in particular any of the cationic monomers as described above.

In another preferred embodiment, the ionic polymer and/or the auxiliary ionic polymer independently of one another is an anionic polymer.

In a preferred embodiment the anionic polymer and/or the auxiliary anionic polymer independently of one another is a negatively charged material composed of macromolecules containing >10 monomer units, wherein at least one monomer is an anionic monomer as defined below.

The anionic monomers which can be used or selected by way of example according to the invention are those listed below:

a.) olefinically unsaturated carboxylic acids and carboxylic acid anhydrides, in particular acrylic acid, methacrylic acid, itaconic acid, crotonic acid, glutaconic acid, maleic acid, maleic anhydride, fumaric acid and the water-soluble alkali metal salts thereof, alkaline earth metal salts thereof, and ammonium salts thereof;

b.) olefinically unsaturated sulfonic acids, in particular aliphatic and/or aromatic vinyl-sulfonic acids, for example vinylsulfonic acid, allylsulfonic acid, styrenesulfonic acid, acrylic and methacrylic sulfonic acids, in particular sulfoethyl acrylate, sulfoethyl methacrylate, sulfopropyl acrylate, sulfopropyl methacrylate, 2-hydroxy-3-methacryloxypropyl-sulfonic acid and 2-acrylamido-2-methylpropanesulfonic acid and the water-soluble alkali metal salts thereof, alkaline earth metal salts thereof, and ammonium salts thereof;

c.) olefinically unsaturated phosphonic acids, in particular, for example, vinyl- and allyl-phosphonic acid and the water-soluble alkali metal salts thereof, alkaline earth metal salts thereof, and ammonium salts thereof;

d.) sulfomethylated and/or phosphonomethylated acrylamides and the water-soluble alkali metal salts thereof, alkaline earth metal salts thereof, and ammonium salts thereof.

Preferably, olefinically unsaturated carboxylic acids and carboxylic acid anhydrides, in particular acrylic acid, methacrylic acid, itaconic acid, crotonic acid, glutaconic acid, maleic acid, maleic anhydride, fumaric acid, and the water-soluble alkali metal salts thereof, alkaline earth metal salts thereof, and ammonium salts thereof are employed as anionic monomers, the water-soluble alkali metal salts of acrylic acid, in particular its sodium and potassium salts and its ammonium salts, being particularly preferred.

For the preparation of anionic polymers and/or the auxiliary anionic polymers independently of one another, a monomer composition is preferably used which consists of from 0 to 100% by weight, preferably of from 5 to 70% by weight and more preferably from 5 to 40% by weight of anionic monomers, in each case based on the total weight of monomer. Very preferably, the preparation of anionic polymer and/or auxiliary anionic polymer independently of one another is carried out using a mixture of nonionic monomers, preferably acrylamide and anionic monomers, in particular olefinically unsaturated carboxylic acids and carboxylic acid anhydrides, preferably acrylic acid, methacrylic acid, itaconic acid, crotonic acid, glutaconic acid, maleic acid, maleic anhydride, fumaric acid and the water-soluble alkali metal salts thereof, alkaline earth metal salts thereof, and ammonium salts thereof, acrylic acid being particularly preferred as the anionic monomer. A mixture of acrylic acid with alkyl(meth) acrylates and/or alkyl(meth)acrylamides is also preferred. In such monomer compositions, the amount of anionic monomers is preferably at least 5% by weight.

The ionic, preferably cationic or anionic polymers and/or the auxiliary ionic polymers independently of one another may be also copolymers, i.e. bipolymers, terpolymers, quaterpolymers, etc., which comprise, e.g., at least two different ionic, preferably cationic or monomer units or ionic, preferably cationic or anionic as well as non-ionic monomer units and/or amphiphilic monomer units.

It is also possible that the ionic polymer and/or the auxiliary ionic polymer independently of one another is a copolymer of cationic, anionic, and optionally non-ionic monomers, whereas the ionicity is dominated by the cationic monomers so that the overall net charge is positive rendering the polymer cationic. Alternatively, the ionic polymer and/or the auxiliary ionic polymer independently of one another can also be a copolymer of cationic, anionic, and optionally non-ionic monomers, whereas the ionicity is dominated by the anionic monomers so that the overall net charge is negative rendering the ionic polymer anionic.

For the purpose of the specification, the term "non-ionic monomer units" preferably refers to monomers of the general formula (II):

(II)

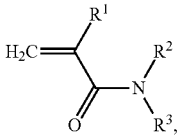

wherein $R^1$ stands for hydrogen or methyl, and $R^2$ and $R^3$ stand, independently of each other, for hydrogen, alkyl with 1 to 5 carbon atoms, or hydroxyalkyl with 1 to 5 carbon atoms.

The non-ionic monomers (meth)acrylamide, N-methyl (meth)acrylamide, N-iso-propyl(meth)acrylamide or N,N substituted (meth)acrylamides such as N,N,-dimethyl(meth) acryl amide, N,N-diethyl(meth)acrylamide, N-methyl-N-ethyl(meth)acrylamide or N-hydroxyethyl(meth)acrylamide are preferably used as comonomers for manufacturing the water-soluble or water-swellable ionic, preferably cationic or anionic polymers and/or the auxiliary ionic polymers according to the invention. The non-ionic monomer acrylamide or methacrylamide is more preferably used.

For the purpose of the specification, the term "amphiphilic monomer units" preferably refers to monomers of the general formula (III) and (IV):

(III)

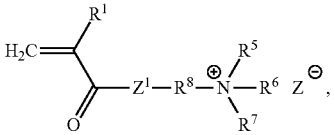

wherein $Z^1$ stands for O, NH or $NR^4$, wherein $R^4$ stands for hydrogen or methyl, $R^1$ stands for hydrogen or methyl, $R^5$ and $R^6$ stand, independently of each other, for alkyl with 1 to 6 carbon atoms, $R^7$ stands for alkyl, aryl and/or aralkyl with 8 to 32 carbon atoms, $R^8$ stands for alkylene with 1 to 6 carbon atoms, and $Z^-$ stands for halogen, pseudohalide ions, methyl sulfate or acetate;

or (IV)

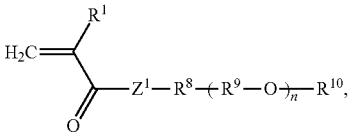

wherein $Z^1$ stands for O, NH or $NR^4$, wherein $R^4$ stands for alkyl with 1 to 4 carbon atoms, $R^1$ stands for hydrogen or methyl, $R^8$ stands for alkylene with 1 to 6 carbon atoms, $R^9$ stands for alkylene with 2 to 6 carbon atoms, and $R^{10}$ stands for hydrogen, alkyl, aryl, and/or aralkyl with 8 to 32 carbon atoms, and n stands for an integer between 1 to 50.

The conversion products of (meth)acrylic acid or (meth) acrylamide with polyethylene glycols (10 to 40 ethylene oxide units) that have been etherified with fatty alcohol are preferably used as amphiphilic monomers for manufacturing the water-soluble or water-swellable ionic polymer and/or the auxiliary ionic polymer according to the invention.

For the purpose of the specification, the term "amphiphilic monomer units" preferably refers to charged, preferably positively charged, or uncharged monomers, which possess both a hydrophilic and a hydrophobic group (cf. D. H. Everett. Manual of Symbols and Terminology for Physicochemical Quantities and Units. Appendix II, Part I: Definitions, Terminology and Symbols in Colloid and Surface Chemistry. *Pure & Applied Chemistry* 1972, 31, 579-638).

In a preferred embodiment, the ionic, preferably cationic or anionic polymer contains at least 10 wt.-%, or at least 25 wt.-%, or at least 50 wt.-%, or at least 75 wt.-%, or about 100 wt.-% of ionic, preferably cationic or anionic monomer units. More preferably, the ionic, preferably cationic or anionic polymer contains 10-100 wt.-%, or 15-90 wt.-%, or 20-80 wt.-%, or 25-70 wt.-%, or 30-60 wt.-% of ionic, preferably cationic or anionic monomer units.

In another preferred embodiment, the ionic, preferably cationic or anionic polymer contains at least 1.0 mole.-%, or at least 2.5 mole.-%, or at least 5.0 mole.-%, or at least 7.5 mole.-%, or at least 10 mole.-% of cationic monomer units. More preferably, the ionic, preferably cationic or anionic polymer contains 2.5-40 mole.-%, or 5.0-30 mole.-%, or 7.5-25 mole.-%, or 8.0-22 mole.-%, or 9.0-20 mole.-% of ionic, preferably cationic or anionic monomer units.

Preferably, the ionic, preferably cationic or anionic polymer contains 15.5±15 mole.-%, 16±15 mole.-%, 16.5±15 mole.-%, 17±15 mole.-%, 17.5±15 mole.-%, 18±15 mole.-%, 18.5±15 mole.-%, 19±15 mole.-%, 19.5±15 mole.-%, 20±15 mole.-%, 20.5±15 mole.-%, 21±15 mole.-%, 21.5±15 mole.-%, 22±15 mole.-%, 22.5±15 mole.-%, 23±15 mole.-%, 23.5±15 mole.-%, 24±15 mole.-%, 24.5±15 mole.-%, 25±15 mole.-%, 25.5±15 mole.-%, 26±15 mole.-%, 26.5±15 mole.-%, 27±15 mole.-%, 27.5±15 mole.-%, 28±15 mole.-%, 28.5±15 mole.-%, 29±15 mole.-%, 29.5±15 mole.-%, 30±15 mole.-%, 30.5±15 mole.-%, 31±15 mole.-%, 31.5±15 mole.-%, 32±15 mole.-%, 32.5±15 mole.-%, 33±15 mole.-%, 33.5±15 mole.-%, 34±15 mole.-%, 34.5±15 mole.-%, 35±15 mole.-%, 35.5±15 mole.-%, 36±15 mole.-%, 36.5±15 mole.-%, 37±15 mole.-%, 37.5±15 mole.-%, 38±15 mole.-%, 38.5±15 mole.-%, 39±15 mole.-%, 39.5±15 mole.-%, or 40±15 mole.-% ionic, preferably cationic or anionic monomer units, based on the total amount of monomer units.

Preferably, the ionic, preferably cationic or anionic polymer contains 8.0±7.5 mole.-%, 8.5±7.5 mole.-%, 9.0±7.5 mole.-%, 9.5±7.5 mole.-%, 10±7.5 mole.-%, 10.5±7.5 mole.-%, 11±7.5 mole.-%, 11.5±7.5 mole.-%, 12±7.5 mole.-%, 12.5±7.5 mole.-%, 13±7.5 mole.-%, 13.5±7.5 mole.-%, 14±7.5 mole.-%, 14.5±7.5 mole.-%, 15±7.5 mole.-%, 15.5±7.5 mole.-%, 16±7.5 mole.-%, 16.5±7.5 mole.-%, 17±7.5 mole.-%, 17.5±7.5 mole.-%, 18±7.5 mole.-%, 18.5±7.5 mole.-%, 19±7.5 mole.-%, 19.5±7.5 mole.-%, 20±7.5 mole.-%, 20.5±7.5 mole.-%, 21±7.5 mole.-%, 21.5±7.5 mole.-%, 22±7.5 mole.-%, 22.5±7.5 mole.-%, 23±7.5 mole.-%, 23.5±7.5 mole.-%, 24±7.5 mole.-%, 24.5±7.5 mole.-%, 25±7.5 mole.-%, 25.5±7.5 mole.-%, 26±7.5 mole.-%, 26.5±7.5 mole.-%, 27±7.5 mole.-%, 27.5±7.5 mole.-%, 28±7.5 mole.-%, 28.5±7.5 mole.-%, 29±7.5 mole.-%, 29.5±7.5 mole.-%, 30±7.5 mole.-%, 30.5±7.5 mole.-%, 31±7.5 mole.-%, 31.5±7.5 mole.-%, 32±7.5 mole.-%, 32.5±7.5 mole.-%, 33±7.5 mole.-%, 33.5±7.5 mole.-%, 34±7.5 mole.-%, 34.5±7.5 mole.-%, 35±7.5 mole.-%, 35.5±7.5 mole.-%, 36±7.5 mole.-%, 36.5±7.5 mole.-%, 37±7.5 mole.-%, 37.5±7.5 mole.-%, 38±7.5 mole.-%, 38.5±7.5 mole.-%, 39±7.5 mole.-%, 39.5±7.5 mole.-%, or 40±7.5 mole.-% ionic, preferably cationic or anionic monomer units, based on the total amount of monomer units.

In still another preferred embodiment, the ionic, preferably cationic or anionic polymer contains 15-50 mole.-%, or 20-45 mole.-%, or 25-40 mole.-%, or 25.5-38 mole.-%, or 26-36 mole.-% of ionic, preferably cationic or anionic monomer units.

In a particular preferred embodiment, the ionic polymer is a cationic polymer that is a copolymer of acrylamide or methacrylamide with quaternized dialkylaminoalkyl(meth)acrylates, quaternized dialkylaminoalkyl(meth)acrylamides or diallylalkyl ammonium halides; more preferably a copolymer of acrylamide with ADAME-Quat (quaternized N,N-dimethylaminoethyl acrylate, i.e. trimethylammoniumethyl acrylate), DI MAPA-Quat (quaternized N,N-dimethylaminopropyl acrylamide, i.e. trimethylammoniumpropyl acrylamide) or DADMAC (diallyldimethyl ammonium chloride); wherein the content of cationic monomers is preferably within the range of from 5 to 99 wt.-%, more preferably 7.5 to 90 wt.-%, still more preferably 10 to 80 wt.-%, most preferably 15 to 60 wt.-%, and in particular 20 to 45 wt.-%, based on the total weight of the cationic polymer.

Preferably, the cationic polymer and/or the auxiliary cationic polymer independently of one another is derived from identical or different monomers according to general formula (V), (V)

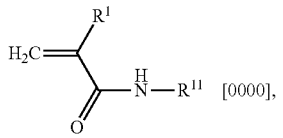

[0000], wherein $R^1$ stands for —H or —$CH_3$, and $R^{11}$ stands for —H or —$C_2$-$C_6$-alkylene-$N^+(C_1$-$C_3$-alkyl$)_3$ $X^-$, where $X^-$ is a suitable anion, such as $Cl^-$, $Br^-$, $SO_4^{2-}$, and the like.

Preferably, the cationic polymer and/or the auxiliary cationic polymer does not contain any vinylamine units or derivatives thereof, such as acylates (e.g. vinylamine, mono- or di-N-alkylvinylamine, quaternized N-alkyl vinylamine, N-formyl vinylamine, N-acetyl vinylamine, and the like).

Homopolymers of quaternized dialkylaminoalkyl(meth) acrylamides or copolymers of quaternized dialkylaminoalkyl (meth)acrylamides and (meth)acrylamides are preferably employed as cationic polymers and/or auxiliary cationic polymers.

In a particularly preferred embodiment, the ionic polymer and/or the auxiliary ionic polymer independently of one another in each case can be contained in a cationic or anionic polymer composition that contains at least one cationic or anionic polymer A and/or at least one cationic or anionic polymer B as defined here below. Preferably, ionic polymer A and ionic polymer B have the same charge, i.e. are either both anionic or both cationic.

Cationic or anionic polymer A is preferably high-molecular with an average molecular weight ($M_w$) of $\geq 1.0\times10^6$ g/mol, as measured by the GPC method. Cationic or anionic polymer B is preferably a low-molecular polymer with an average molecular weight ($M_w$) of at most 500,000 g/mol, or at most 400,000 g/mol, or at most 300,000 g/mol, or at most 200,000 g/mol, as measured by the GPC method.

Thus, it is preferred that the average molecular weight of cationic or anionic polymer A is greater than the average molecular weight of cationic or anionic polymer B. The ratio of the average molecular weights of cationic or anionic polymer A to cationic or anionic polymer B may be at least 4.0, or at least 10, or at least 20, or at least 25, or at least 30, or at least 40.

In a particularly preferred embodiment, the ionic, preferably cationic or anionic polymer and/or the auxiliary ionic, preferably cationic or anionic polymer independently of one another in each case comprises at least one water-soluble or water-swellable cationic or anionic polymer A and/or at least one water-soluble or water-swellable cationic or anionic polymer B as the only polymer components.

The preparation of the water-soluble and water-swellable cationic or anionic polymers is known to the person skilled in the art. For example, the polymers according to the invention may be prepared by polymerization techniques according to the procedures described in WO 2005/092954, WO 2006/072295, and WO 2006/072294.

According to a preferred embodiment of the method according to the invention, step (h) involves the addition of two different ionic, preferably cationic or anionic polymers to the cellulosic material, wherein the second ionic polymer (auxiliary ionic polymer) is preferably added in the thick stock area, where the cellulosic material preferably has a stock consistency of at least 2.0%; or in the thin stock area, where the cellulosic material preferably has a stock consistency of less than 2.0%.

It has been surprisingly found that said two different ionic polymers can act synergistically, particularly with respect to the (re-)fixation of starch to the cellulose fibers. This synergism is particularly pronounced when both polymers have different average molecular weights and/or ionicities.

For the purpose of the specification, one of said two different ionic polymers is to be regarded as the "ionic polymer", whereas the other of said two different ionic polymers according to the invention in the following will be referred to as "auxiliary ionic polymer".

Thus, preferably step (h) of the method according to the invention comprises substep ($h_1$) concerning the addition of the ionic, preferably cationic or anionic polymer according to the invention to the cellulosic material in the thick stock area or in the thin stock area; and substep ($h_2$) concerning the addition of the auxiliary ionic, preferably cationic or anionic polymer according to the invention to the cellulosic material, preferably in the thick stock area or in the thin stock area.

The auxiliary ionic polymer and the ionic polymer can be added to the cellulosic material, preferably to the thick stock or to the thin stock, simultaneously or subsequently, continuously or discontinuously. Preferably, both polymers are added continuously.

The auxiliary ionic polymer and the ionic polymer can be added to the cellulosic material at the same feeding point or at different feeding points. When both polymers are added at the same feeding point, they may be added in form of a single composition containing the auxiliary ionic polymer and the ionic polymer, or in form of different compositions, one containing the auxiliary ionic polymer, the other containing the ionic polymer. A skilled person recognizes that also mixed variants are possible, e.g. one composition may contain a mixture of the auxiliary ionic polymer and the ionic polymer, whereas another composition may contain pure auxiliary ionic polymer, pure ionic polymer, or both, i.e. the auxiliary ionic polymer and the ionic polymer in another mixing ratio.

In a preferred embodiment, the auxiliary ionic polymer is added to the outlet of the mixing chest and/or to the top of the machine chest.

Preferably, the ionic polymer and the auxiliary ionic polymer are added at different locations of the paper making plant. In a preferred embodiment, the feeding point for the ionic polymer is located upstream with respect to the feeding point of the auxiliary ionic polymer. In another preferred embodiment, the feeding point for the ionic polymer is located downstream with respect to the feeding point of the auxiliary ionic polymer.

In a preferred embodiment, at least a portion of the ionic polymer and at least a portion of the auxiliary ionic polymer is added to the thick stock. In another preferred embodiment, at least a portion of the ionic polymer and at least a portion of the auxiliary ionic polymer is added to the thin stock. In still another preferred embodiment, at least a portion of the ionic polymer is added to the thick stock, whereas at least a portion of the auxiliary ionic polymer is added to the thin stock. In yet another preferred embodiment, at least a portion of the ionic polymer is added to the thin stock, whereas at least a portion of the auxiliary ionic polymer is added to the thick stock.

Particularly preferred embodiments $B^1$ to $B^2$ concerning preferred feeding points of the ionic, preferably cationic or anionic polymer and the auxiliary ionic, preferably cationic or anionic polymer according to the invention are summarized in Table 2 here below:

TABLE 2

| | $B^1$ | $B^2$ |
|---|---|---|
| | ionic polymer | |
| feeding point | in section (II), (III), and/or (IV) | in section (III) and/or (IV); but preferably not in section (II) |
| | auxiliary ionic polymer | |
| feeding point | in section (II), (III), and/or (IV) | in section (II) and/or (III); but preferably not in section (IV) |

wherein sections (II) to (IV) refer to the sections of a papermaking plant comprising a papermaking machine,
wherein section (II) includes measures associated with pulping;
section (III) includes measures taking place after pulping but still outside the papermaking machine; and
section (IV) includes measures taking place inside the papermaking machine.

Particularly preferred embodiments of the method according to the invention relate to combinations of any of embodiments $A^1$ to $A^6$ as summarized in Table 1 with any of embodiments $B^1$ to $B^2$ as summarized in Table 2; particularly $A^1+B^1$, $A^1+B^2$; $A^2+B^1$, $A^2+B^2$; $A^3+B^1$, $A^3+B^2$; $A^4+B^1$, $A^4+B^2$; $A^5+B^1$, $A^5+B^2$; $A^6+B^1$, $A^6+B^2$.

When the auxiliary ionic polymer and the ionic polymer are contained in different compositions, said compositions may independently of one another be liquid or solid. Preferably, the composition containing the auxiliary ionic polymer is liquid and the composition containing the ionic polymer is solid.

The auxiliary ionic polymer can be cationic or anionic. Preferably, it has the same charge as the ionic polymer, i.e. either the ionic polymer as well as the auxiliary ionic polymer are either both cationic or both anionic.

In principle, the preferred properties such as chemical composition (e.g. monomers, comonomers, molecular weight, and the like) of the ionic polymer according to the invention that have been described above also fully apply to the auxiliary ionic polymer according to the invention. Thus, for the purpose of the specification, the above definitions referring to the ionic, preferably cationic or anionic polymer according to the invention shall also refer to the auxiliary ionic polymer according to the inventions and therefore, are not explicitly repeated hereinafter. For example, when the auxiliary ionic polymer is cationic, it is preferably derived from a monomer composition containing cationic monomers of general formula (I).

In a preferred embodiment, the auxiliary ionic polymer is a homopolymer of cationic monomers. In another preferred embodiment, the auxiliary ionic polymer is a copolymer of cationic and non-ionic monomers.

Preferably, the auxiliary ionic polymer is a copolymer of cationic and optionally non-ionic monomers, and anionic comonomers, whereas the ionicity is dominated by the cationic monomers so that the overall net charge is positive rendering the auxiliary ionic polymer cationic. In this embodiment, the auxiliary ionic polymer preferably contains at most 20 wt.-%, or at most 17.5 wt.-%, or at most 15 wt.-%, or at most 12.5 wt.-%, or at most 10 wt.-%, or at most 7.5 wt.-%, or at most 6.0 wt.-%, or at most 5.0 wt.-% of anionic monomer units.

Preferably, the auxiliary ionic polymer contains at least 50 wt.-%, or at least 60 wt.-%, or at least 70 wt.-%, or at least 80 wt.-%, or at least 90 wt.-%, or at least 95 wt.-%, or about 100 wt.-% of ionic, preferably cationic or anionic monomer units.

Preferably, the weight average molecular weight $M_w$ of the auxiliary ionic polymer, that can be measured e.g. by GPC, is at most 5,000,000 g/mol, or at most 4,000,000 g/mol, or at most 3,000,000 g/mol, or at most 2,500,000 g/mol, or at most 2,000,000, or at most 1,750,000 g/mol or within the range of from 500,000 g/mol to 1,500,000 g/mol.

Preferably, the weight average molecular weight $M_w$ of the auxiliary ionic polymer is within the range of from 500,000±300,000 g/mol, 600,000±300,000 g/mol, 700,000±300,000 g/mol, 800,000±300,000 g/mol, 900,000±300,000 g/mol, 1,000,000±300,000 g/mol, 1,100,000±300,000 g/mol, 1,200,000±300,000 g/mol, 1,300,000±300,000 g/mol, 1,400,000±300,000 g/mol, 1,500,000±300,000 g/mol, 1,600,000±300,000 g/mol, 1,700,000±300,000 g/mol, 1,800,000±300,000 g/mol, 1,900,0001-300,000 g/mol, 2,000,000±300,000 g/mol, 2,100,000±300,000 g/mol, 2,200,000±300,000 g/mol, 2,300,000±300,000 g/mol, 2,400,000±300,000 g/mol, or 2,500,000±300,000 g/mol;

Preferably, the ionic polymer and the auxiliary ionic polymer have a different ionicity (i.e. the content of ionic monomer units relative to the total amount of monomer units) and/or average molecular weight.

In a preferred embodiment, the ionicity of the auxiliary ionic polymer is higher than the ionicity of the ionic polymer, i.e. the content of ionic monomer units relative to the total amount of monomer units of the auxiliary ionic polymer is higher than that of the ionic polymer.

In a preferred embodiment, the relative difference between the ionicity (i.e. the content of ionic monomer units relative to the total amount of monomer units) of the auxiliary ionic polymer and the ionicity of the ionic polymer is at least 5 mole.-%, or at least 10 mole.-%, or at least 15 mole.-%, or at least 20 mole.-%, or at least 25 mole.-%, or at least 30 mole.-%, or at least 35 mole.-%, or at least 40 mole.-%, or at least 45 mole.-%, or at least 50 mole.-%, or at least 55 mole.-%, or at least 60 mole.-%, or at least 65 mole.-%, or at least 70 mole.-%, or at least 75 mole.-%. For example, when the above difference amounts to at least 40 mole.-% and the ionic polymer has an ionicity of e.g. 30 mole.-%, then the ionicity of the auxiliary ionic polymer is at least 70 mole.-%.

In a preferred embodiment, the ionic polymer and the auxiliary ionic polymer according to the invention are derived from the same monomers and comonomers. For example, when the ionic polymer and the auxiliary anionic polymer are both cationic, they are preferably derived from monomer compositions containing the same cationic monomers, and optionally, the same comonomers. Typically, however, the absolute content as well as the relative weight ratio to the comonomers contained in said monomer compositions differ from one another.

In a preferred embodiment, the weight average molecular weight of the ionic polymer is higher than the weight average molecular weight of the auxiliary ionic polymer.

Preferably, the weight average molecular weight of the ionic polymer is at least twice as high as the weight average molecular weight of the auxiliary ionic polymer, more preferably at least thrice, still more preferably at least four times, yet more preferably at least five times, most preferably at least six times and particularly at least seven times as high as the weight average molecular weight of the auxiliary ionic polymer.

Preferably, the relative ratio of the weight average molecular weight of the auxiliary ionic polymer to the weight average molecular weight of the ionic polymer is within the range of 1:2 to $1:10^6$, or 1:3 to $1:10^5$, or 1:4 to $1:10^4$, or 1:5 to 1:1000, or 1:6 to 1:500, or 1:7 to 1:400.

In a preferred embodiment, the relative ratio of the weight average molecular weight of the auxiliary ionic polymer to the weight average molecular weight of the ionic polymer is within the range of 1:(7±6), or 1:(10±6), or 1:(13±6), or 1:(16±6), or 1:(19±6) or 1:(22±6), or 1:(25±6), or 1:(28±6).

In a particularly preferred embodiment, (i) the ionic polymer is a cationic polymer comprising cationic monomer units derived from N,N,N-trialkylammoniumalkyl(meth)acrylate with a counter anion, preferably N,N,N-trimethylammoniumalkyl(meth)acrylate, more preferably N,N,N-trimethylammoniumethyl(meth)acrylate; or N,N,N-trialkylammoniumalkyl(meth)acrylamide with a counter anion, preferably N,N,N-trimethylammoniumalkyl (meth)acrylamide, more preferably N,N,N-trimethylammoniumpropyl(meth)acrylamide; or diallyldialkyl ammonium halide, preferably diallyldimethyl ammonium halide; and (ii) the auxiliary ionic polymer is a cationic polymer comprising monomer units derived from N,N,N-trialkylammoniumalkyl(meth)acrylamide with a counter anion, preferably N,N,N-trimethylammoniumalkyl(meth)acrylamide, more preferably N,N,N-trimethylammoniumpropyl(meth)acrylamide.

Preferably, (i) the ionic polymer has an ionicity within the range of from 20 to 45 mole.-%, more preferably 30.5±15 mole.-%, more preferably 30.5±7.5 mole.-%; and (ii) the auxiliary ionic polymer has an ionicity of at least 80 mole.-%, more preferably at least 85 mole.-%, still more preferably at least 90 mole.-% and in particular at least 95 mole.-%.

The auxiliary ionic polymer and the ionic polymer may be added to the thick stock at different or identical dosages.

In a preferred embodiment, (i) the ionic, preferably cationic polymer is added to the thick stock at a dosage of 50 to 6000 g/t, or 100 to 5000 g/t, or 200 to 4000 g/t, or 300 to 3000 g/t, or 400 to 2000 g/t, or 450 to 1500 g/t or 500 to 1000 g/t, based on the overall composition containing the cellulosic material; and (ii) the auxiliary ionic, preferably cationic polymer is added to the thick stock at a dosage of 10 to 400 g/t, or 20 to 300 g/t, or 30 to 250 g/t, or 40 to 200 g/t, or 50 to 175 g/t, or 60 to 150 g/t, or 75 to 125 g/t, based on the dry weight of the auxiliary ionic polymer and the weight of the overall composition containing the cellulosic material.

Particularly preferred embodiments $E^1$ to $E^6$ concerning the ionic polymer and the auxiliary ionic polymer according to the invention are summarized in Table 3 here below:

TABLE 3

| | $E^1$ | $E^2$ | $E^3$ | $E^4$ | $E^5$ | $E^6$ |
|---|---|---|---|---|---|---|
| | ionic polymer | | | | | |
| nature | copolymer | copolymer | copolymer | copolymer | copolymer | copolymer |
| charge | cationic | cationic | cationic | cationic | cationic | cationic |
| ionicity [mole.-%] | 30 ± 25 | 30 ± 20 | 30 ± 15 | 30 ± 10 | 30 ± 7.5 | 30 ± 5 |
| ionic monomer | general formula (I) | general formula (I) | general formula (I) | trialkylammonium-alkyl(meth)acylamide or trialkylammonium alkyl (meth)acrylate | DIMAPA quat.[1] or ADAME quat.[2] | DIMAPA quat.[1] or ADAME quat.[2] |
| non-ionic comonomer | general formula (II) | general formula (II) | general formula (II) | acrylamide | acrylamide | acrylamide |
| further ionic comonomer | no | no | no | no | no | no |
| average $M_w$ [g/mole] | >2,000,000 | >2,000,000 | >3,000,000 | >3,000,000 | >5,000,000 | >5,000,000 |

TABLE 3-continued

| | $E^1$ | $E^2$ | $E^3$ | $E^4$ | $E^5$ | $E^6$ |
|---|---|---|---|---|---|---|
| | | | auxiliary ionic polymer | | | |
| nature | homopolymer or copolymer | homopolymer or copolymer | homopolymer or copolymer | homopolymer or copolymer | homopolymer or copolymer | homopolymer |
| charge | cationic | cationic | cationic | cationic | cationic | cationic |
| ionicity [mole.-%] | ≥60 | ≥70 | ≥80 | ≥90 | ≥95 | 100 |
| ionic monomer | general formula (I) | general formula (I) | general formula (I) | trialkylammonium-alkyl(meth)acylamide | DIMAPA quat.[1] | DIMAPA quat.[1] |
| non-ionic comonomer | general formula (II) | general formula (II) | general formula (II) | acrylamide | acrylamide | acrylamide |
| ionic comonomer | no or (meth)acrylic acid | no or (meth)acrylic acid | no or (meth)acrylic acid | no | no | no |
| average $M_w$ [g/mole] | 100,000-2,000,000 | 120,000-2,000,000 | 200,000-1,900,000 | 300,000-1,800,000 | 400,000-1,750,000 | 500,000-1,500,000 |

[1]trimethylammoniumpropylacrylamide
[2]trimethylammonium ethylacrylate

Particularly preferred embodiments of the method according to the invention relate to combinations of any of embodiments $A^1$ to $A^6$ as summarized in Table 1 with any of embodiments $E^1$ to $E^6$ as summarized in Table 3; particularly $A^1+E^1$, $A^1+E^2$, $A^1+E^3$, $A^1+E^4$; $A^1+E^5$, $A^1+E^6$; $A^2+E^1$; $A^2+E^2$; $A^2+E^3$, $A^2+E^4$, $A^2+E^5$, $A^2+E^6$; $A^3+E^1$; $A^3+E^2$; $A^3+E^3$, $A^3+E^4$; $A^3+E^5$, $A^3+E^6$; $A^4+E^1$; $A^4+E^2$; $A^4+E^3$, $A^4+E^4$, $A^4+E^5$; $A^4+E^6$; $A^5+E^1$, $A^5+E^2$, $A^5+E^3$, $A^5+E^4$, $A^5+E^5$, $A^5+E^6$; $A^6+E^1$, $A^6+E^2$; $A^6+E^3$; $A^6+E^4$, $A^6+E^5$, or $A^6+E^6$.

Depending on the procedure used for the preparation of the ionic polymer and the auxiliary ionic polymer according to the invention, the respective polymer products may comprise further substances such as polyfunctional alcohols, water-soluble salts, chelating agents, free-radical initiators and/or their respective degradation products, reducing agents and/or their respective degradation products, oxidants and/or their respective degradation products, etc.

The ionic polymer and the auxiliary ionic polymer according to the invention may be solid, in the form of a solution, dispersion, emulsion or suspension.

For the purpose of the specification, the term "dispersion" comprises preferably aqueous dispersions, water-in-oil dispersions and oil-in-water dispersions. A person skilled in the art knows the meaning of these terms; in this respect it may be also referred to EP 1 833 913, WO 02/46275 and WO 02/16446.

Preferably, ionic polymer and the auxiliary ionic polymer according to the invention is dissolved, dispersed, emulsified or suspended in a suitable solvent. The solvent may be water, an organic solvent, a mixture of water with at least one organic solvent or a mixture of organic solvents.

In another preferred embodiment, the ionic polymer and the auxiliary ionic polymer according to the invention independently of one another is in the form of a solution, wherein the polymer is dissolved in water as the only solvent or in a mixture comprising water and at least one organic solvent.

More preferably, the ionic polymer and the auxiliary ionic polymer according to the invention independently of one another is in the form of a dispersion, an emulsion or a suspension, wherein the polymer is dispersed, emulsified or suspended in a mixture comprising water and at least one organic solvent. Preferably, polymer is in the form of a dispersion, an emulsion or a suspension, wherein the polymer is dispersed, emulsified or suspended in water as the only solvent, i.e. no organic solvent is present. In another preferred embodiment of the invention, the ionic polymer and the auxiliary ionic polymer according to the invention independently of one another is in the form of a dispersion, wherein the polymer is dispersed in water as the only solvent or in a mixture comprising water and at least one organic solvent. It is especially preferred that the ionic, preferably cationic or anionic polymer dispersion according to the invention is substantially oil-free.

In a preferred embodiment, the content of the ionic polymer and the auxiliary ionic polymer according to the invention independently of one another in the solution, dispersion, emulsion or suspension is at most 50 wt.-%, or at most 40 wt.-%, or at most 30 wt.-%, or at most 20 wt.-%, or at most 10 wt.-% based on the total weight of the solution, dispersion, emulsion or suspension.

Suitable organic solvents are preferably low-molecular weight alcohols (e.g., methanol, ethanol, n-propanol, iso-propanol, n-butanol, iso-butanol, sec-butanol, tert-butanol, etc.), low molecular weight ethers (e.g., dimethylether, diethylether, di-n-propylether, di-iso-propylether, etc.), low molecular weight ketones (e.g. acetone, buten-2-one, pentane-2-one, pentane-3-one, etc.), low molecular weight hydrocarbons (e.g., n-pentane, n-hexane, petroleum ether, ligroin, benzene, etc.) or halogenated low molecular weight hydrocarbons (e.g., methylene chloride, chloroform, etc.) or mixtures thereof.

When the polymer is employed in form of a dispersion, the ionic, preferably cationic or anionic polymer dispersion, which is preferably substantially oil-free, has a density of from 550 to 2,000 kg/m$^3$, or from 650 to 1,800 kg/m$^3$, or from 750 to 1,600 kg/m$^3$, or from 850 to 1,400 kg/m$^3$, or from 950 to 1,200 kg/m$^3$.

In a preferred embodiment, the ionic, preferably cationic or anionic polymer dispersion according to the invention, which is preferably substantially oil-free, has a product viscosity of from 1,000 to 20,000 mPa s, or from 3,000 to 18,000 mPa s, or from 5,000 to 15,000 mPa s, or from 8,000 to 12,000 mPa s, or from 9,000 to 11,000 mPa s.

When the ionic, preferably cationic or anionic polymer is employed in form of a polymer solution, the ionic, preferably cationic or anionic polymer solution preferably has a density from 550 to 2,000 kg/m$^3$, or from 650 to 1,800 kg/m$^3$, or from 750 to 1,600 kg/m$^3$, or from 850 to 1,400 kg/m$^3$, or from 950 to 1,100 kg/m$^3$.

In a preferred embodiment, the ionic, preferably cationic or anionic polymer solution has a product viscosity of from 300 to 3,000 mPa s, or from 500 to 2,750 mPa s, or from 1,000 to 2,500 mPa s, or from 1,500 to 2,250 mPa s, or from 1,900 to 2,100 mPas.

When the ionic, preferably cationic or anionic polymer is employed in form of a polymer emulsion, the ionic, preferably cationic or anionic polymer emulsion preferably has a density of from 550 to 2,000 kg/m$^3$, or from 650 to 1,800 kg/m$^3$, or from 750 to 1,600 kg/m$^3$, or from 850 to 1,400 kg/m$^3$, or from 900 to 1,300 kg/m$^3$.

In a preferred embodiment, the ionic, preferably cationic or anionic polymer emulsion has a product viscosity of from 1,000 to 3,500 mPa s, or from 1,200 to 3,250 mPa s, or from 1,400 to 3,000 mPa s, or from 1,600 to 2,700 mPa s, or from 1,800 to 2,200 mPa s.

The ionic, preferably cationic or anionic polymer according to the invention may also be a solid, i.e. in particulate form, such as in the form of granulates, pellets or powders.

Preferably, the ionic, preferably cationic or anionic polymer granulate has a bulk density of from 100 to 1,000 kg/m$^3$, or from 200 to 900 kg/m$^3$, or from 300 to 800 kg/m$^3$, or from 450 to 700 kg/m$^3$, or from 550 to 675 kg/m$^3$.

Preferably, the solid ionic, preferably cationic or anionic polymer particles (i.e., granules, pellets, powder particles, etc.) have an average diameter of from 100 to 5,000 μm, or from 100 to 4,000 μm, or from 100 to 3,000 μm, or from 100 to 2,000 μm, or from 100 to 1,000 μm.

The ionic, preferably cationic or anionic polymer in the form of a solution, dispersion, emulsion, suspension, granulate, pellets, or powder is preferably dispersed, emulsified, suspended, dissolved or diluted in a suitable solvent such as water, an organic solvent, a mixture of water with at least one organic solvent, or a mixture of at least two organic solvents, before being added to the cellulosic material.

In a particularly preferred embodiment of the method according to the invention, the biocide comprises an inorganic ammonium salt in combination with a halogen source, preferably a chlorine source, more preferably hypochlorous acid or a salt thereof; preferably $NH_4Br/NaOCl$; which is preferably added prior to or during pulping; and the ionic polymer is a cationic polymer which in turn is a copolymer derived from acrylamide and quaternized dialkylaminoalkyl (meth)acrylates or quaternized dialkyl-aminoalkyl(meth) acrylamides; preferably quaternized dialkylaminoalkyl (meth)acrylamides (i.e. trialkylammoniumalkyl(meth) acrylamides); which is preferably added to the cellulosic material in the thick stock area.

The method according to the invention is suitable for the manufacture of paper, paperboard or cardboard. Preferably, the paper, paperboard or cardboard has an area weight of less than 150 g/m$^2$, of from 150 g/m$^2$ to 600 g/m$^2$, or of more than 600 g/m$^2$. In a preferred embodiment, the area weight is within the range of 15±10 g/m$^2$, or 30±20 g/m$^2$, or 50±30 g/m$^2$, or 70±35 g/m$^2$, or 150±50 g/m$^2$.

In a preferred embodiment, starch is added to the cellulosic material at the papermaking machine. Because of the unexpected advantages of the invention, the amount of starch that needs to be added in order to achieve the desired paper properties is reduced, as the non-degraded starch, that was originally contained in the cellulosic material has been re-fixated to the cellulosic fibers by means of the cationic polymer, at least to a certain extent, whereas the starch that is optionally added to the cellulosic material at the papermaking machine is also fixated to the cellulosic fibers by means of the cationic polymer, at least to a certain extent.

For the purpose of the specification, the term "fixated" and "fixation" shall encompass both, the fixation of freshly added starch as well as the fixation of starch that is already contained in the system ("re-fixation"), e.g. originates from waste water.

It is known to a person skilled in the art that a compound that exerts these properties may be referred to as "retention aid", The ionic, preferably cationic or anionic polymer according to the invention and the auxiliary ionic polymer according to the invention may be used in combination with an additional retention aid. The term "retention aid", as used herein, refers to one or more components which, when being applied to a stock of cellulosic material, improve the retention compared to a stock of cellulosic material in which no retention aids are present. Suitable retention aids that may be employed in combination with the ionic, preferably cationic or anionic polymer according to the invention are preferably anionic microparticulate materials, including anionic inorganic particles, anionic organic particles, water-soluble anionic vinyl addition polymers, aluminium compounds and combinations thereof.

Anionic inorganic particles that can be used in combination with the ionic, preferably cationic or anionic polymer according to the invention include anionic silica-based particles and clays of the smectite type.

Anionic silica-based particles, i.e. particles based on $SiO_2$ or silicic acid, include colloidal silica, different types of polysilicic acid, colloidal aluminium-modified silica, aluminium silicates, and mixtures thereof. Anionic silica-based particles are usually supplied in the form of aqueous colloidal dispersions, so-called sols.

Clays of the smectite type that are suitable to be used in combination with the ionic, preferably cationic or anionic polymer according to the invention include montmorillonite/bentonite, hectorite, beidelite, nontronite and saponite, preferably bentonite.

Anionic organic particles that are preferably used in combination with the ionic, preferably cationic or anionic polymer according to the invention include highly cross-linked anionic vinyl addition polymers and co-polymers derivable from an anionic monomer such as acrylic acid, methacrylic acid and sulfonated vinyl addition monomers, which may be co-polymerized with non-ionic monomers, such (meth)acrylamide or alkyl(meth)acrylates; and anionic condensation polymers such as melamine-sulfonic acid sols.

Aluminium compounds that are preferably employed with the cationic polymer according to the invention include alum, aluminates such as sodium aluminate, aluminium chloride, aluminium nitrate and polyaluminium compounds. Suitable polyaluminium compounds are for example polyaluminium chlorides, polyaluminium sulphates, polyaluminium compounds containing both chloride and sulphate ions, polyaluminium silicate-sulphates, polyaluminium compounds and mixtures thereof. The polyaluminium compounds may also contain other anions, including anions derived from phosphoric acid, sulphuric acid, citric acid and oxalic acid.

Preferably, the ionic, preferably cationic or anionic polymer and the additional retention aid are employed in such a ratio that the retention is improved compared to cellulosic material containing either the ionic polymer alone or the additional retention aid alone.

In a preferred embodiment of the invention, the method comprises the additional step of (j) employing an auxiliary additive typically used in paper manufacture.

The invention can be used in a combination with other compositions in order to further improve the strength properties of the paper product. The compositions that may be used in combination with the invention can be a cationic, or an anionic, or an amphoteric, or a nonionic synthetic, or a natural polymer, or combinations thereof. For example, the invention can be used together with a cationic starch or an amphoteric starch.

In a preferred embodiment, the method according to the invention does not encompass the addition of cellulytic enzymes to the cellulosic material, preferably not the introducing of at least one cellulytic enzyme composition and at least one cationic polymer composition to a papermaking pulp at about the same time to form a treated pulp.

In particularly preferred embodiments of the method according to the invention, (i) in step (b) the one or more biocides are continuously or discontinuously added to the cellulosic material in quantities so that after 1 month of treatment on a continuously operating papermaking plant, the pH value of the aqueous phase of the cellulosic material has been increased by at least 0.2 pH units, compared to the pH value that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch; and/or after 1 month of treatment on a continuously operating papermaking plant, the electrical conductivity of the aqueous phase of the cellulosic material has been decreased by at least 5%, preferably at least 20%, more preferably at least 50%, compared to the electrical conductivity that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch; and/or after 48 hours, preferably after 8 hours on a continuously operating papermaking plant, the extinction of the starch (corresponding to the concentration of free starch) contained in the aqueous phase of the cellulosic material has been increased by at least 5%, compared to the extinction that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch; and/or after 48 hours, preferably after 8 hours on a continuously operating papermaking plant, the concentration of ATP in the aqueous phase of the cellulosic material has been decreased by at least 5%, compared to the concentration of ATP that was measured, preferably at the same location, preferably at the wet end entry of the papermaking machine immediately before biocide was added for the first time or before the addition of higher amounts of biocide than conventionally employed was started, i.e. compared to a situation where microorganisms had been degrading the starch; and/or after 48 hours, preferably after 8 hours on a continuously operating papermaking plant, the redox potential of the aqueous phase of the cellulosic material has been increased to an absolute value of at least −75 my;

and/or (ii) the one or more biocides comprise an ammonium salt; preferably $NH_4Br$ in combination with a halogen source, preferably a chlorine source, more preferably hypochlorous acid or a salt thereof; and/or the one or more biocides comprise an ammonium salt, preferably $NH_4Br$ in combination with hypochlorous acid or a salt thereof, as first biocide and an organic, preferably non-oxidizing biocide as further biocide;

(iii) the one or more biocides comprise an oxidizing biocide that is employed at a concentration equivalent to a concentration of at least 0.005% active substance as $Cl_2$ per ton produced paper, more preferably at least 0.010% active substance as $Cl_2$ per ton produced paper; and/or (iv) the one or more biocides are added to the thick stock, preferably at least a portion thereof is added to the dilution water for the pulper; and/or (v) the ionic polymer is added in combination with an auxiliary ionic polymer; and/or (vi) the ionic polymer and/or the auxiliary ionic polymer are cationic; preferably independently of one another derived from trialkylamoniumalkyl(meth)acrylamides and/or (vii) the starting material comprises virgin pulp or recycle pulp.

On a continuously operating papermaking plant, at which the paper manufacture may optionally be transiently shut down for maintenance purposes, a preferred embodiment of the invention includes the steps:

(A) measuring a property of the aqueous phase of the cellulosic material selected from the group consisting of electrical conductivity, redox potential, pH, concentration of ATP and concentration of free starch; at a predetermined location of the papermaking plant, preferably at a location in the thick stock area or in the thin stock area;

(B) manufacturing paper, paperboard or cardboard by the method according to the invention comprising steps (a), (b), ($h_1$) and optionally ($h_2$);

(C) measuring the same property as measured in step (A), preferably at the same location, preferably at the wet end entry of the papermaking machine of the papermaking plant as in step (A), after time Δt, preferably after 1, 2, 3, 4, 5, 10, 14, 21 or 28 days, and comparing the value measured in step (C) with the value measured in step (A); and (D) regulating, preferably optimizing the dosage of biocide added in step (b) and/or the dosage of ionic polymer added in step ($h_1$) and/or the dosage of auxiliary ionic polymer optionally added in step ($h_2$) in dependence of the result of the comparison made in step (C).

For the purpose of the specification, optimization preferably means that at minimized consumption of biocide, ionic polymer and auxiliary ionic polymer, respectively, the substantial alteration of the measured value ($m_2$ vs. $m_1$) is prevented.

Another aspect of the invention relates to a method as described above for (re-)fixation of starch to the cellulosic material, preferably to the cellulose fibers. This method according to the invention serves the purpose of refixating starch that is originally contained in the starting material (e.g. virgin pulp) and/or fixating starch that has been added elsewhere to the cellulosic material, preferably to the cellulose fibers, thereby resulting in a recycling of starch. All preferred embodiments that have been described above in connection with the method according to the invention also apply to this aspect of the invention and thus, are not repeated hereinafter.

Still another aspect of the invention relates to the use of the ionic, preferably cationic or anionic polymer as defined above, or the combination of the ionic, preferably cationic or anionic polymer with the auxiliary ionic, preferably cationic or anionic polymer as defined above, in the method for manufacturing paper, paperboard or cardboard, to increase the strength of paper, paperboard or cardboard, to increase papermaking machine drainage and/or production rate, and/or to reduce the effluent COD in the papermaking process as described above and/or for (re-)fixation of starch to the cellulosic material, preferably to the cellulose fibers. All preferred embodiments that have been described above in connection with the methods according to the invention also apply to this aspect of the invention and thus, are not repeated hereinafter.

Yet another aspect of the invention relates to the use of the biocide as defined above in the method for manufacturing paper, paperboard or cardboard, to increase the strength of paper, paperboard or cardboard, to increase papermaking machine drainage and/or production rate, and/or to reduce the effluent COD in the papermaking process as described above and/or for (re-)fixation of starch to the cellulosic material, preferably to the cellulose fibers. All preferred embodiments that have been described above in connection with the methods according to the invention also apply to this aspect of the invention and thus, are not repeated hereinafter.

Another aspect of the invention relates to the use of the auxiliary additive as defined above in the method for manufacturing paper, paperboard or cardboard, to increase the strength of paper, paperboard or cardboard, to increase papermaking machine drainage and/or production rate, and/or to reduce the effluent COD in the papermaking process as described above and/or for (re-)fixation of starch to the cellulosic material, preferably to the cellulose fibers. All preferred embodiments that have been described above in connection with the methods according to the invention also apply to this aspect of the invention and thus, are not repeated hereinafter.

EXAMPLES

The following experiments were run on different commercially used paper mills throughout Europe. Examples 1 and 4 were run on a closed system, whereas the other Examples were run on open systems. The starting material was in each case 100% recycled papers.

The following biocides and polymers were employed at the following dosages and feeding points are summarized in Table 4 here below:

TABLE 4

| Parameters for settings A, B, C and D | Setting A | Setting B | Setting C | Setting D |
|---|---|---|---|---|
| furnish types [CEPI] | 1.02<br>1.04<br>4.01 | 1.02<br>1.04 | 1.02<br>1.04 | 1.02<br>1.04<br>4.01<br>1.01 |
| $NH_4Br$ biocide | | | | |
| dosage [concentration of active substance equivalent to elemental chlorine, expressed in % active substance as $Cl_2$ per ton produced paper] | 0.020 | 0.019 | 0.019 | 0.017 |
| feeding points | pulper dilution water, white water 2, white water 1, clarified shower water | pulper dilution water, white water 1, clear filtrate, inlet clarification | pulper dilution water, white water 1, clear filtrate, inlet clarification | pulper dilution water, white water 2, white water 1, clarified shower water |
| organic biocide | | | | |
| dosage [g/ton paper] | 830 | 258 | 258 | 200 |
| feeding points | outlet pulper, inlet fiber clarification | outlet pulper, inlet fiber clarification | outlet pulper, inlet fiber clarification | outlet pulper |
| Polymer A | | | | |
| dosage [g/ton paper] | 600-1000 | 400 | 400 | 450 |
| feeding points | outlet machine chest; low dosage if starch content in furnish is low, high dosage if starch content in furnish is high | outlet machine chest | outlet machine chest | outlet machine chest |
| Auxiliary Polymer A | | | | |
| dosage [g/ton paper] | 400 | 300 | 300 | 300 |
| feeding points | outlet mixing chest | top of machine chest | top of machine chest | outlet mixing chest |

CEPI—Confederation of European Paper Industries

For comparative purposes, it should be noted that ammonium bromide biocide is conventionally employed at dosages of 0.005 to 0.008% active substance as $Cl_2$ per ton produced paper, i.e. the dosage employed in the experiments in accordance with the invention is 2 to 10 times higher than the conventional dosage.

Example 1

Using Setting A (Experiments Showing the Effects on Microbial Degradation and Starch Fixation on Cellulose when Using (a) Aux. Poly A but Neither Biocide Nor Poly A; (b) Aux. Poly A and Biocide, but no Poly A; and (c) Aux. Poly A, Biocide and Poly A)

The positive impact of the combined use of a biocide and a cationic polymer according to the invention was studied by the following experiment.

The biocide employed was a combination of an oxidizing two-component biocide comprising (a) 35% $NH_4Br$ and 13% NaOCl as an inorganic biocide, prepared in situ according to EP-A 517 102, EP 785 908, EP 1 293 482 and EP 1 734 009; and (b) bronopol/5-chloro-2-methyl-2H-isothiazol-3-one/2-methyl.2H-isothiazol-3-one (BNPD/Iso) as organic biocide.

The cationic polymer employed was a copolymer of acryl amide (approx. 69 mole-%) and quaternized N,N-dimethylaminopropyl acrylamide (DIMAPA-Quat.) (approx. 31 mole-%), having a molecular weight of approx. 10,000,000-20,000,000 g/mol, in the following also referred to as "Poly A" or "Polymer A".

As displayed in Table 4 above, all examples use an auxiliary cationic polymer in addition to Poly A, which for the sake of convenience will be described here. The auxiliary cationic polymer is a homopolymer of DIMAPA-Quat. (100 mole-%), having a molecular weight of >100,000 g/mol, in the following also referred to as "Aux. poly A" or "Auxiliary Polymer A".

First, a thick stock of recycled fibers having a consistency of 35 to 45 g/l (corresponding to 3.5 to 4.5% consistency) composed of cepi reference 1.04 was subjected to a pulping step.

By means of a comparative cone settlement study by means of an Imhoff funnel, the positive impact of the biocide and the cationic polymer on the remaining starch could then be made visible. Clear filtrate from a polydisk fiber recovery device was taken at 3 different conditions as described below.

Experiment a: The filtrate was treated with Aux. poly A, but neither with a biocide nor with Poly A. As a result, the filtrate had a high turbidity, containing lots of degradation products.

Experiment b: The filtrate was treated with biocide and Aux. poly A, but not with Poly A. As a result, the starch was prevented from microbiological degradation and settled to the bottom of the funnel.

Experiment c: The filtrate was treated with biocide, Poly A and Aux. poly A according to the invention. As a result, the starch got prevented from microbiological degradation and could therefore be fixed to the thick stock in its original properties. The starch was therefore not present in the filtrate anymore and the filtrate was thus clear with low consistency.

The test by means of the polydisk fiber recovery device revealed that only in experiment c the entire solution was clear, i.e. the starch could be prevented from being degraded and be effectively refixated to the cellulose fibers. In experiment a (absence of biocide and Poly A), however, the entire solution exhibited a substantial turbidity, indicating various degradation products which could not be effectively filtered off by the polydisk fiber recovery device. In experiment b (absence of Poly A) there was a starch settlement indicating that the starch could be prevented from being degraded, however, could not be effectively refixated to the cellulose fibers.

Experiments (a), (b) and (c) illustrate the importance of using all, the biocide, the Poly A and the Aux. poly A in order to prevent microbiological degradation and fix and/or re-fix the starch to the cellulose fibers of the thick stock.

Example 2

Using Setting A (Experiments Showing Effects Starch Fixation, Turbidity, and Drainage when Using Various Amounts of Poly A in Conjunction with Constant Amounts of Aux. Poly A and Biocide)

In the following experiment the biocide and the cationic polymer according to Example 1 were applied to a papermaking process as follows:

A thick stock of recycled fibers having a consistency of 35 to 45 g/l composed of either cepi reference 1.04 or 4.01 was subjected to a pulping step before being treated with biocide in order to prevent starch degradation.

Poly A as well as Aux. poly A was then added to the thick stock of the recycled pulp and mixed with said pulp to simulate machine chest addition. Then the sample was diluted either with tap water or white water to a thin stock of material having a concentration of 7 to 9 g/l. A standard retention aid program was then added and the sample was put into a VDT (vacuum drainage test) device or DFR device for analysis (DFR=Drainage Freeness Retention). A DFR device simulates the retention and the drainage conditions prevailing in a papermaking machine immediately before and during sheet formation.

The VDT is a pad-forming device, meaning the pulp is drained under vacuum onto a filter paper resulting in the formation of a pad. The VDT used herein consists of a Büchner funnel (diameter: 15 mm) which is placed onto a vacuum flask connected to a vacuum pump (LABOPORT, type N820 AN 18). For the VDT experiments, the thin pulp is transferred to the Büchner funnel and subsequently transferred by gravity to the vacuum dewatering chamber. The drainage rate (in seconds) was calculated by determining the time necessary to collect 100, 200, 300 and 400 mL of filtrate or white water. Additionally the vacuum was determined by means of a vacuum measurement device and the filtrate was used for determining the turbidity, starch concentration evolution (iodine test) and ionic demand.

For the starch concentration test, 10 mL of the filtrate were mixed with 5 mL of tap water and 10 mL of acetic acid and placed in a spectrometer (HACH DR 2010). For the measurements a wavelength of 550 nm was selected and the absorbance was set to zero %. To the sample 100 μL of an iodine solution N/10 were added and the resulting solution was mixed.

A positive starch test shows a range of color from blue to purple. A negative starch test shows a yellowish color. Up to an absorbance of 1.5, the intensity of color is directly proportional to the concentration of starch. Amylose is the portion of starch that is responsible for the formation of the deep blue color in presence of iodine. In contrast, amylopectin starch does not give the blue color. Native starch usually has its maximum absorbance at 550 nm and cationic starch at 620 nm.

According the procedure as described above, a variety of experiments were conducted with varying amounts of Poly A in each case in combination with constant amounts of Aux. poly A, using different batches of the thick stock (composed of either cepi reference 1.04 or 4.01 and having been treated with either biocide a or biocide b). For each batch, a comparative experiment (blank test) was conducted, wherein treatment with Poly A was omitted (ref. 1-7) but treatment with Aux. poly A was continued. This example was performed using setting A. As shown in Table 4 above, auxiliary polymer A (Aux. poly A) was dosed at 400 g/tons paper and its dose was kept constant. The dose of Poly A was varied within the range of 600 to 1000 g/tons paper as further specified (expressed in kg) in Table 5.

Figure 1:
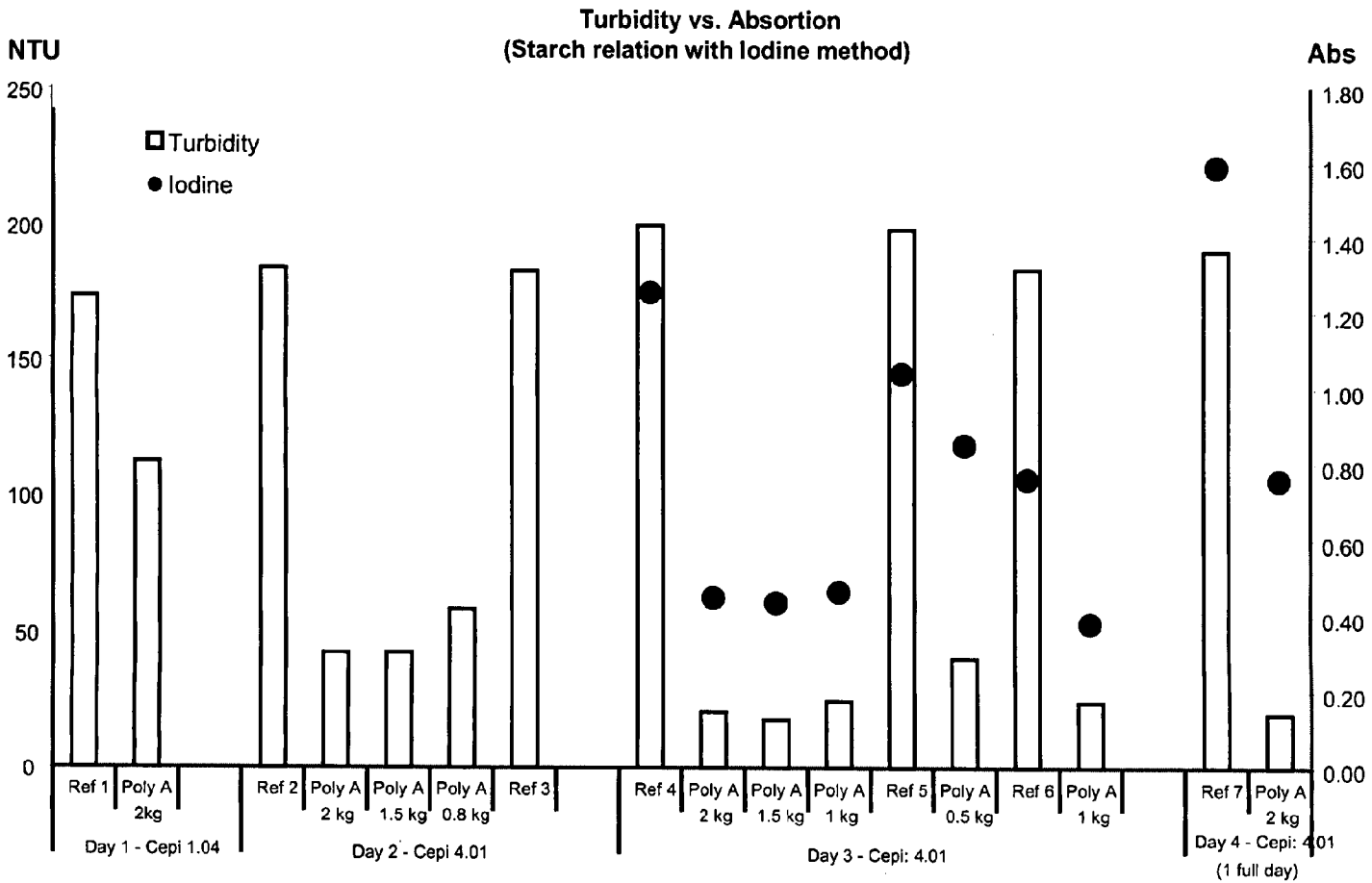
FIG. 1 shows the turbidity of the filtrates of the inventive examples after being treated with biocide and cationic polymer (0.5, 1.0, 1.5 or 2.0 kg/metric ton) and after being diluted to a thin stock. For comparison also the turbidity of the corresponding filtrate without cationic polymer is shown.
Figure 2:
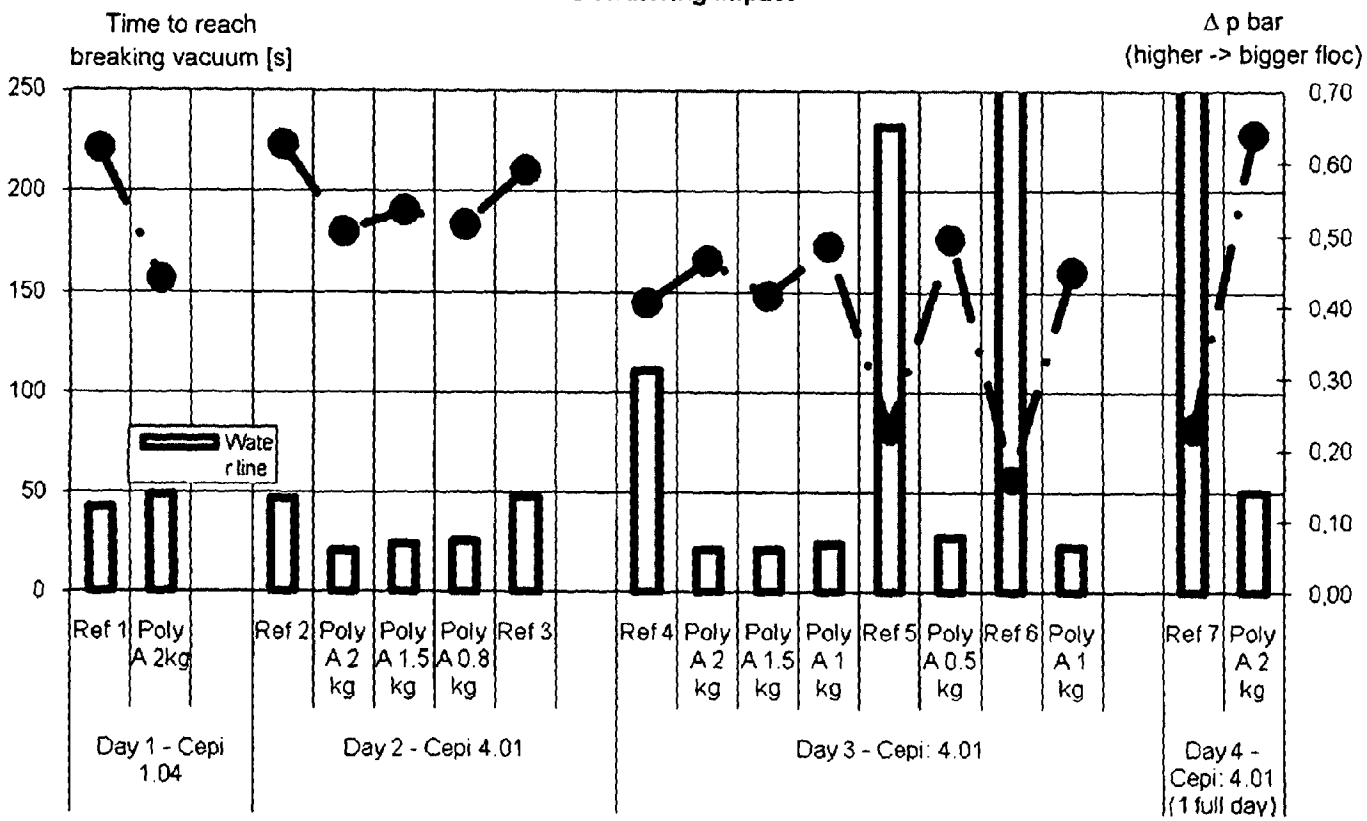
FIG. 2 shows the dewatering impact of the biocide and the cationic polymer by comparing the time to reach the maximum vacuum (breaking vacuum) and by comparing the difference between the maximum vacuum and the minimum vacuum of the inventive examples containing different amounts of cationic polymer (0.5, 1.0, 1.5 and 2.0 kg/metric ton) with the blank experiments.

The results of the VDT tests (vacuum drainage tests) are depicted in FIGS. 1-5 and summarized in Table 5 here below:

The results of the turbidity studies are depicted in FIG. 1 and Table 5.

If the comparative examples (ref. 1-7) (biocide+Aux. poly A but no Poly A) are compared to the inventive examples containing different amounts of Poly A (0.5, 1.0, 1.5 and 2.0 kg/metric ton) (biocide+Aux. poly A+Poly A), it is clear that by the presence of Poly A the turbidity of the solution is

TABLE 5

| Work session and Type of Furnish Polymer A | | Iodine level Absorption | Ion demand filtered | Turbidity NTU extract | TIME Vacuum max seconds | AVG (sec) Drainage | DRAINAGE RATE 100 ml seconds | 200 ml seconds | 300 ml seconds | 400 ml seconds |
|---|---|---|---|---|---|---|---|---|---|---|
| Day 1 - Cepi 1.04 | Ref 1 | | −1424 | 173 | 42.5 | 19 | 7 | 14.5 | 22.5 | 32 |
| | 2 kg | | −1442 | 112 | 49.0 | 18.5 | 6 | 12 | 21 | 35 |
| Day 2 - Cepi 4.01 | Ref 2 | | −1188 | 184 | 47.0 | 24.125 | 10 | 19.5 | 29 | 38 |
| | 2 kg | | −1313 | 42 | 21.0 | 10.5 | 5 | 9 | 12 | 16 |
| | 1.5 kg | | −1163 | 42.0 | 24.5 | 13.125 | 6 | 11 | 15.5 | 20 |
| | 0.8 kg | | −1300 | 58.0 | 26.0 | 13.875 | 6.5 | 11.5 | 16 | 21.5 |
| | Ref 3 | | −1335 | 183 | 47.5 | 24.5 | 10 | 19.5 | 29.5 | 39 |
| Day 3 - Cepi 4.01 | Ref 4 | 1.256 | −1275 | 200 | 111.0 | 47.1 | 12.5 | 32.5 | 57.5 | 86 |
| | 2 kg | 0.449 | −1183 | 21 | 21.5 | 11.0 | 5.5 | 9.5 | 13.5 | 17.5 |
| | 1.5 kg | 0.435 | −1048 | 17.8 | 21.5 | 11.6 | 5.5 | 9.5 | 13.5 | 18 |
| | 1 kg | 0.4635 | −1030 | 24.5 | 24.0 | 12.5 | 6.5 | 10.5 | 15.5 | 20 |
| | Ref 5 | 1.04 | | 198.0 | 232.5 | 89.8 | 19 | 62.5 | 109 | 168.5 |
| | 0.5 kg | 0.85 | | 40.0 | 27.5 | 14.5 | 6.5 | 11.5 | 17.5 | 22.5 |
| | Ref 6 | 0.76 | | 183.0 | 331.0 | 148.5 | 39 | 102 | 181 | 272 |
| | 1 kg | 0.38 | | 24.0 | 23.0 | 12.5 | 6 | 10 | 15 | 19 |
| Day 4 - Cepi: 4.01 | Ref 7 | 1.590 | | 190 | 382.0 | 134.0 | 29 | 80 | 161 | 266 |
| (1 full day) | 2 kg | 0.757 | | 20 | 50.5 | 23.8 | 8.5 | 18 | 28.5 | 40 |

| Work session and Type of Furnish Polymer A | | FLOC SIZE Pmax bar | Pmin bar | dP bar | BONE DRY WET weigth gram | DRY weigth gram | Wet-Dry gram | Bone Dry % |
|---|---|---|---|---|---|---|---|---|
| Day 1 - Cepi 1.04 | Ref 1 | 0.84 | 0.22 | 0.62 | 13.5 | 4.55 | 8.9 | 33.8 |
| | 2 kg | 0.72 | 0.28 | 0.44 | 13.1 | 4.4 | 8.7 | 33.6 |
| Day 2 - Cepi 4.01 | Ref 2 | 0.88 | 0.25 | 0.63 | 15.8 | 4.25 | 11.5 | 27.0 |
| | 2 kg | 0.60 | 0.10 | 0.51 | 18.7 | 4.6 | 14.1 | 24.8 |
| | 1.5 kg | 0.65 | 0.12 | 0.54 | 17.2 | 4.7 | 12.5 | 27.3 |
| | 0.8 kg | 0.64 | 0.13 | 0.52 | 17.3 | 4.75 | 12.5 | 27.5 |
| | Ref 3 | 0.85 | 0.26 | 0.59 | 16.5 | 4.6 | 11.9 | 27.9 |
| Day 3 - Cepi 4.01 | Ref 4 | 0.98 | 0.58 | 0.41 | 14.0 | 3.65 | 10.3 | 26.2 |
| | 2 kg | 0.59 | 0.13 | 0.47 | 12.1 | 3.75 | 8.3 | 31.1 |
| | 1.5 kg | 0.58 | 0.16 | 0.42 | 12.3 | 3.8 | 8.5 | 30.9 |
| | 1 kg | 0.64 | 0.16 | 0.49 | 12.1 | 3.8 | 8.3 | 31.4 |
| | Ref 5 | 0.98 | 0.75 | 0.23 | 15.3 | 3.7 | 11.6 | 24.6 |
| | 0.5 kg | 0.68 | 0.18 | 0.50 | 12.4 | 3.7 | 8.7 | 30.0 |
| | Ref 6 | 0.98 | 0.82 | 0.16 | 31.6 | 3.9 | 27.7 | 12.3 |
| | 1 kg | 0.60 | 0.15 | 0.45 | 12.1 | 3.7 | 8.4 | 30.6 |
| Day 4 - Cepi: 4.01 | Ref 7 | 0.98 | 0.75 | 0.23 | 15.8 | 3.9 | 11.9 | 24.7 |
| (1 full day) | 2 kg | 0.85 | 0.21 | 0.64 | 13.1 | 3.95 | 9.2 | 30.2 |

If the comparative examples (ref. 4, ref. 5 and ref. 6) (biocide+Aux. poly A but no Poly A) are compared with the inventive examples containing different amounts of Poly A (0.5, 1.0, 1.5 and 2.0 kg/metric ton) (biocide+Aux. poly A+Poly A), it is clear that the starch concentration in the filtrate has been reduced significantly by the presence of Poly A. For example, with 1.0 kg/metric ton of Poly A the starch concentration has been reduced by 50-65%. The concentration of the starch is reduced with an increasing amount of Poly A. As can be seen from a comparison of the inventive examples, the optimal dose for Poly A in this embodiment is at about 1.0 kg/metric ton. When Poly A was applied to the cellulosic material in an amount of 0.5 kg/metric ton, a small positive effect could still be observed.

Apparently part of the starch has not been released to the solution, but has been retained in the fiber or has been refixated to the fiber instead.

reduced. In case of the batch of day 3 (cepi 4.01), for instance, with 1.0 kg/metric ton of Poly A the starch concentration has been reduced from 200 NTU to 24.5 NTU. Except for one case, the turbidity has been reduced by more than 67%.

Both tests imply that the starch residuals have been fixed to the fibers which result in a mean strength improvement for the paper and in clearer white water.

Regarding the VDT studies, Table 5 shows the drainage rate (time to obtain 100, 200, 300 and 400 ml of filtrate) and the time to reach the maximum vacuum for the pulp. The drainage curves are additionally shown in FIG. 2. Generally, the time to reach the maximum vacuum was reduced significantly in presence of the cationic polymer Poly A resulting in a higher average vacuum and a reduced drainage rate.

During the drainage process the maximum vacuum and minimum vacuum are measured and the difference is calculated as an indication for the floc size, higher floc size will mean a degraded formation. After the drainage procedure, the wet weight of the resulting pad is determined before it is dried for 2 hours in an oven set at 105° C. and the dry weight is determined. The higher the bone dry value (percentage of the dry pad vs. the wet pad: The higher mean dryer pad), the dryer the pad has left the drainage process and the dryer a corresponding sheet would reach the press section of the corresponding papermaking process. The results of the floc size and bone dry weight studies depending on the content of Poly A are shown in Table 5 and FIG. 4.

Figure 3:
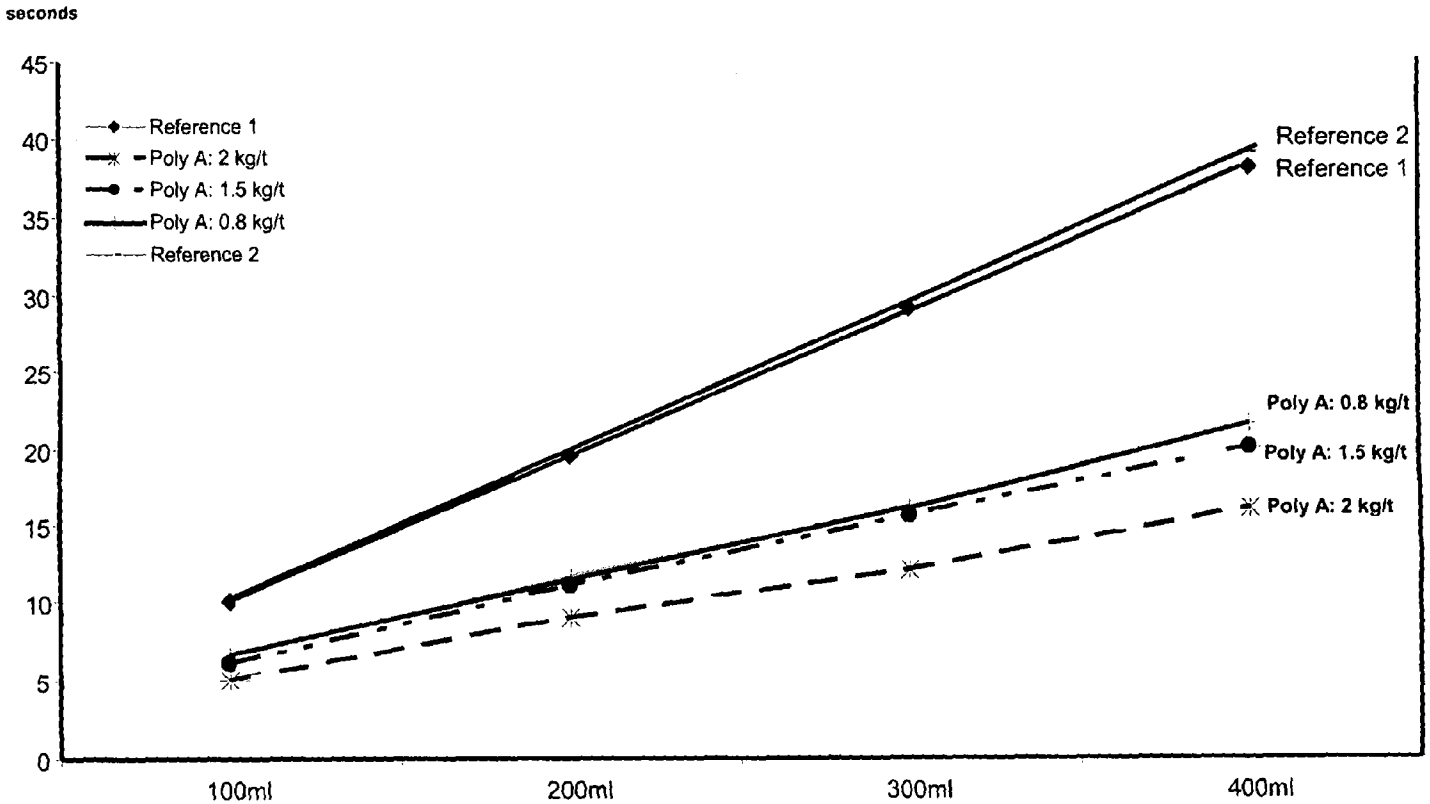
FIG. 3 shows the drainage rates (time to obtain 100, 200, 300 and 400 ml of filtrate) of the inventive examples and comparative examples after being subjected to a VDT study.
Figure 4:
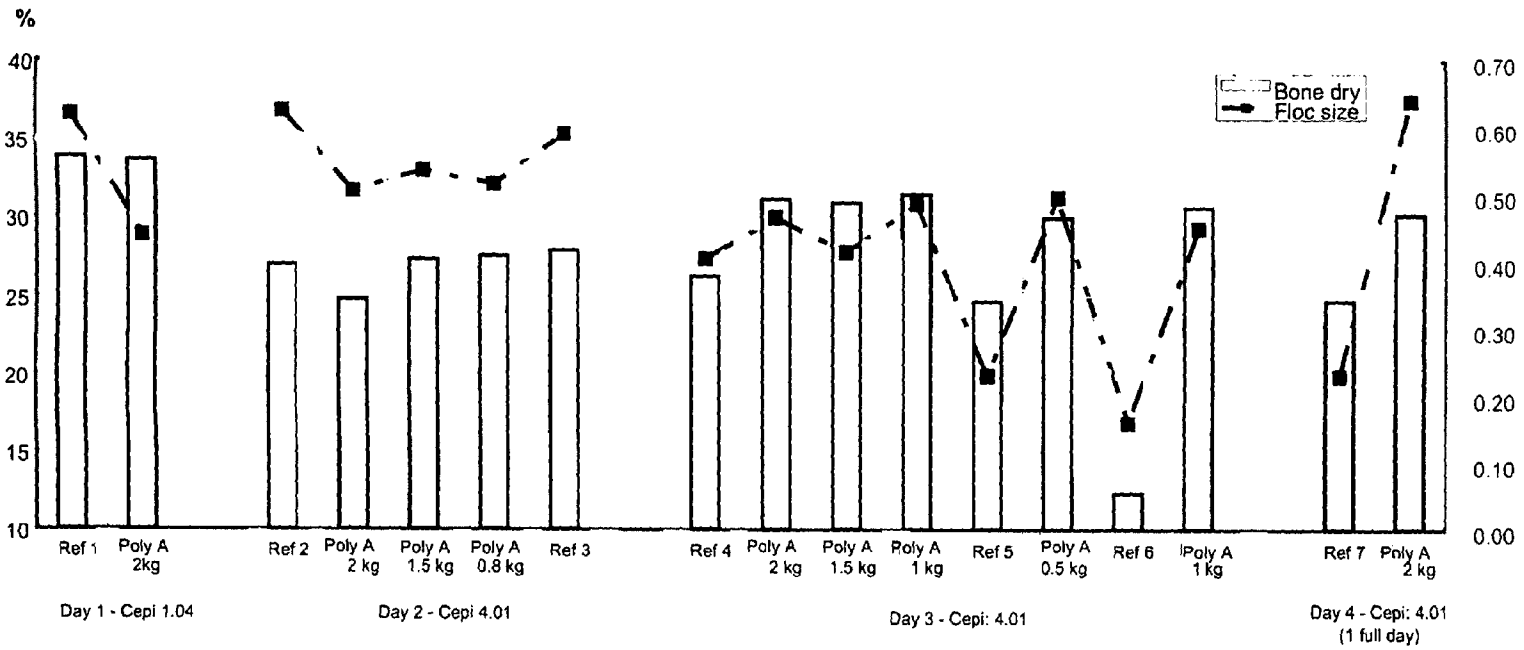
FIG. 4 shows the bone dry weight depending on the amount of the cationic polymer added.
Figure 5:
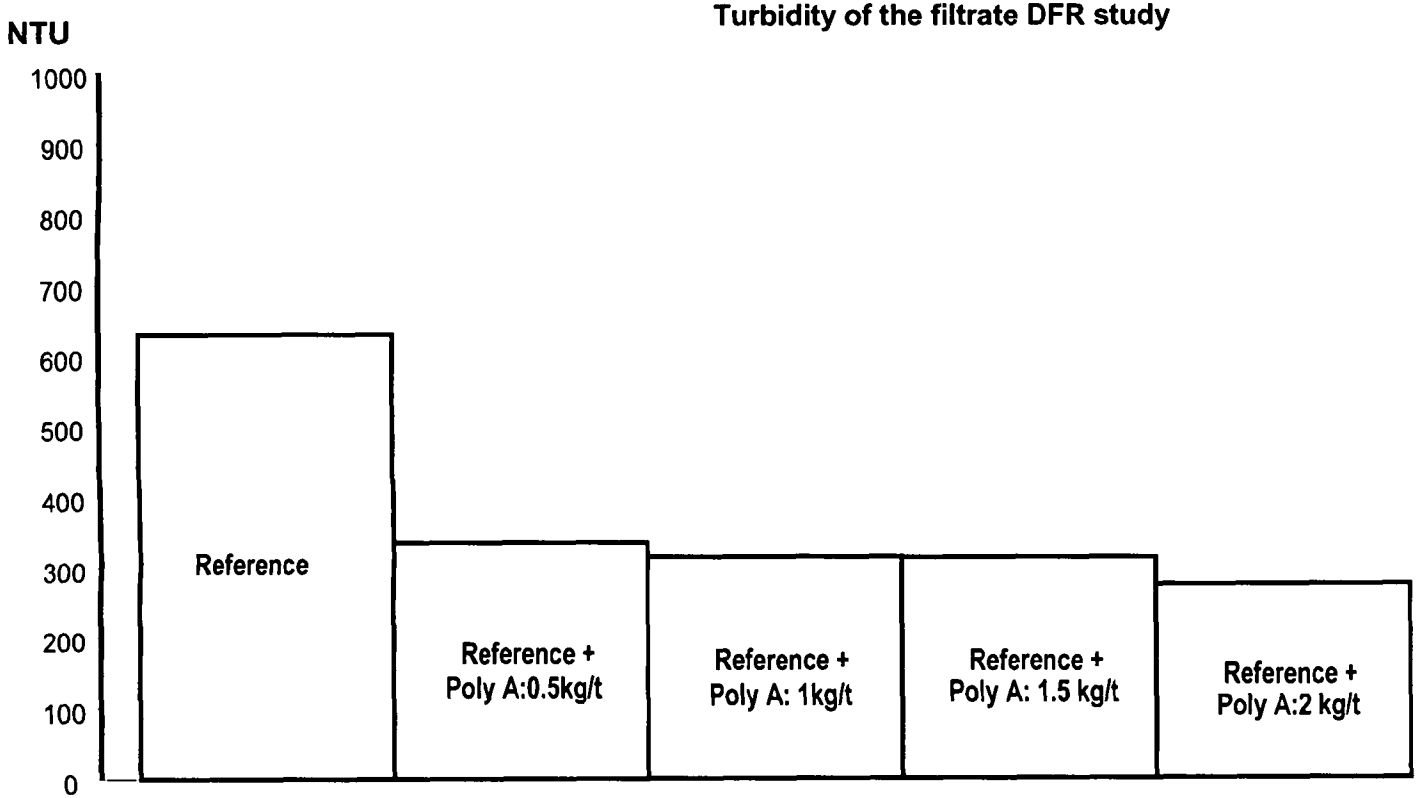
FIG. 5 shows the turbidity of the filtrates of the inventive examples after being treated with biocide and cationic polymer and after being diluted to a thin stock.
Figure 6:
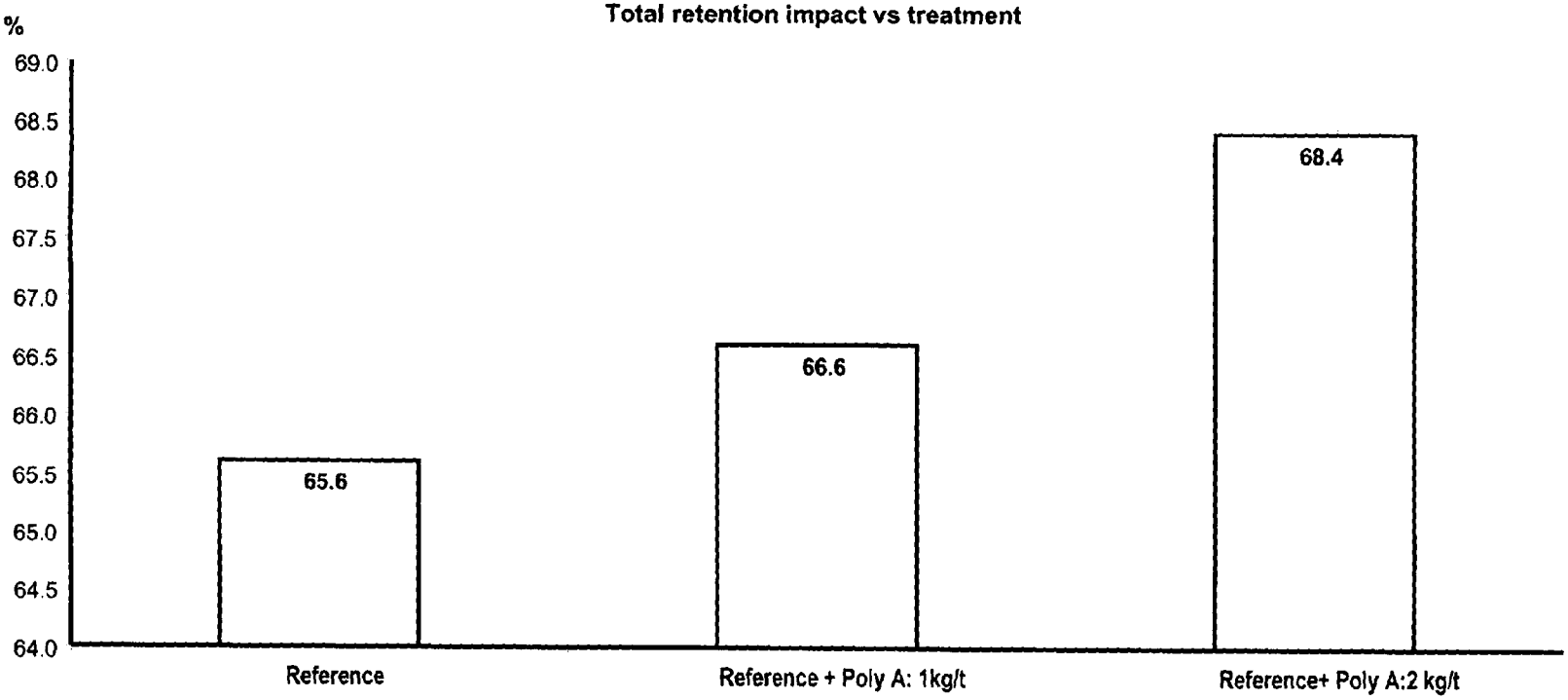
FIG. 6 shows the total retention impact of a sample depending on the content of the cationic polymer.
Figure 7:
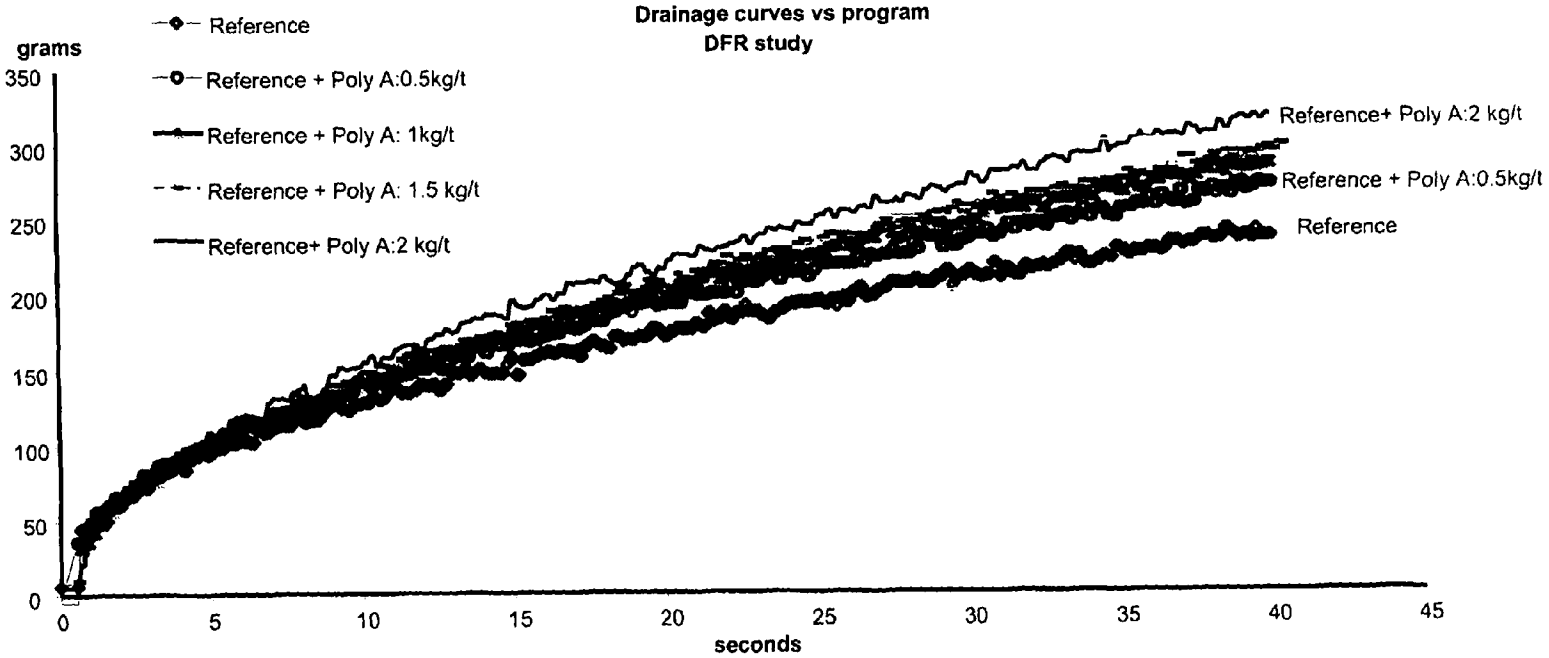
FIG. 7 shows the drainage rates (time to obtain 100, 200, 300 and 400 ml of filtrate) of inventive examples and comparative examples after being subjected to a VDT study.
Figure 8:
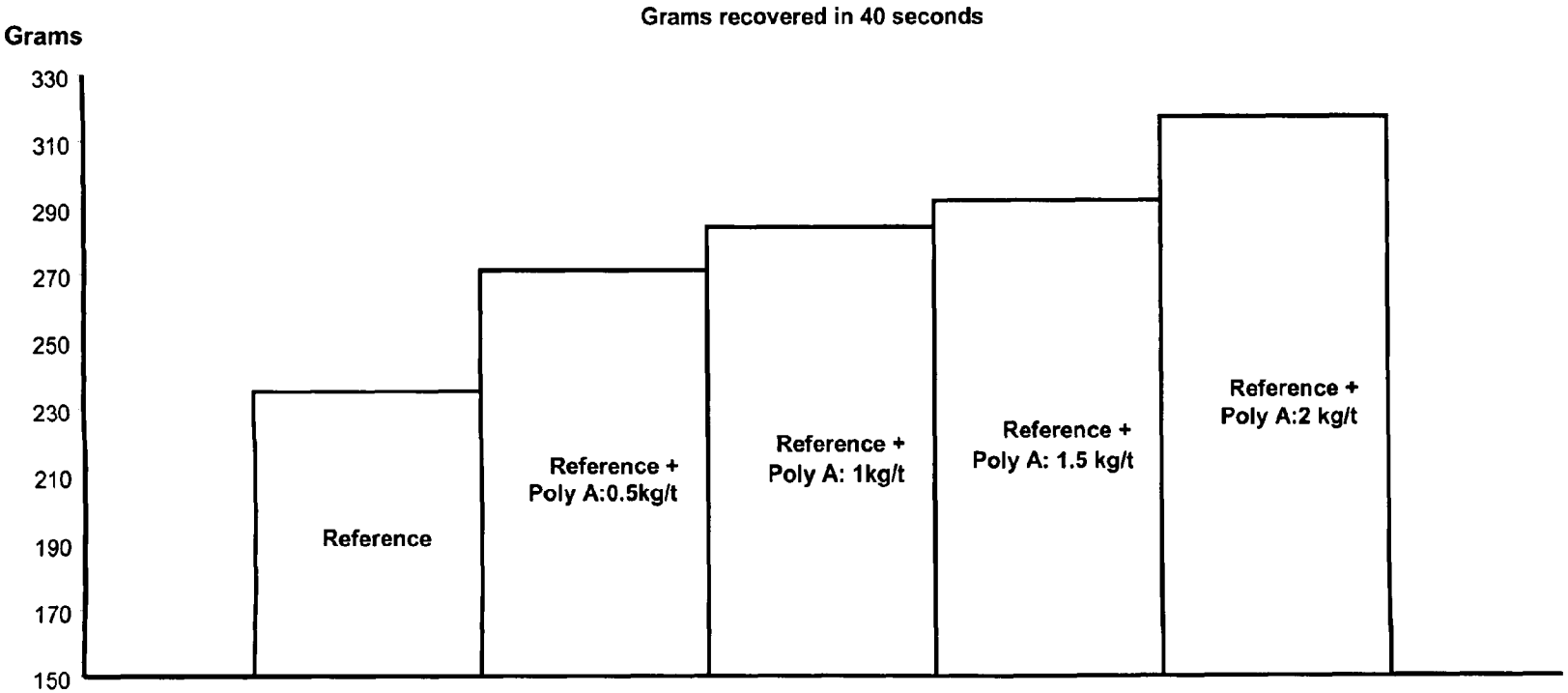
FIG. 8 shows the amount of cellulosic material recovered after 40 seconds of drainage time for the inventive and comparative examples.
Figure 9:
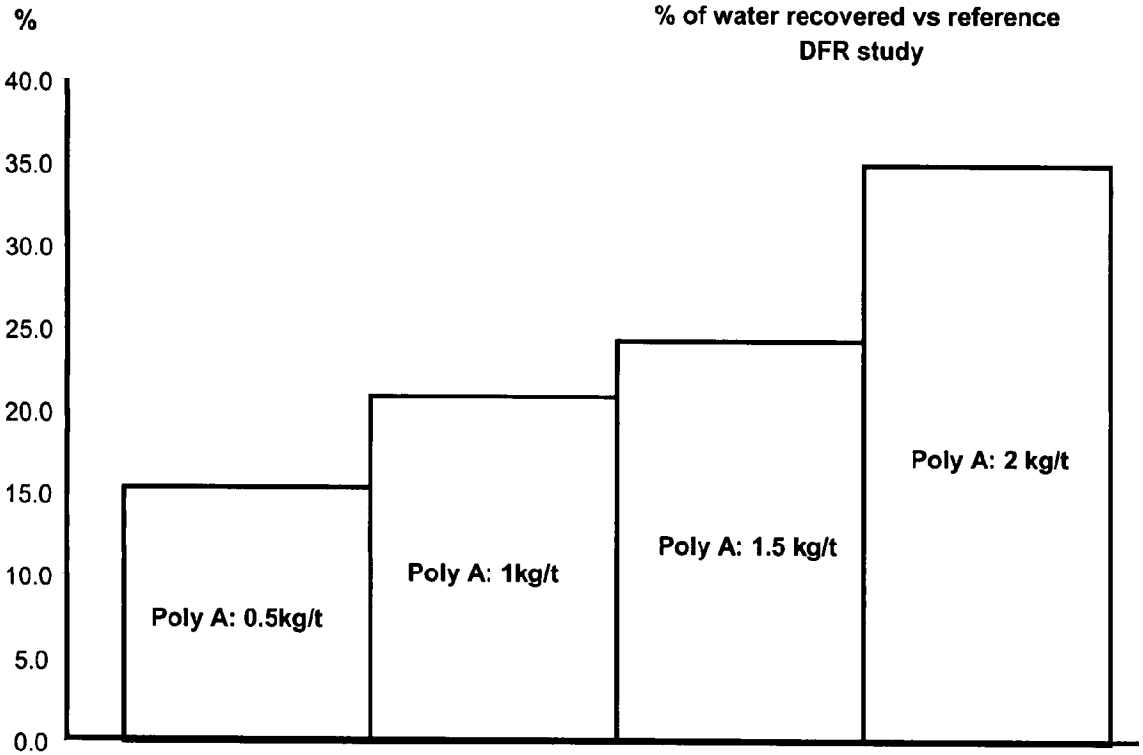
FIG. 9 shows the amount of water (in %) recovered for the inventive examples containing the cationic polymer in comparison with the reference.

If the comparative examples (ref. 1-7) (biocide+Aux. poly A but no Poly A) are compared to the inventive examples containing different amounts of Poly A (0.5, 1.0, 1.5 and 2.0 kg/metric ton) (biocide+Aux. poly A+Poly A), it is clear that by increasing the Poly A level, all the parameters related to the drainage: Drainage curves—"Water line"—Bone dry reflect the positive trend (FIGS. 3-5). With regard to the VDT results, it is clear that Poly A improves the VDT on all parameters.

Example 3

Using Setting A (Laboratory Simulation Experiments Showing the Effects on Drainage, Retention and Turbidity when Using Poly A/Aux. Poly A and No Poly A/Aux. Poly A, Respectively)

Four thin stocks of cellulosic material containing different amounts of Poly A (0.5, 1.0, 1.5 or 2.0 kg/metric ton), Aux. poly A and the standard retention aid were prepared and analyzed in accordance with Example 2, i.e. the polymers were dosed to the thick stock which was subsequently diluted to yield thin stock. Further, a comparative experiment (blank test) was conducted, wherein the treatment with Poly A and Aux. poly A was omitted The data of the DFR experiments are depicted in FIGS. 6 to 10 and summarized in Table 6 here below:

TABLE 6

| | Drainage weight [g] - 40 seconds | % vs. Reference | Total retention % | Turbidity |
|---|---|---|---|---|
| Reference | 235 | 0.0 | 65.6 | 630 |
| Reference + Poly A: 0.5 kg/t + Aux. poly A: 0.4 kg/t | 271 | 15.3 | | 334 |
| Reference + Poly A: 1.0 kg/t + Aux. poly A: 0.4 kg/t | 284 | 20.9 | 66.6 | 314 |
| Reference + Poly A: 1.5 kg/t + Aux. poly A: 0.4 kg/t | 292 | 24.3 | | 313 |
| Reference + Poly A: 2.0 kg/t + Aux. poly A: 0.4 kg/t | 317 | 34.9 | 68.4 | 274 |

The results of the turbidity study show that the turbidity is reduced already with 0.5 kg/metric ton of Poly A (Table 4 and FIG. 5), which is again an indication for an effective starch fixation.

With regard to the DFR results, it is clear that the retention and drainage were also improved by the presence of Poly A (Table 4 and FIGS. 7-10). The extent to which both the retention and the drainage were improved depended on the amount of Poly A added.

All in all, the tests performed indicate that Poly A in combination with Aux. poly A improves the fixation of not degraded starch when added in the thick stock of recycled fiber treated with a biocide. This effect is expected to translate into a strength improvement of the final paper.

The following examples were run on papermaking machines, not in the laboratory, in order to demonstrate that the invention also works under real conditions. This is important, as it is known to the skilled artisan that in paper manufacture, laboratory results cannot always be transferred to industrial, up-scaled processes.

Example 4

Using Setting A (Experiments Showing Effect on Starch Reduction in White Water when Using Biocide in Combination with Only Aux. Poly A but in Absence of Poly A, and Biocide in Combination with Poly A and Aux. Poly A)

In the following comparative experiment the combined use of the biocide, the cationic polymer Poly A and the auxiliary cationic polymer Aux. poly A according to Example 1 was compared to the use of the biocide and Aux. poly A only.

The comparative experiment was run on a papermaking machine equipped with a closed water recycle circuit and the papermaking process was monitored for 92 consecutive days.

In the papermaking process, a thick stock of recycled fibers having a consistency of 35 to 45 g/l composed of mixed furnishes was subjected to a pulping step before being treated with the biocide in order to prevent starch degradation.

Two conditions were tested within the testing period:

Experiment a) Aux. poly A was added to the thick stock of cellulosic material at the machine chest.

Experiment b) Poly A and Aux. poly A were added to the thick stock of cellulosic material at the machine chest.

A comparative cone settlement study was conducted next. For this study, a filtrate taken from the process water was transferred to a conic glass (Imhof funnel) and the amount of starch settled to the bottom of the funnel was measured relative to the total volume of the suspension.

The results of this test are depicted in Table 7 here below:

TABLE 7

| | ml starch sediment/ l process water | measured as average value over |
|---|---|---|
| Aux. poly A | 12 | 18 days |
| Aux. poly A and Poly A | 0 | 4 days |
| Aux. poly A | 9 | 52 days |
| Aux. poly A and Poly A | 0 | 2 days |
| Aux. poly A | 40 | 6 days |
| Aux. poly A and Poly A | 0 | 3 days |
| Aux. poly A | 10 | 3 days |
| Aux. poly A and Poly A | 1 | 4 days |

It is clear from the above table that the amount of starch in the whitewater solids is reduced by the combined use of biocide, Poly A and Aux. poly A compared to the use of only the biocide and Aux. poly A. It also is clear that this effect can be "switched on and off".

Example 5

Using Setting D (Experiments Showing Effect of Starch Reduction in Whitewater when Both Biocide and Poly A are Used in Absence of Aux. Poly A; and when Biocide, Poly A and Aux. Poly A are Used)

In this experiment, the combined use of the biocide, the cationic polymer Poly A and the auxiliary cationic polymer Aux. poly A according to Example 1 was compared to the use of the biocide and Poly A only.

The comparative experiment was run on a papermaking machine equipped with an open water circuit and the papermaking process was run continuously during the entire testing period. In the papermaking process, a thick stock of recycled fibers having a consistency of 35 to 45 g/l composed of mixed furnishes was subjected to a pulping step before being treated with the biocide in order to prevent starch degradation. For this purpose, the white water of the papermaking machine was analyzed by means of the starch concentration test as disclosed in Example 1. During day 1, the cellulosic material was treated with the biocide after the pulping step, and the cationic polymer Poly A was added to the thick stock of cellulosic material at the machine chest. On the following days, the auxiliary cationic polymer Aux. poly A was additionally added to the thick stock of cellulosic material at the machine chest. The white water of the papermaking machine was analyzed at different times according to the starch concentration test according to Example 1.

The results of this test are depicted in Table 8 here below:

TABLE 8

| Date | time | Aux. poly A kg/t (liquid, 25 wt.-% solids content) | Poly A kg/t | Iodine absorption WW | |
|---|---|---|---|---|---|
| day 1 | 10:25 | — | 1.10 | 1.90 | comparative |
| day 1 | 14:00 | — | 1.00 | 1.28 | |

TABLE 8-continued

| Date | time | Aux. poly A kg/t (liquid, 25 wt.-% solids content) | Poly A kg/t | Iodine absorption WW | |
|---|---|---|---|---|---|
| day 1 | 16:30 | — | 1.00 | 1.26 | |
| day 2 | 13:20 | 0.50 | 1.00 | 0.16 | inventive |
| day 2 | 14:45 | 0.50 | 1.00 | 0.18 | |
| day 2 | 17:25 | 0.50 | 1.00 | 0.16 | |
| day 2 | 18:15 | 0.50 | 1.00 | 0.13 | |
| day 2 | 19:55 | 0.50 | 1.00 | 0.17 | |
| day 3 | 11:10 | 0.50 | 1.00 | 0.12 | |
| day 3 | 15:05 | 0.50 | 1.00 | 0.22 | |
| day 3 | 17:30 | 0.50 | 1.00 | 0.24 | |

It becomes apparent from these results that the amount of starch in the white water (expressed as Iodine absorption) is further reduced when a combination of Poly A and Aux. poly A is applied to the papermaking process.

Example 6

Using Setting A (Experiments Showing the Effects on Dry Strength on Different Types of Paper when Using Combination of Biocide, Poly A, and Aux. Poly A)

The strength results are summarized in Table 9 here below:

TABLE 9

| | grade | | size press starch concentration | % change | CMT N | % change | SCT lä kN/m | % change | SCT qu kN/m | % change |
|---|---|---|---|---|---|---|---|---|---|---|
| a | Fluting 100 g/m$^2$ | without invention | 11.3 | −9.2 | 166.4 | 7.6 | 3.0 | 14.9 | 1.54 | 1.84 |
| | | with invention | 10.2 | | 179.1 | | 3.4 | | 1.82 | |
| b | Fluting 105 g/m$^2$ | without invention | 11.5 | −8.9 | 176.8 | 6.3 | 3.2 | 10.7 | 1.59 | 21.2 |
| | | with invention | 10.5 | | 188.1 | | 3.5 | | 1.93 | |
| c | Liner 115 g/m$^2$ | without invention | 11.0 | −8.6 | 225.4 | 7.8 | 3.4 | 11.4 | 1.73 | 12.0 |
| | | with invention | 10.0 | | 243.0 | | 3.8 | | 1.94 | |
| d | Liner 125 g/m$^2$ | without invention | 11.0 | −8.5 | 234.2 | 5.2 | 3.6 | 9.0 | 1.85 | 12.4 |
| | | with invention | 10.1 | | 246.3 | | 4.0 | | 2.08 | |
| e | Fluting 135 g/m$^2$ | without invention | 11.2 | −12.1 | 242.9 | 7.9 | 3.9 | 8.6 | 2.02 | 8.9 |
| | | with invention | 9.8 | | 262.1 | | 4.3 | | 2.20 | |
| f | Liner 140 g/m$^2$ | without invention | 11.8 | −8.9 | 289.9 | 0.7 | 4.4 | 7.1 | 2.36 | 5.1 |
| | | with invention | 10.7 | | 291.9 | | 4.8 | | 2.48 | |
| g | Liner 160 g/m$^2$ | without invention | 11.6 | −6.8 | 305.0 | 10.2 | 5.1 | 4.9 | 2.69 | 2.2 |
| | | with invention | 10.8 | | 336.0 | | 5.3 | | 2.75 | |

CMT—Flat Crush of Corrugated Medium Test (measure for the flat crush resistance of corrugated board)
SCT—Short Span Compression Test (measure for the compression resistance of paper)

It is clear from the above experimental results that the method according to the invention substantially increases the dry strength of paper, paperboard and cardboard at reduced dosage of fresh surface starch.

Example 7

Using Setting B (Experiments Showing the Effects on Dry Strength at Different Basis Weights when Using Combination of Biocide, Poly A, and Aux. Poly A)

The basis weight refers to the paper density in mass (as weight) per number of sheets. Experimental details are contained in Table 13.

The strength results for basis weights of 100, 110 and 120 are summarized in Table 10 here below:

TABLE 10

| | basis weight | | Size Press Starch conc. | % change | SCT index CD | % change | RCT | % change | CMT | % change |
|---|---|---|---|---|---|---|---|---|---|---|
| a | 100 | without invention | 7.8 | −9.6 | 1.94 | 15.2 | 0.56 | 37.5 | 158.0 | 2.8 |
| | 100 | with invention | 7.1 | | 2.24 | | 0.77 | | 162.5 | |
| b | 110 | without invention | 7.9 | −0.4 | 2.08 | 16.8 | 0.88 | 31.8 | 171.8 | 5.2 |
| | 110 | with invention | 7.9 | | 2.43 | | 1.16 | | 180.7 | |
| c | 120 | without invention | 8.4 | −11.0 | 2.24 | 23.7 | 1.23 | 53.7 | 186.5 | 12.6 |
| | 120 | with invention | 7.5 | | 2.77 | | 1.89 | | 210.0 | |

Example 8

Using Setting C (Experiments Showing the Effects on Dry Strength at Different Basis Weights when Using Combination of Biocide, Poly A, and Aux. Poly A)

Experimental details are contained in Table 13.

The strength results are summarized in Table 11 here below:

TABLE 11

| | Basis weight | | size press starch concentration | % change | Burst index | % change | SCT cd index kN · m/kg | % change | SCT MD index kN · m/kg | % change |
|---|---|---|---|---|---|---|---|---|---|---|
| a | 120 | without invention | 7.8 | −1.2 | 2.18 | 15.5 | 16.4 | 12.8 | 28.5 | 13.5 |
| | 120 | with invention | 7.7 | | 2.52 | | 18.5 | | 32.3 | |
| b | 130 | without invention | 7.7 | 8.7 | 2.20 | 7.4 | 16.0 | 9.8 | 28.1 | 11.1 |
| | 130 | with invention | 8.3 | | 2.36 | | 17.6 | | 31.2 | |
| c | 140 | without invention | 7.8 | −0.5 | 2.19 | | 15.5 | 8.1 | 27.8 | 7.6 |
| | 140 | with invention | 7.7 | | | | 16.7 | | 29.9 | |
| d | 160 | without invention | 8.2 | −2.6 | 2.16 | 6.0 | 16.0 | 6.2 | 26.9 | 9.8 |
| | 160 | with invention | 8.0 | | 2.29 | | 16.9 | | 29.5 | |
| e | 170 | without invention | 8.0 | −7.7 | 2.09 | 4.3 | 15.8 | 4.2 | 25.5 | 5.8 |
| | 170 | with invention | 7.4 | | 2.18 | | 16.4 | | 27.0 | |
| f | 190 | without invention | 8.3 | −1.9 | 2.07 | 2.9 | 14.9 | 10.1 | 24.8 | 9.6 |
| | 190 | with invention | 8.2 | | 2.13 | | 16.4 | | 27.2 | |
| g | 200 | without invention | 8.2 | −10.1 | 2.12 | 1.4 | 15.9 | 4.0 | 25.5 | 4.8 |
| | 200 | with invention | 7.4 | | 2.15 | | 16.6 | | 26.7 | |

Example 9

Using Setting D (Experiments Showing the Effects on Dry Strength at Different Basis Weights when Using Combination of Biocide, Poly A, and Aux. Poly A)

Experimental details are contained in Table 13.

The strength results are summarized in Table 12 here below:

TABLE 12

| | Grade | | Size Press Starch conc. | % reduction | synthetic dry strength agent g/ton | % reduction |
|---|---|---|---|---|---|---|
| a | Liner 100 g/m$^2$ | without invention | 5.3 | −17.0 | 3900 | −100 |
| | | with invention | 4.4 | | 0 | |
| b | Liner 110 g/m$^2$ | without invention | 5.3 | −14.2 | 3900 | −100 |
| | | with invention | 4.5 | | 0 | |
| c | Liner 115 g/m$^2$ | without invention | 5.2 | −10.1 | 3900 | −100 |
| | | with invention | 4.6 | | 0 | |
| d | Liner 120 g/m$^2$ | without invention | 5.2 | −11.2 | 3900 | −100 |
| | | with invention | 4.6 | | 0 | |
| e | Liner 125 g/m$^2$ | without invention | 5.0 | −11.5 | 3900 | −100 |
| | | with invention | 4.5 | | 0 | |

TABLE 12-continued

| | Grade | | Size Press Starch conc. | % reduction | synthetic dry strength agent g/ton | % reduction |
|---|---|---|---|---|---|---|
| f | Liner 140 g/m$^2$ | without invention | 5.0 | −1.2 | 3900 | −100 |
| | | with invention | 4.9 | | 0 | |
| g | Liner 160 g/m$^2$ | without invention | 4.9 | −9.5 | 3900 | −100 |
| | | with invention | 4.4 | | 0 | |
| h | Liner 175 g/m$^2$ | without invention | 5.1 | −2.6 | 3900 | −100 |
| | | with invention | 5.0 | | 0 | |

It is clear from the above experimental results that the method according to the invention substantially increases the dry strength of paper, paperboard and cardboard. Accordingly, the amount of fresh starch applied at the size can be reduced and at maintained strength, additional synthetic dry strength agents can be completely omitted or at least their amount can be reduced.

Some additional experimental results that were observed during the machine runs using Settings A to D are summarized in Table 13 here below:

TABLE 13

| | Setting A | Setting B | Setting C | Setting D |
|---|---|---|---|---|
| pH changes (average) | | | | |
| conventional biocide | 6.21[1] | 6.87[2] | 6.97[2] | 6.93[2] |
| inventive biocide | 7.30[3] | 7.54[3] | 7.54[3] | 7.57[3] |
| electrical conductivity changes (average, [μS/cm]) | | | | |
| conventional biocide | 15,190[1] | 3,520[2] | 3,520[2] | 2,500[2] |
| inventive biocide | 7,860[3] | 1,775[3] | 1,775[3] | 1,370[3] |
| ATP changes (average, [RLU]) | | | | |
| conventional biocide | 119,000[1] | 96,000[2] | 96,000[2] | 214,000[2] |
| inventive biocide | 19,600[3] | 34,377[3] | 34,377[3] | 11,958[3] |
| Redox potential (average, [mV]) | | | | |
| conventional biocide | −112[1] | 6[2] | 6[2] | −12[2] |
| inventive biocide | 96[3] | 124[3] | 124[3] | 180[3] |
| starch content (iodine test) | | | | |
| conventional biocide | 0.00[1] | n.d. | n.d. | n.d. |
| with step b | 2.49 | 2.30 | 2.63 | 1.41 |
| with step h | 0.27 | 1.95 | 1.80 | 0.59 |
| COD (average, [ppm]) | | | | |
| with step b | 45,714 | 6,138 | 6,138 | 5,096 |
| with step h additionally | 48,044 | 5,378 | 5,378 | 4,138 |
| clear filtrate difference (average) condition a | | | | |
| consistency [mg/l] | 54 | n.d. | n.d. | n.d. |
| starch settlement [ml/l] | n.d. | n.d. | n.d. | n.d. |
| condition b | | | | |
| consistency [mg/l] | 67 | n.d. | n.d. | n.d. |
| starch settlement [ml/l] | 17 | n.d. | n.d. | n.d. |
| condition c | | | | |
| consistency [mg/l] | 38.2 | n.d. | n.d. | n.d. |
| starch settlement [ml/l] | 3 | n.d. | n.d. | n.d. |
| turbidity (average, [NTU]) | | | | |
| with step b | 204 | 445 | 445 | 317 |
| with step h additionally | 93 | 200 | 200 | 99 |

[1]organic biocide in conventional amounts, absence of $NH_4Br$ biocide

[2]$NH_4Br$ biocide in conventional amounts, absence of organic biocide

[3]combination of $NH_4Br$ biocide with organic biocide in increased amounts as set forth in Table 4

Example 10

Using Setting A (Experiments Showing Effect on Biocide Dosage when Poly A and Aux. Poly A are Used and when Aux. Poly A is Used Alone)

The role of the ionic polymer in the combination of biocide and auxiliary ionic polymer according to the invention was investigated. For that purpose, biocide was added in quantities that were sufficient under the given conditions to keep the process parameters below a threshold value.

In the beginning of the experiment, biocide was employed in combination with Poly A and Aux. poly A (where "+" indicates addition). After about one month, however, the addition of Poly A was interrupted (where "−" indicates interruption), while the addition of Aux. poly A was continued, and it was investigated whether the dose of biocide needed to be adapted in order to satisfy the predetermined threshold requirement. The results are summarized in Table 14 here below and depicted in FIG. 10:

TABLE 14

| Day | Poly A/Aux. poly A | biocide needed* |
|---|---|---|
| 1 | +/+ | 0.018 |
| 2 | +/+ | 0.018 |
| 3 | +/+ | 0.018 |
| 4 | +/+ | 0.018 |
| 5 | +/+ | 0.018 |
| 6 | +/+ | 0.018 |
| 7 | +/+ | 0.018 |
| 8 | +/+ | 0.018 |
| 9 | +/+ | 0.018 |
| 10 | +/+ | 0.020 |
| 11 | +/+ | 0.020 |
| 12 | +/+ | 0.020 |
| 13 | +/+ | 0.020 |
| 14 | +/+ | 0.020 |
| 15 | +/+ | 0.020 |
| 16 | +/+ | 0.020 |
| 17 | +/+ | 0.020 |
| 18 | +/+ | 0.020 |
| 19 | +/+ | 0.020 |
| 20 | +/+ | 0.020 |
| 21 | +/+ | 0.018 |
| 22 | +/+ | 0.018 |
| 23 | +/+ | 0.018 |
| 24 | +/+ | 0.020 |
| 25 | +/+ | 0.020 |
| 26 | +/+ | 0.020 |
| 27 | +/+ | 0.020 |
| 28 | +/+ | 0.020 |
| 29 | +/+ | 0.020 |
| 30 | −/+ | 0.020 |
| 31 | −/+ | 0.027 |
| 32 | −/+ | 0.027 |
| 33 | −/+ | 0.027 |
| 34 | −/+ | 0.027 |
| 35 | +/+ | 0.027 |
| 36 | +/+ | 0.021 |
| 37 | +/+ | 0.021 |
| 38 | +/+ | 0.020 |
| 39 | +/+ | 0.020 |
| 40 | +/+ | 0.020 |
| 41 | +/+ | 0.018 |
| 42 | +/+ | 0.018 |
| 43 | +/+ | 0.017 |
| 44 | +/+ | 0.017 |
| 45 | +/+ | 0.017 |
| 46 | +/+ | 0.017 |
| 47 | +/+ | 0.017 |
| 48 | +/+ | 0.017 |
| 49 | +/+ | 0.017 |
| 50 | +/+ | 0.016 |
| 51 | +/+ | 0.016 |
| 52 | +/+ | 0.016 |

*expressed as concentration equivalent to chlorine in % active substance as $Cl_2$ per ton produced paper.

It is clear from the above data that in the absence of ionic polymer according to the invention, the dose of the biocide must be increased by about 40% (from 0.020 to 0.027) in order to keep the process stable. It appears that in the absence of ionic polymer the system is enriched with starch which in turn is a nutrient for the microorganisms. Accordingly, more biocide is needed in this period in order to suppress the microbiological degradation of starch.

Example 11

Laboratory Simulation Experiments Showing the Effects on Drainage, Starch Retention and Turbidity when Using Aux. Poly A in Combination with Poly A, Aux. Poly A Always being Added to the Thick Stock and Poly A being Added Either in Different Thick Stock Locations or to the Thin Stock Four thick stocks (3.5%) of recycled cellulosic material containing biocide but no polymer were prepared. All samples were stirred for 50 seconds as thick stock before being diluted to thin stock with clear filtrate to achieve the same consistency like in the headbox of the papermaking machine (0.89%). The furnish for the blank remained without any chemicals.

Samples 2, 3 and 4 were all treated with 300 g/t the Aux. poly A after 5 out of 50 seconds to simulate an early thick stock application. Sample 2, 3 and 4 were additionally treated with Poly A (0.6 kg/metric ton for all samples). Sample 2 was treated with Poly A after 10 out of 50 seconds which is corresponding to early thick stock addition. Sample 3 was treated with Poly A after 30 out of 50 seconds to simulate a late thick stock application. Sample 4 was treated with Poly A in thin stock, i.e. after dilution, to demonstrate a very late dosage in thin stock.

The experimental results are summarized in Table 15 here below and shown in FIG. 11:

TABLE 15

| | Sample no. | Drainage weight - 30 sec | % vs Reference | Turbidity | Starch adsorbtion |
|---|---|---|---|---|---|
| Blank | 1 | 396 | 0 | 2227 | 0.34 |
| early thick stock (10 s) | 2 | 463 | 14.5 | 1447 | 0.15 |
| thick stock (30 s) | 3 | 471 | 15.9 | 1288 | 0.16 |
| thin stock (after dilution) | 4 | 496 | 20.2 | 1008 | 0.12 |

The results of the turbidity study show that the turbidity and starch concentration in white water is also reduced when Poly A is added to the thin stock at 0.6 kg/metric ton, which is an indication for an effective starch refixation.

With regard to the DFR results, it is clear that the retention and drainage were also improved by the presence of Poly A (Table 2 and FIGS. 7-10). The extent to which both the retention and the drainage were improved depended on the feeding point where the Poly A was added.

All in all, the tests performed indicate that Poly A, particularly in combination with Aux. Poly A, improves the fixation of not degraded starch also when added in the late thick stock or thin stock of recycled fiber treated with a biocide. This effect is expected to translate into a strength improvement of the final paper.

The invention claimed is:

1. A method for manufacturing paper, paperboard or cardboard comprising the steps of (a) pulping a cellulosic material containing a starch;

(b) treating the cellulosic material containing the starch with one or more biocides in an amount sufficient to prevent microbiological degradation of at least a portion of the starch; and (c) adding an ionic polymer and an auxiliary ionic polymer to the cellulosic material;

wherein the ionic polymer and the auxiliary ionic polymer are cationic;

wherein the relative difference between the ionicity of the auxiliary ionic polymer and the ionicity of the ionic polymer is at least 5 mole.-%, wherein the ionicity is the molar content of ionic monomer units relative to the total amount of monomer units; and wherein the ionic polymer has a higher average molecular weight than the auxiliary ionic polymer.

2. The method according to claim 1, wherein (i) the ionic polymer comprises cationic monomer units derived from N,N,N-trialkylammoniumalkyl (meth) acrylate, N,N,N-trialkylammoniumalkyl (meth)acrylamide or diallyldialkyl ammonium halide; and (ii) the auxiliary ionic polymer comprises monomer units derived from N,N,N-trialkylammoniumalkyl (meth) acrylamide.

3. The method according to claim 1, wherein the auxiliary ionic polymer has a higher ionicity than the ionic polymer; and wherein the relative difference between the ionicity of the auxiliary ionic polymer and that of the ionic polymer is at least 30 mole.-%.

4. The method according to claim 3, wherein (i) the ionic polymer has an ionicity within the range of from 20 to 45 mole.-%; and (ii) the auxiliary ionic polymer has an ionicity of at least 90 mole.-%.

5. The method according to claim 1, wherein the ionic polymer and/or the auxiliary ionic polymer are added to the cellulosic material in a thick stock area, where the cellulosic material has a stock consistency of at least 2.0 wt.-%.

6. The method according to claim 1, wherein the ionic polymer and/or the auxiliary ionic polymer are added to the cellulosic material in a thin stock area, where the cellulosic material has a stock consistency of less than 2.0 wt.-%.

7. The method according to claim 1, wherein the one or more biocides are continuously or discontinuously added to the cellulosic material in quantities so that after 1 month of treatment, the pH value of the aqueous phase of the cellulosic material has been increased by at least 0.2 pH units, compared to the pH value that was measured immediately before biocide was added for the first time; and/or after 1 month of treatment, the electrical conductivity of the aqueous phase of the cellulosic material has been decreased by at least 5%, compared to the electrical conductivity that was measured immediately before biocide was added for the first time; and/or after 48 hours, the extinction of the starch contained in the aqueous phase of the cellulosic material has been increased by at least 5%, compared to the extinction that was measured immediately before biocide was added for the first time.

8. The method according to claim 1, wherein the one or more biocides are dosed in an amount of at least 5.0 g/metric ton, based on the total amount of the composition containing the cellulosic material and the starch.

9. The method according to claim 1, wherein the one or more biocides are added to the cellulosic material in the thick stock area, where the cellulosic material has a stock consistency of at least 2.0%.

10. The method according to claim 1, wherein the one or more biocides are added in section (I) and/or (II); and optionally also in section (III) and/or (IV) of a papermaking plant comprising a papermaking machine, wherein section (I) includes measures taking place before pulping; section (II) includes measures associated with pulping; section (III) includes measures taking place after pulping but still outside the papermaking machine; and section (IV) includes measures taking place inside the papermaking machine.

11. The method according to claim 1, wherein the one or more biocides comprise an inorganic ammonium salt in combination with a halogen source.

12. The method according to claim 1, wherein the one or more biocides are oxidative and/or comprise two components.

13. The method according to claim 1, wherein additionally to the one or more biocides added in step (b), a further biocide is added to the cellulosic material which differs from the one or more biocides added in step (b).

14. The method according to claim 13, wherein the further biocide is added in section (I) and/or (II); and optionally, also in section (III) and/or (IV) of a papermaking plant comprising a papermaking machine, wherein section (I) includes measures taking place before pulping; section (II) includes measures associated with pulping; section (III) includes measures taking place after pulping but still outside the papermaking machine; and section (IV) includes measures taking place inside the papermaking machine.

15. The method according to claim 13, wherein the further biocide is non-oxidizing.

16. The method according to claim 13, wherein the further biocide is an organic biocide selected from the group consisting of quaternary ammonium compounds, benzyl-$C_{12-16}$-alkyldimethyl chlorides (ADBAC), polyhexamethylenebiguanide (biguanide), 1,2-benzisothiazol-3(2H)-one (BIT), bronopol (BNPD), bis(trichloromethyl)sulfone, diiodomethyl-p-tolylsulfone, bronopol/quaternary ammonium compounds, benzyl-$C_{12-16}$-alkyldimethyl chlorides (BNPD/ADBAC), bronopol/didecyldimethylammonium chloride (BNPD/DDAC), bronopol/5-chloro-2-methyl-2H-isothiazol-3-one/2-methyl-2H-isothiazol-3-one (BNPD/Iso), NABAM/sodium dimethyldithiocarbamate, sodiumdimethyl-dithiocarbamate-N,N-dithiocarbamate (NABAM), sodiummethyldithiocarbamate, sodium dimethyldithiocarbamate, 5-chloro-2-methyl-4-isothiazolin-3-one (CMIT), 2,2-dibromo-2-cyanoacetamide (DBNPA), DBNPA/bronopol/iso (DBNPA/BNPD/Iso), 4,5-dichloro-2-n-octyl-3-isothiazolin-3-one (DCOIT), didecyldimethylammonium chloride (DDAC), didecyldimethylammoniumchloride, alkyldimethylbenzylammoniumchloride (DDAC/ADBAC), dodecylguanidine monohydrochloride/quaternary ammonium compounds, benzyl-$C_{12-16}$-alkyldimethyl chlorides (DGH/ADBAC), dodecylguanidine monohydrochloride/methylene dithiocyanate (DGH/MBT), gluteraldehyde (Glut), gluteraldehyde/quaternary ammonium compounds/benzyl-coco alkyldimethyl chlorides (Glut/coco), gluteraldehyde/ didecyldimethylammonium chloride (Glut/DDAC), gluteraldehyde/5-chloro-2-methyl-2H-isothiazol-3-one/2-methyl-2H-isothiazol-3-one (Glut/Iso), gluteraldehyde/methylene dithiocyanate (Glut/MBT), 5-chloro-2-methyl-2H-isothiazol-3-one/2-methyl-2H-isothiazol-3-one (Iso), methylene dithiocyanate (MBT), 2-methyl-4-isothiazolin-3-one (MIT), methamine oxirane (methamine oxirane), sodium bromide (NaBr), nitromethylidynetrimethanol, 2-n-octyl-3-isothiazolin-3-one (OIT), bis(trichloromethyl) sulphone/quaternary ammonium compounds, benzyl-$C_{12-16}$-alkyldimethyl chlorides (sulphone/ADBAC), symclosene, terbuthylazine, dazomet (thione), tetrakis(hydroxymethyl)phosphonium sulphate(2:1) (TRPS) and p-[(diiodomethyl)-sulphonyl]toluene (tolyl sulphone), and mixtures thereof.

17. The method according to claim 1, wherein the ionic polymer and/or the auxiliary ionic polymer is added at the machine chest, mixing chest and/or regulating box.

18. The method according to claim 1, wherein the ionic polymer and/or the auxiliary ionic polymer has a weight average molecular weight $M_w$ of at least 100,000 g/mol.

19. The method according to claim 1, wherein the ionic polymer and/or the auxiliary ionic polymer contains at least 5.0 mole-% of cationic monomer units.

20. The method according to claim 1, wherein (i) the ionic polymer is added in section (II) and/or (III) and/or (IV); and (ii) the auxiliary ionic polymer is added in section (II) and/or (III) and/or (IV);

of a papermaking plant comprising a papermaking machine, wherein section (II) includes measures associated with pulping; section (III) includes measures taking place after pulping but still outside the papermaking machine; and section (IV) includes measures taking place inside the papermaking machine.

21. The method according to claim 1, which is for (re-)fixation of the starch to the cellulosic material; and/or to increase the strength of paper, paperboard or cardboard; and/or to increase papermaking machine drainage and/or production rate; and/or to reduce the effluent COD in the papermaking process; and/or to reduce the amount of nutrients for microorganisms in the cellulosic material; and/or to reduce the consumption of fresh starch by recycling starch that is already contained in the starting material and/or the water circuit of the papermaking plant.

22. The method according to claim 1, wherein the ionic polymer contains 2.5 to 40 mole.-% of cationic monomer units.

23. The method according to claim 1, wherein (i) the ionic polymer has an ionicity of at least 5 mole.-%; and (ii) the auxiliary ionic polymer has an ionicity of at least 90 mole.-%.

24. The method according to claim 1, wherein the cationic monomer that has been used in the manufacture of the ionic polymer and/or the auxiliary ionic polymer is selected from the group consisting of quaternized dialkylaminoalkyl(meth) acrylates with $C_1$ to $C_6$-alkyl and $C_1$ to $C_6$-alkylene groups, quaternized dialkylaminoalkyl(meth)acrylamides with $C_1$ to $C_6$-alkyl and $C_1$ to $C_6$-alkylene groups, and diallyldimethyl ammonium chloride.

25. The method according to claim 1, wherein the ionic polymer and the auxiliary ionic polymer independently of one another comprise cationic monomer units selected from the group consisting of quaternized N,N-dimethylaminoethyl acrylate, quaternized N,N-dimethylaminopropyl acrylamide and diallyldimethyl ammonium chloride, and further comprise non-ionic monomer units selected from the group consisting of acrylamide, methacrylamide, vinylamide and vinylamine.

26. The method according to claim 1, wherein (i) the ionic polymer comprises cationic monomer units derived from N,N,N-trialkylammoniumalkyl (meth) acrylate, N,N,N-trialkylammoniumalkyl (meth)acrylamide or diallyldialkyl ammonium halide; and (ii) the auxiliary ionic polymer comprises monomer units derived from diallyldialkyl ammonium halide.

27. The method according to claim 1, wherein (i) the ionic polymer comprises cationic monomer units derived from quaternized N,N-dimethylaminoethyl acrylate; and (ii) the auxiliary ionic polymer comprises monomer units derived from diallyldialkyl ammonium halide.

28. The method according to claim 1, wherein (i) the ionic polymer comprises cationic monomer units derived from diallyldimethyl ammonium chloride; and (ii) the auxiliary ionic polymer comprises monomer units derived from diallyldimethyl ammonium chloride.

29. The method according to claim 1, wherein (i) the ionic polymer comprises cationic monomer units derived from N,N,N-trialkylammoniumalkyl(meth) acrylamide; and (ii) the auxiliary ionic polymer comprises monomer units derived from diallyldimethyl ammonium chloride.

30. The method according to claim 1, wherein (i) the ionic polymer comprises cationic monomer units derived from N,N,N-trialkylammoniumalkyl(meth) acrylamide; and (ii) the auxiliary ionic polymer comprises monomer units derived from N,N,N-trialkylammoniumalkyl (meth) acrylamide.

31. The method according to claim 1, wherein (i) the ionic polymer comprises cationic monomer units derived from diallyldimethyl ammonium chloride; and (ii) the auxiliary ionic polymer comprises monomer units derived from N,N,N-trialkylammoniumalkyl (meth) acrylamide.

* * * * *